US012497770B2

(12) United States Patent
Blank et al.

(10) Patent No.: US 12,497,770 B2
(45) Date of Patent: Dec. 16, 2025

(54) AIR INDUCER ASSEMBLY FOR PRESSURIZED FLUSH TANK

(71) Applicant: Sloan Valve Company, Franklin Park, IL (US)

(72) Inventors: Alexander Blank, Plymouth, MI (US); Jasris Jasnie, Washington, MI (US)

(73) Assignee: Sloan Valve Company, Franklin Park, IL (US)

( * ) Notice: Subject to any disclaimer, the term of this patent is extended or adjusted under 35 U.S.C. 154(b) by 76 days.

(21) Appl. No.: 18/239,404

(22) Filed: Aug. 29, 2023

(65) Prior Publication Data

US 2024/0068217 A1 Feb. 29, 2024

Related U.S. Application Data

(60) Provisional application No. 63/401,830, filed on Aug. 29, 2022.

(51) Int. Cl.
*E03D 3/10* (2006.01)

(52) U.S. Cl.
CPC ..... *E03D 3/10* (2013.01)

(58) Field of Classification Search
CPC ..... E03D 3/00; E03D 3/10
USPC ..... 4/322, 354, 361, 362; 137/846
See application file for complete search history.

(56) References Cited

U.S. PATENT DOCUMENTS 653,512 A 7/1900 Ingersoll
1,002,255 A 9/1911 Fraissinet
1,057,707 A 4/1913 Cassidy
2,048,674 A 7/1936 Brannen
5,857,224 A 1/1999 Oberg et al.
6,029,287 A 2/2000 Ge et al.
6,029,288 A * 2/2000 Ge ..... E03D 3/10 4/362
6,343,387 B1 * 2/2002 Beh ..... E03D 3/12 4/354
7,299,508 B2 11/2007 Li
7,694,355 B2 4/2010 Lo
11,821,190 B2 11/2023 Papai
2001/0034903 A1 11/2001 Martin
2004/0194200 A1 10/2004 Li
(Continued)

OTHER PUBLICATIONS

Jan. 18, 2024—(WO) ISR and Written Opinion—App PCT/US2023/031440.

(Continued)

*Primary Examiner* — Tuan N Nguyen
(74) *Attorney, Agent, or Firm* — Banner & Witcoff, Ltd.

(57) ABSTRACT

An air inducer assembly includes a housing having a chamber, an outlet located downstream from the chamber for connection to an inlet of a flush tank, a water inlet and an air inlet in communication with the chamber, and a tube extending into the chamber and toward the outlet. The tube has a passage therethrough extending from the air inlet through the tube to place the air inlet in communication with the outlet, and air is drawn from the air inlet through the tube and into the outlet by a flow of the water past a distal end of the tube. The assembly further includes features such one or more ribs extending from the tube to the wall(s) defining the chamber and spaced around a periphery of the tube and/or the tube having a distal end that extends out of the chamber and into the outlet.

30 Claims, 57 Drawing Sheets

(56) References Cited

U.S. PATENT DOCUMENTS

| | | | | |
|---|---|---|---|---|
| 2005/0150038 | A1* | 7/2005 | Li | E03D 3/10 4/354 |
| 2006/0107451 | A1 | 5/2006 | Kuster et al. | |
| 2011/0265257 | A1 | 11/2011 | Ge et al. | |
| 2022/0372742 | A1 | 11/2022 | Papai | |
| 2024/0328133 | A1* | 10/2024 | Jasnie | E03D 3/10 |

OTHER PUBLICATIONS https://web.archive.org/web/20200811072024/https://www.flushmate.com/product/flushmate-iii-503-series (date Aug. 11, 2020).
https://web.archive.org/web/20200811065640/https://www.flushmate.com/product/flushmate-iv-504-series (date Aug. 11, 2020).
https://web.archive.org/web/20240806110456/https://www.flushmate.com/products/503uh (date Aug. 6, 2024).
https://web.archive.org/web/20200811063845/https://www.flushmate.com/product/flushmate-iii-503h-series (date Aug. 11, 2020).
https://www.youtube.com/watch?v=7EU0mrYYso0 (date May 18, 2009).

* cited by examiner

AIR INDUCER ASSEMBLY FOR PRESSURIZED FLUSH TANK

CROSS-REFERENCE TO RELATED APPLICATION

This application is a non-provisional of, and claims priority to, U.S. Provisional Application No. 63/401,830, filed Aug. 29, 2022, which prior application is incorporated by reference herein in its entirety.

FIELD OF THE INVENTION

This disclosure relates to pressure assisted flushing systems for toilets, and more specifically to air inducer assemblies for such flushing systems.

BACKGROUND

Pressure assisted flushing systems for toilets use a pressure tank which may be positioned within the tank of the toilet. Water at line pressure flows into the pressure tank, such that the water within the tank is at line pressure. When the toilet is flushed and the flush valve within the pressure tank is operated, the water is forced from the pressure tank into the toilet bowl for rapid and complete flushing of its contents. Such systems also include an air inducer assembly, which draws air into the pressure tank to create an air head that is used to provide the pressure for discharging the water in the tank. The air inducer assembly connects to the inlet water conduit and to air at atmospheric pressure, such that the flow of water from a conventional water supply will draw air into the tank to pressurize the tank. Improving the air drawing capabilities of the air inducer assembly can achieve greater air volume and lower water volume being drawn into the tank, thereby reducing flush volume. This can have numerous benefits, including increased water conservation.

The present disclosure is provided to address this need and other needs in existing pressure assisted flushing systems. A full discussion of the features and advantages of the present invention is deferred to the following detailed description, which proceeds with reference to the accompanying drawings.

BRIEF SUMMARY

General aspects of the present disclosure relate to air inducers and air inducer assemblies for pressure-assisted flushing systems that include various features, including features that may improve air draw through an air inlet during refilling of the tank. These features may result in decreased water volume in the tank and decreased flush volume.

Aspects of the disclosure relate to an air inducer assembly that includes a housing having one or more walls defining a chamber, an outlet located downstream from the chamber and configured for connection to an inlet of a flush tank, a water inlet in communication with the chamber and configured for connection to a water inlet conduit for introducing water into the chamber, and an air inlet in communication with the chamber and configured to be in communication with a source of air. The air inducer assembly also includes a tube extending into the chamber and toward the outlet, the tube having a passage therethrough extending from the air inlet through the tube to place the air inlet in communication with the outlet, and the tube is configured to permit air to be drawn from the air inlet through the tube and into the outlet by a flow of the water past a distal end of the tube. The assembly further includes a plurality of ribs extending from the tube to the one or more walls defining the chamber, wherein the ribs are spaced around a periphery of the tube to define spaces between the ribs.

According to various aspects, the ribs may extend along a length of the tube and terminate at the distal end of the tube, terminate short of the distal end of the tube, or extend beyond the distal end of the tube.

According to another aspect, the ribs and the water inlet are configured such that the water entering the chamber must pass through at least one of the spaces between the water inlet and the outlet.

According to a further aspect, the ribs are spaced around the periphery of the tube at equal intervals.

According to yet another aspect, the housing has a recess in the one or more walls defining the chamber configured to receive a sealing member. The recess is located at a bottom end of the chamber such that the outlet is located below a top of the recess, and the distal end of the tube is located within the chamber.

According to a still further aspect, the assembly includes a check valve connected to the housing at the air inlet and configured to permit the air to flow through the air inlet and into the passage and to resist air flow out of the air inducer assembly through the air inlet.

According to an additional aspect, the distal end of the tube is chamfered on at least one of an inner surface and an outer surface of the tube.

According to an additional aspect, the plurality of ribs extend radially with respect to the tube between the tube and the one or more walls defining the chamber, and the plurality of ribs further extend lengthwise along the tube.

According various additional aspects, the air inducer assembly, in use, is configured to produce increased air draw relative to existing air inducer assemblies, such as another air inducer assembly that does not include the plurality of ribs, which other air inducer assembly may be otherwise identical except for the ribs. For example, the air inducer assembly may produce at least 50% increased air draw, 50% to 100% increased air draw, or 70% to 90% increased air draw relative to such other air inducer assembly.

Additional aspects of the disclosure relate to an air inducer assembly that includes a housing having one or more walls defining a chamber and a recess in the one or more walls located at a bottom end of the chamber, a sealing member received in the recess, an outlet located downstream from the chamber and below the recess and the sealing member, where the outlet is configured for connection to an inlet of a flush tank, a water inlet in communication with the chamber and configured for connection to a water inlet conduit for introducing water into the chamber, and an air inlet in communication with the chamber and configured to be in communication with a source of air. The assembly also includes a tube extending into the chamber and toward the outlet, the tube having a distal end located below a top of the recess in the housing, where a passage extends from the air inlet through the tube to place the air inlet in communication with the outlet. The tube is configured to permit air to be drawn from the air inlet through the tube and into the outlet by a flow of the water past the distal end of the tube.

According to one aspect, the distal end of the tube is located at or below a bottom of the recess and/or within the outlet. In some aspects, the air inducer assembly, in use, is configured to produce increased air draw relative to existing air inducer assemblies, such as another air inducer assembly in which the distal end of the tube is located above the top of the recess, which other air inducer assembly may be otherwise identical except for the tube configuration. For example, the air inducer assembly may produce at least 50% increased air draw, 50% to 100% increased air draw, or 60% to 80% increased air draw relative to such other air inducer assembly.

According to another aspect, the assembly includes a rib, or a plurality of ribs, extending from the tube to the one or more walls defining the chamber. In one configuration, the ribs are spaced around a periphery of the tube to define spaces between the ribs. The rib or ribs extend radially with respect to the tube between the tube and the one or more walls defining the chamber, and further extend lengthwise along the tube.

According to a further aspect, the assembly also includes a check valve connected to the housing at the air inlet and configured to permit the air to flow through the air inlet and into the passage and to resist air flow out of the air inducer assembly through the air inlet.

According to yet another aspect, the distal end of the tube is chamfered on at least one of an inner surface and an outer surface of the tube.

According to a still further aspect, the outlet is configured to receive a threaded portion of the inlet of the flush tank and has internal threading configured for threading engagement with the threaded portion of the inlet, and the distal end of the tube is located below an upper end of the threading.

Further aspects of the disclosure relate to pressure-assist toilet flush system including a tank having an outlet configured for discharging water from the tank and an inlet having a threaded portion, a flush cartridge configured for controlling discharge of the water from the outlet of the tank, and an air inducer assembly connected to the inlet according to aspects described herein and configured for introducing a mixture of air and the water into the tank. In one configuration, the air inducer assembly includes a housing having one or more walls defining a chamber, an outlet located downstream from the chamber and below the recess and the sealing member, where the outlet receives the threaded portion of the inlet of the tank and is connected to the inlet by complementary threading, a water inlet in communication with the chamber and configured for connection to a water inlet conduit for introducing water into the chamber, and an air inlet in communication with the chamber and configured to be in communication with a source of air. The air inducer assembly also includes a tube extending into the chamber and toward the outlet, the tube having a distal end located within the outlet and within the inlet of the tank, where a passage extends from the air inlet through the tube to place the air inlet in communication with the outlet. The tube is configured to permit air to be drawn from the air inlet through the tube and into the inlet of the tank by a flow of the water past the distal end of the tube.

According to one aspect, the air inducer assembly includes a rib or a plurality of ribs extending from the tube to the one or more walls defining the chamber, wherein the ribs are spaced around a periphery of the tube to define spaces between the ribs. In one configuration, the rib(s) extend radially with respect to the tube between the tube and the one or more walls defining the chamber, and extend lengthwise along the tube.

According to another aspect, the system also includes a check valve connected to the housing at the air inlet and configured to permit the air to flow through the air inlet and into the passage and to resist air flow out of the air inducer assembly through the air inlet.

According to a further aspect, the distal end of the tube is chamfered on at least one of an inner surface and an outer surface of the tube.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
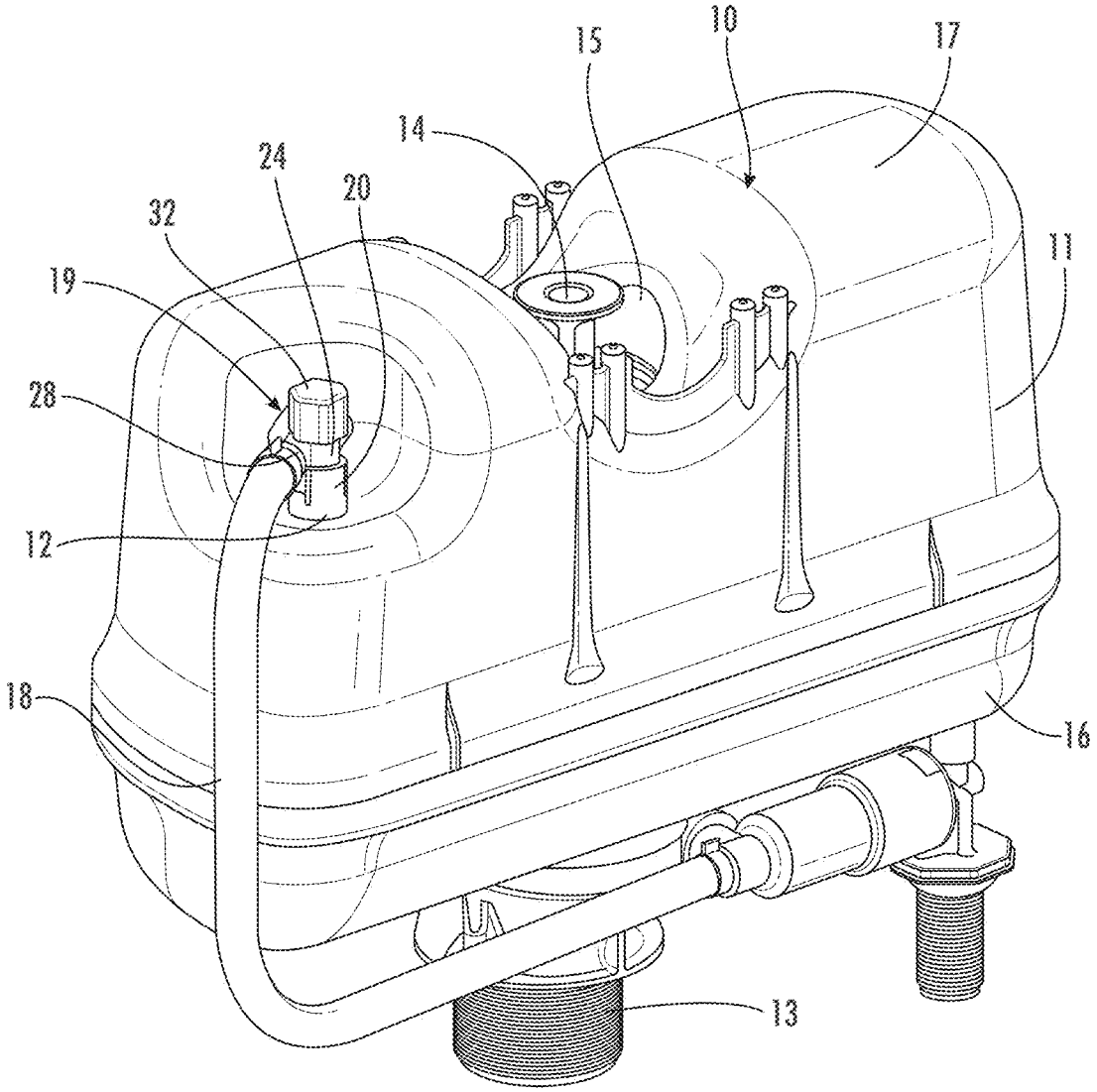
FIG. 1 is a perspective view of one embodiment of a pressure-assisted flushing system configured for use with a toilet, according to aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 2:
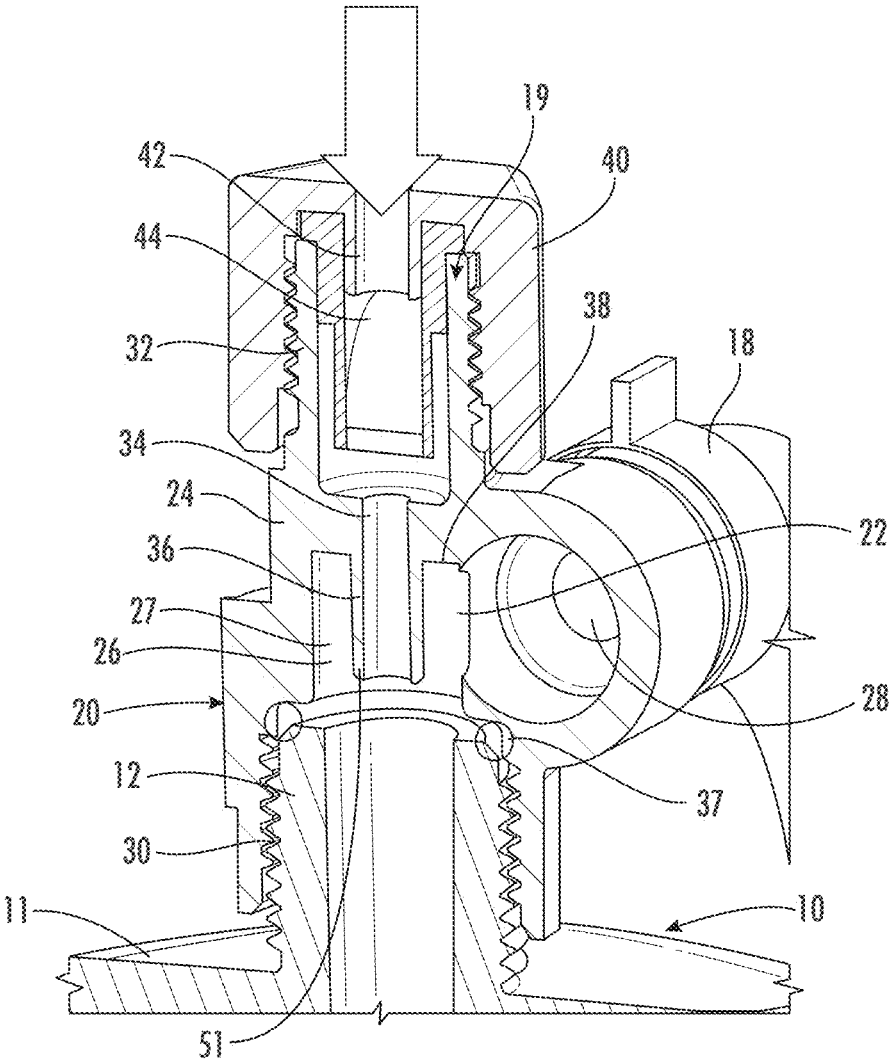
FIG. 2 PRIOR ART
FIG. 2 is a cross-section view of a portion of the system of FIG. 1, with a prior art air inducer assembly.

Referring initially to FIGS. 1-2, there is shown an example embodiment of a pressure assist toilet flush system 10 that includes a tank 11 defining an internal cavity, with an inlet 12 and an outlet 13 for intake and discharge of water, and a flush actuator 14 configured for selectively opening and closing a valve leading to outlet 13 to control discharge of water. The flush actuator 14 in this embodiment may be in the form of a replaceable flush cartridge mounted within a receiver 15 in the tank 11, such that a portion of the flush cartridge is accessible outside the tank 11 and the actuator 14 is positioned within the cavity to interact with an internal seal surface around the outlet 13. The tank 11 may be constructed of a lower housing or base 16 forming a bottom portion of the tank 11, and an upper housing or cover 17 forming a top portion of the tank 11, such that the base 16 and the cover 17 combine to define the internal cavity. The base 16 and the cover 17 may be made from plastic (including, e.g., fiber-reinforced plastic). The outlet 13 is typically connected to a toilet bowl (not shown), such that water discharged from the outlet 13 accomplishes flushing of the bowl.

The system 10 also includes an air inducer assembly 19 connected to the inlet 12 and to a water inlet conduit 18, the assembly 19 configured to introduce liquid (e.g., water) and gas (e.g., air) into the tank 11. Air is drawn into and through the assembly 20 as the water passes through the assembly 19 from the water inlet conduit 18, e.g., by the Venturi effect, such that water and air pass through the inlet 12 into the tank 11. This pressurizes the tank 11, such that water can be forced into the toilet for improved flushing. The tank 11 therefore includes a mixture of air and water within the internal cavity. It is understood that the comparative proportions of air and water within the tank 11 can affect flush volume. More specifically, proportionally greater amounts of air and smaller amounts of water can decrease flush volume, and proportionally smaller amounts of air and greater amounts of water can increase flush volume.

Figure 3:
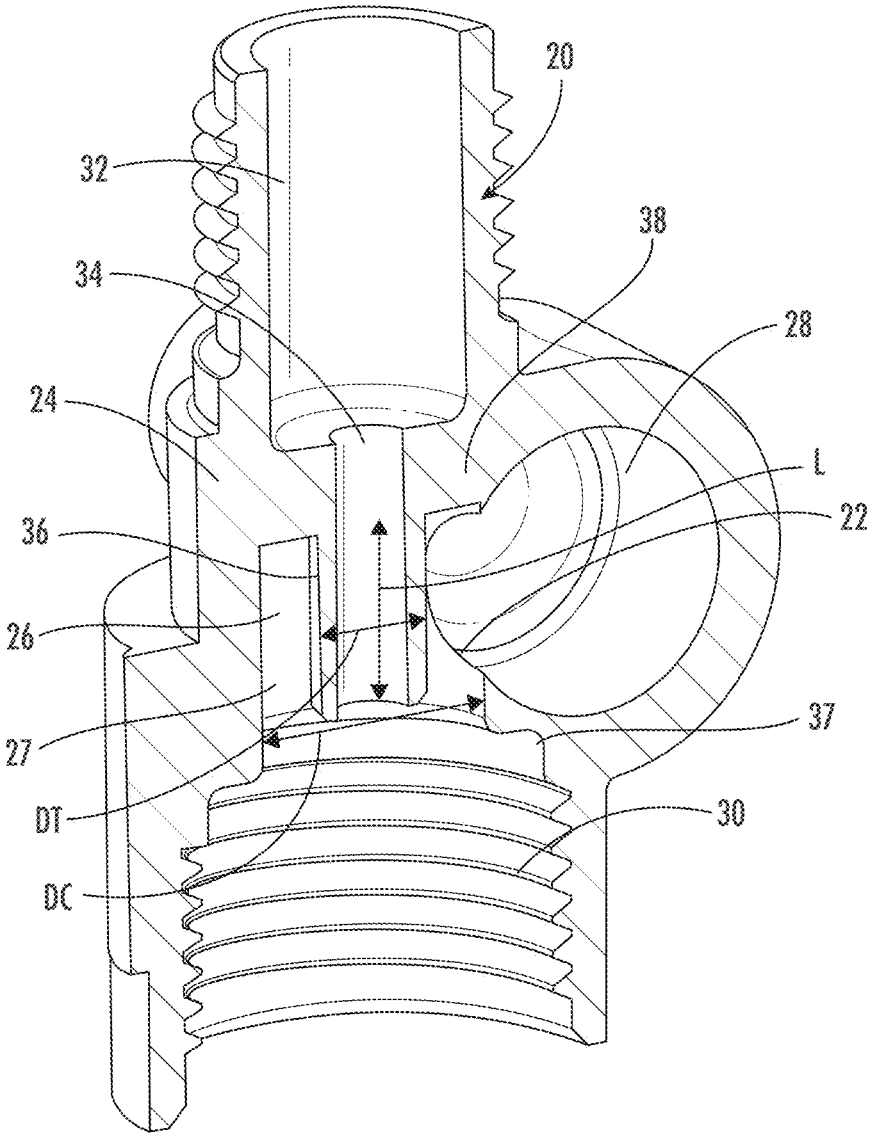
FIG. 3 PRIOR ART
FIG. 3A is a cross-section view of an air inducer of the air inducer assembly of FIG. 2.
FIG. 3B is a cross-section view of the internal volume of the air inducer assembly of FIG. 2, with velocities at air inlet and liquid outlet illustrated quantitatively.
Figure 3B:
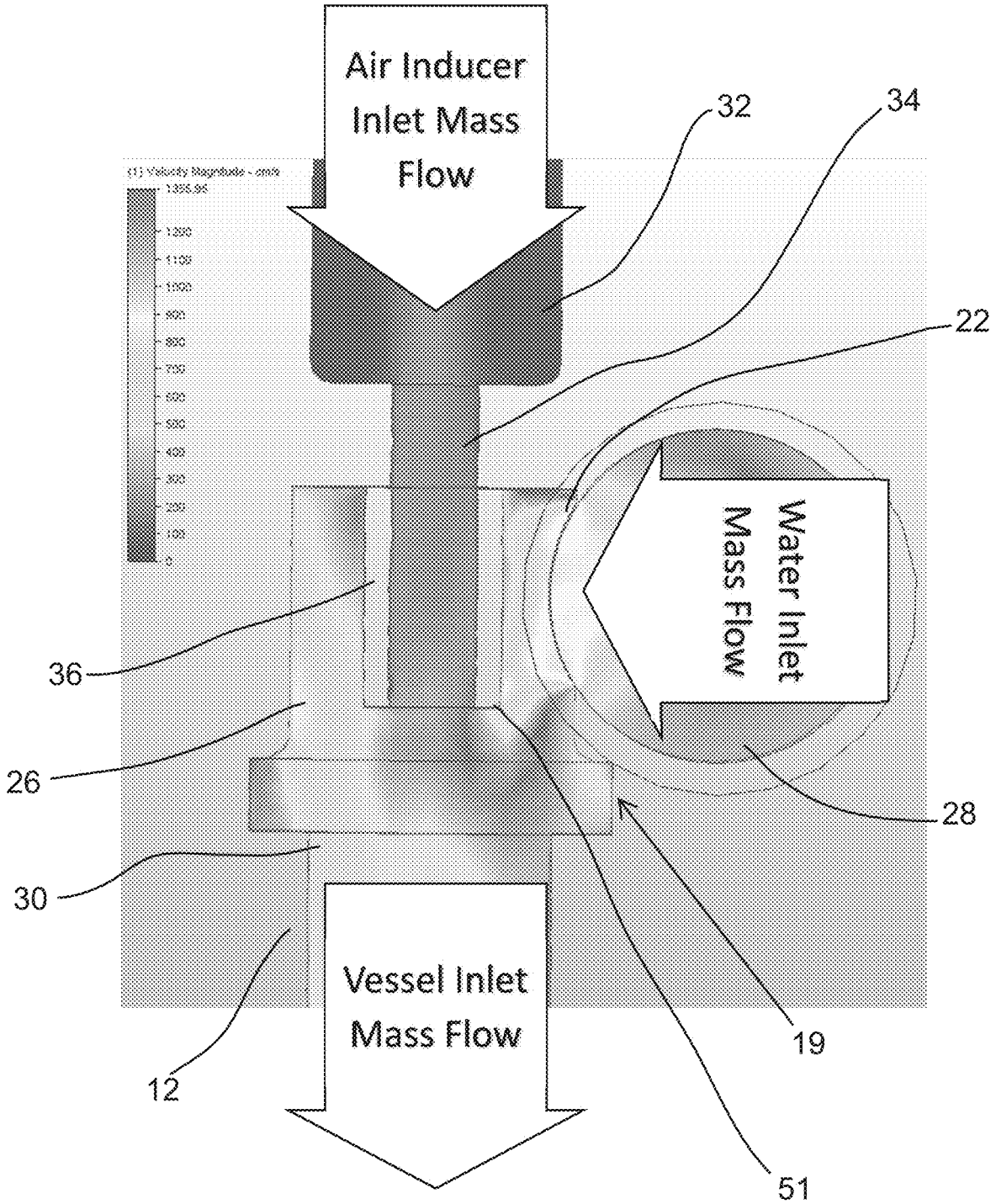
FIG. 3B PRIOR ART
Figure 29:
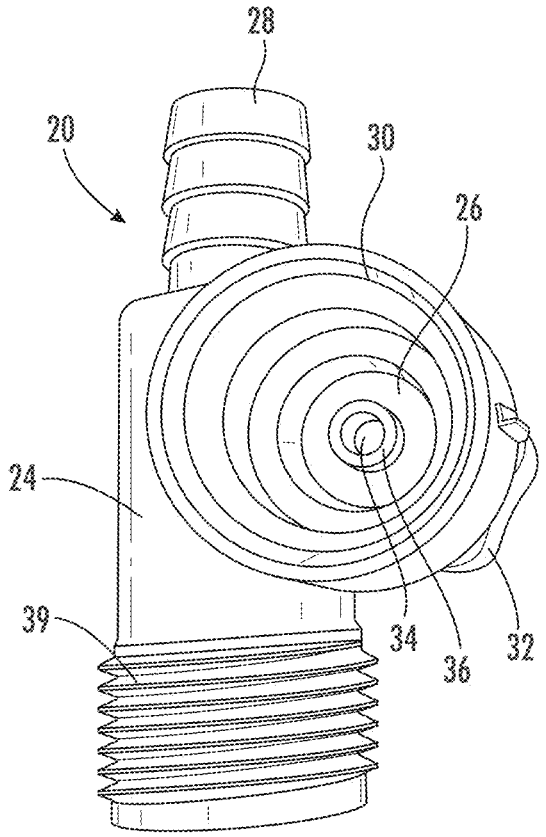
FIG. 29 PRIOR ART
FIG. 29 is a photograph of a prior art air inducer usable in connection with the system of FIG. 1.

FIGS. 2-3B illustrate an example of a prior art air inducer assembly 19, which includes an air inducer 20 having a housing 24 with a chamber 26 formed therein and defined by one or more outer walls 27, with a water inlet 28 and an outlet 30 in communication with the chamber 26. FIG. 29 is a photograph of an air inducer 21 as shown in FIGS. 2-3B. The chamber 26 in FIGS. 2-3B has a cylindrical outer wall 27 defining the chamber as a circular or cylindrical chamber 26. The water inlet 28 is connected to the water inlet conduit 18, and the outlet 30 is connected to the inlet 12 of the tank 11 for discharging water and air into the tank 11. The water inlet 28 is oriented transversely to the direction of the chamber 26 and the outlet 30, and the water inlet 28 is in fluid communication with the chamber 26 via an opening 22 in the wall(s) 27 of the chamber 26. The water inlet 28 may include ribbing and/or other structures for engagement with the water inlet conduit 18. The outlet 30 is internally threaded for connection to the inlet 12 of the tank 11. The assembly 19 also has a vacuum breaker valve 25 that will open to relieve any vacuum in the tank. The air inducer 20 in FIGS. 2-3B is formed of a single molded piece.

The air inducer 20 in FIGS. 2-3B also has an air inlet 32 in fluid communication with a source of air (e.g., the external environment) and with a passage 34 that extends into the chamber 26. A tube 36 extends downward into the chamber 26 from the top wall 38 of the chamber 26 and terminates within the chamber 26, and the passage 34 extends through the tube 36. In other embodiments, as described herein, the tube 36 may extend through the chamber 26 and terminate within the outlet 30. The tube 36 extending into and through the chamber 26 creates an annular shape for at least a portion of the chamber 26. The chamber 26 may have a fully cylindrical portion located below the tip of the tube 36 and the outlet of the passage 34 into the chamber 26. The passage 34 has a diameter that is smaller than (e.g., less than half of) the diameter of the chamber 26. The chamber 26 also includes a recess 37 with a larger diameter than the remainder of the chamber 26 and the outlet 30, for holding an O-ring, gasket, or other sealing member. The recess 37 is located at the bottom end of the chamber 26 and may be considered to define the bottom end of the chamber 26. A fitting 40 is connected to the air inlet 32 by threaded engagement with the housing 24, and the fitting 40 has an opening 42 in communication with the passage 34. The opening 42 may have a smaller diameter than the passage 34. A check valve 44 is connected to the housing 24 at the air inlet 32 by engagement between the fitting 40 and the housing 24, and the check valve 44 is at least partially received within the air inlet 32 in FIGS. 2-3B. The check valve 44 in FIGS. 2-3B is in the form of a duckbill valve, formed of a flexible elastomeric or rubber-like material, which permits air flow into the passage 34 and resists air flow out of the passage 34 through the opening 42. The air inlet 32 is a cylindrical chamber in the embodiment of FIGS. 2-3B, and the passage 34 has a diameter that is smaller than (e.g., less than half of) the diameter of the air inlet 32.

In the configuration illustrated in FIGS. 2-3B, the flow of water from the water inlet 28, through the opening 22 and into and through the chamber 26 and toward the outlet 30 will create a Venturi effect relative to the end of the tube 36 and the passage 34. In other words, the area directly adjacent the end of the tube 36 and the passage 34 will be at a pressure less than atmospheric, whereas, the air outside of the tank 11 and at the air inlet 32 is at atmospheric pressure. This positive pressure differential will cause air to flow through the opening 42 and the check valve 44, through the passage 34 and into the chamber 26 and/or the outlet 30. Thus, the air drawn into the chamber 26 via this Venturi effect is entrained in the water flowing out of outlet 30.

Figure 4:
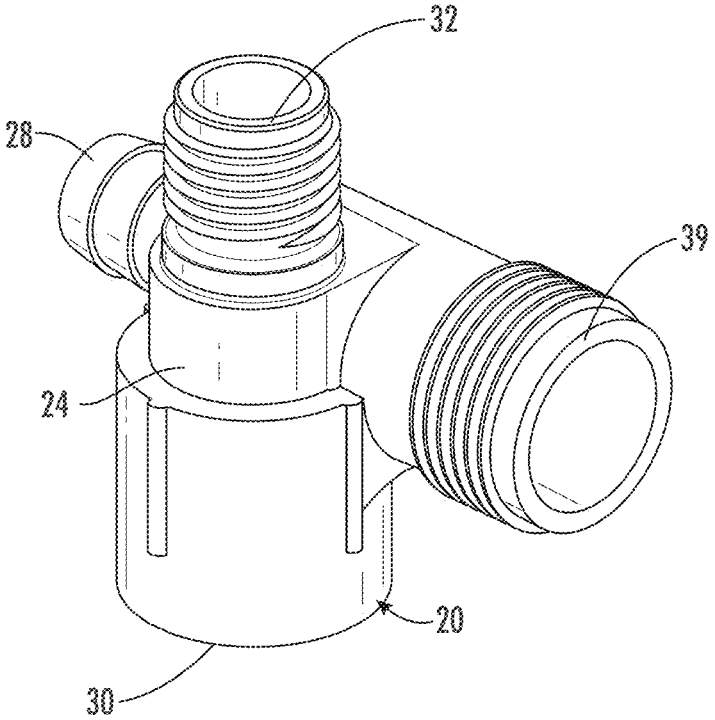
FIG. 4 is a perspective view of an example of an air inducer usable in connection with the system of FIG. 1, according to aspects of the disclosure.

FIGS. 5A-28 illustrate embodiments of air inducers 120, 220, 320, 420, 520, 620, 720, 820, 920, 1020, 1120, 1220, 1320, 1420, 1520, 1620, 1720, 1820 that are usable as part of an air inducer assembly 19 in connection with the system 10 and the tank 11 of FIG. 1 according to aspects of the present disclosure, all of which have one or more features different from the air inducer 20 in FIGS. 2-3B. Each of these embodiments in FIGS. 5A-28 includes components that are structurally and/or functionally similar or identical to components described herein with respect to the air inducer assembly 19 and the air inducer 20 in FIGS. 2-3B, and the same reference numbers are used herein to refer to such similar or identical components in FIGS. 5A-28. Additionally, such similar or identical components may not be described again in detail with respect to the embodiments of FIGS. 5A-28 and may not be identified by reference numbers in FIGS. 5A-28. FIG. 4 illustrates an example of the external appearance of an air inducer body 21 that may be used for any of the embodiments of FIGS. 5A-28, illustrating the air inlet 32, the water inlet 28, the outlet 30, and a connection 39 for the relief valve 25. It is understood that FIG. 3B, as well as FIGS. 8B, 9B, 10B, 11B, 12B, 13B, 14B, 15B, 16B, 17C, 18C, 19C, 20C, 21C, and 28, illustrate the internal volumes of each of the various air inducer assemblies 19, defined by the air inducer 20, 420, 520, 620, 720, 820, 920, 1020, 1120, 1220, 1320, 1420, 1520, 1620, 1720, 1820 and any components connected to the air inducer, i.e., the inlet 12. The positions of various components of the air inducer assemblies 19 and other structures are indicated with relevant reference numbers in these figures. Like the air inducer 20 in FIGS. 2-3B, the air inducers 120, 220, 320, 420, 520, 620, 720, 820, 920, 1020, 1120, 1220, 1320, 1420, 1520, 1620, 1720, 1820 in FIGS. 5A-28 are each formed of a single molded piece, but it is understood that multiple pieces could be used in another embodiment.

Some of the embodiments of FIGS. 5A-28 may differ from the air inducer 20 of FIGS. 3-4 and/or from each other in the length L of the tube 36 (measured from the top wall 38 of the chamber 26), the outer diameter DT of the tube 36, and/or the inner diameter DC of the chamber 26. In the air inducer 20 of FIGS. 2-3B, the length L of the tube 36 is 0.303 inch, the diameter DC of the chamber 26 is 0.395 inch, and the diameter DT of the tube 36 is 0.190 inch. These parameters L, DT, and DC are labeled for reference in FIG. 3A, and it is understood that these parameters L, DT, and DC are defined in the same manner for the embodiments of FIGS. 5A-28. It is also understood that if differences in these parameters are not disclosed herein with respect to any of FIGS. 5A-28, it can be presumed that the parameters are the same as disclosed herein with respect to FIGS. 2-3B. The inner diameters of the tube 36, i.e., the width of the passage 34, remains consistent throughout FIGS. 5A-28, and the varying diameters DT of the tubes 36 are created by increasing or decreasing the wall thickness of the tube 36. In another embodiment, the inner diameter of the tube 36 may differ as well. Additionally, the tube 36 the embodiments of FIGS. 5A-28 have distal ends 51 that terminate at various different points relative to the chamber 26. For example, as described herein, in some embodiments, the distal end 51 of the tube 36 is located within the chamber 26, i.e., above the bottom of the recess 37 and potentially above the top of the recess 37 as well. As another example, as described herein, in some embodiments, the distal end 51 of the tube 36 is located outside the chamber 26 and within the outlet 30, i.e., at or below the bottom of the recess 37. In such a configuration, the distal end 51 of the tube 36 may extend into the tank inlet 12.

The performance of the air inducers 20, 120, 220, 320, 420, 520, 620, 720, 820, 920, 1020, 1120, 1220, 1320, 1420, 1520, 1620, 1720, 1820 described herein can be measured by calculation of the mass flow balance by comparing the mass flow of air through the air inlet 32 to the total mass flow out through the outlet 30. Such performance can also be measured by Computational Fluid Dynamics (CFD) Simulation (using the water phase only in the simulation) to calculate the mass flow balance by comparing the simulated mass flow of water through the air inlet 32 to the simulated total mass flow out through the outlet 30. For example, the following formula may be used to predict the percentage of air passing into the tank 11, with reference to the air inducer inlet mass flow, the water inlet mass flow, and the vessel inlet mass flow, as illustrated in FIG. 3B, which uses CFD Simulation:

$$\frac{\text{Air Inducer Inlet Mass Flow}}{\text{Vessel Inlet Mass Flow}}$$

The air percentage value calculated using this equation is evaluated such that a higher positive value is desirable. In one embodiment, the air inducer assembly may produce a value of at least +15% or at least +20% in the CFD simulation.

Figure 5A:
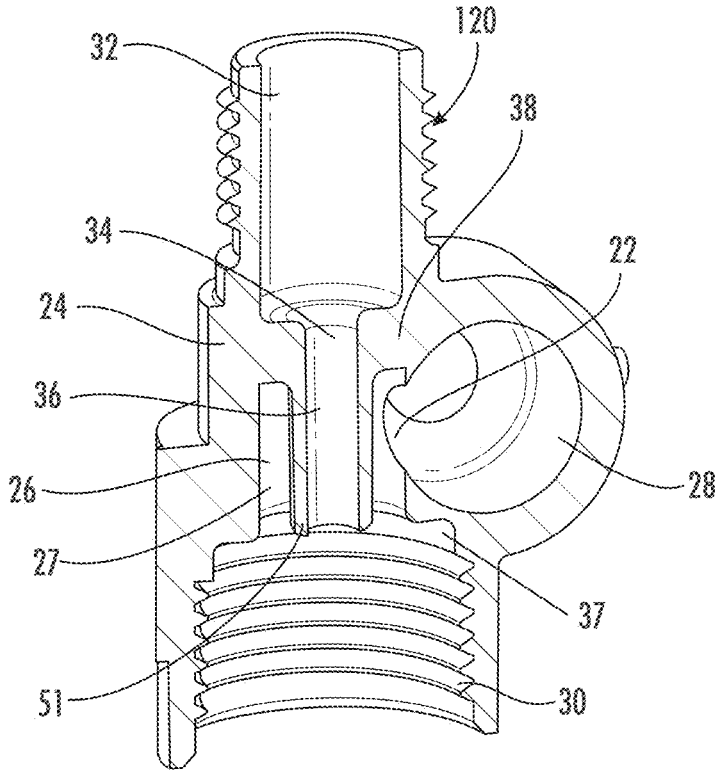
FIGS. 5A and 5B are cross-section views of one embodiment of an air inducer usable in connection with the system of FIG. 1, according to aspects of the disclosure.
Figure 5B:
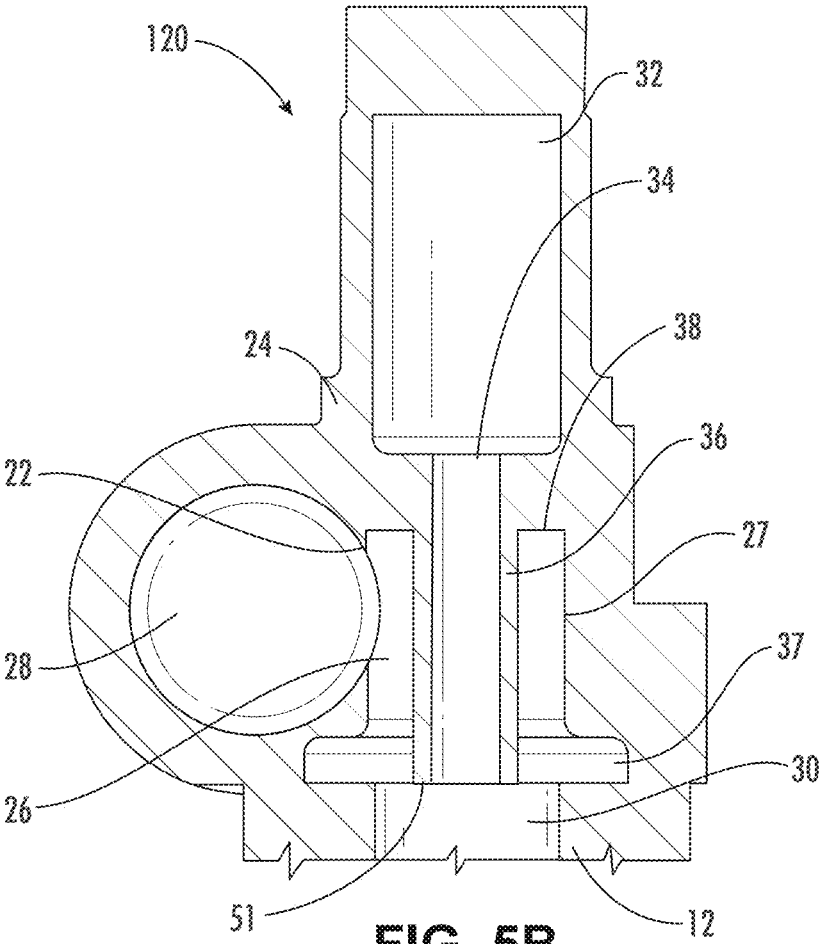
Figure 5C:
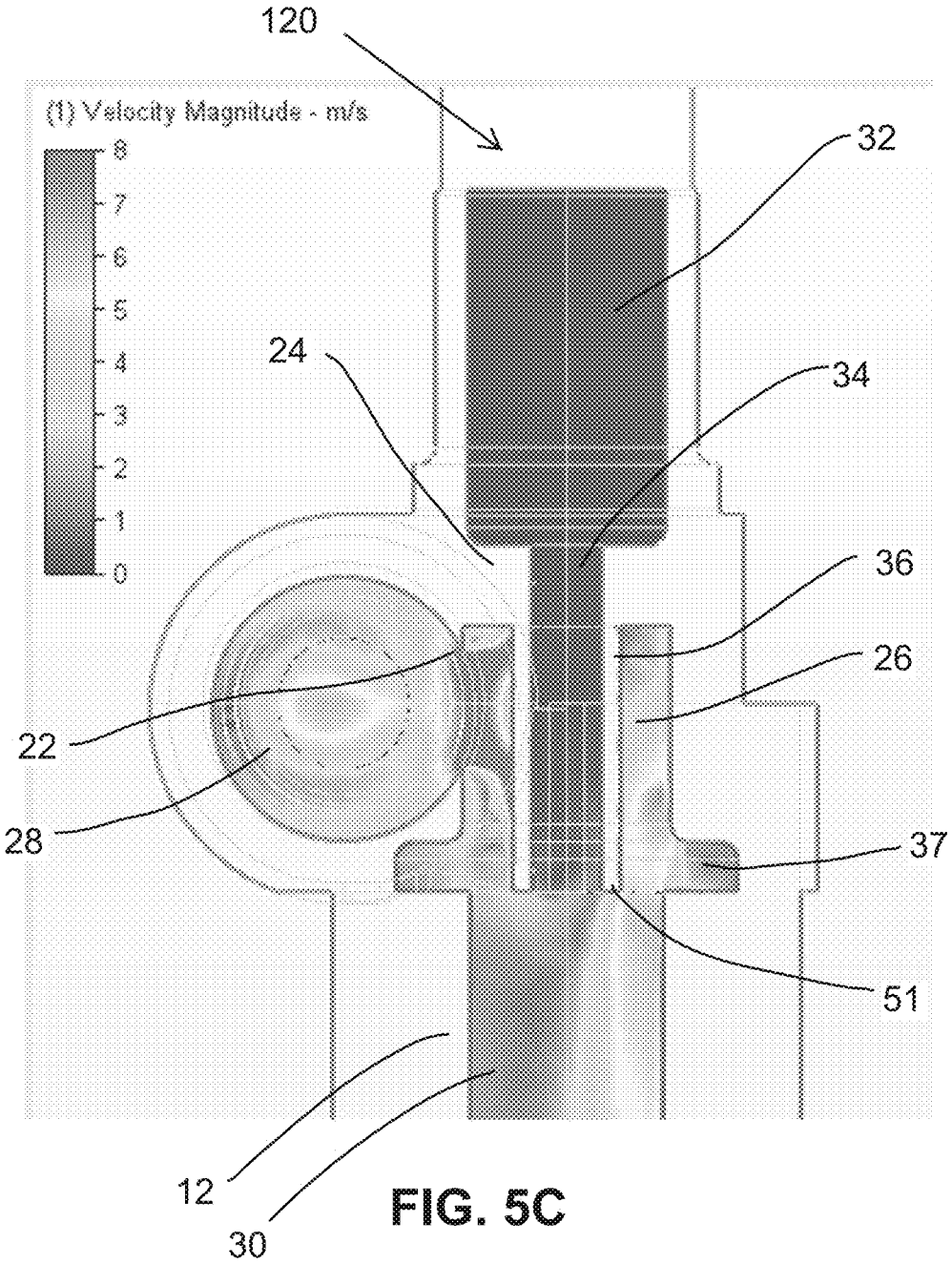
FIG. 5C is a cross-section view of the internal volume of an air inducer assembly including the air inducer of FIGS. 5A and 5B, with velocities at air inlet and liquid outlet illustrated quantitatively.

FIGS. 5A-5C illustrate an embodiment of an air inducer 120 configured similarly to the air inducer 20 of FIGS. 2-3A, in which the length L of the tube 36 is longer than in the air inducer of FIGS. 2-3A, and the diameter DC of the chamber 26 is smaller than in the air inducer of FIGS. 2-3A. In the embodiment of FIGS. 5A-5C, the length L of the tube 36 is 0.378 inch, the diameter DC of the chamber is 0.365 inch, and the diameter DT of the tube 36 is 0.190 inch. The tube 36 in this embodiment terminates approximately at the lower end of the chamber 26, such that the distal end 51 of the tube 36 is approximately level with the bottom of the recess 37. This embodiment exhibited superior mass flow balance performance relative to the air inducer 20 of FIGS. 2-3B.

Figure 6A:
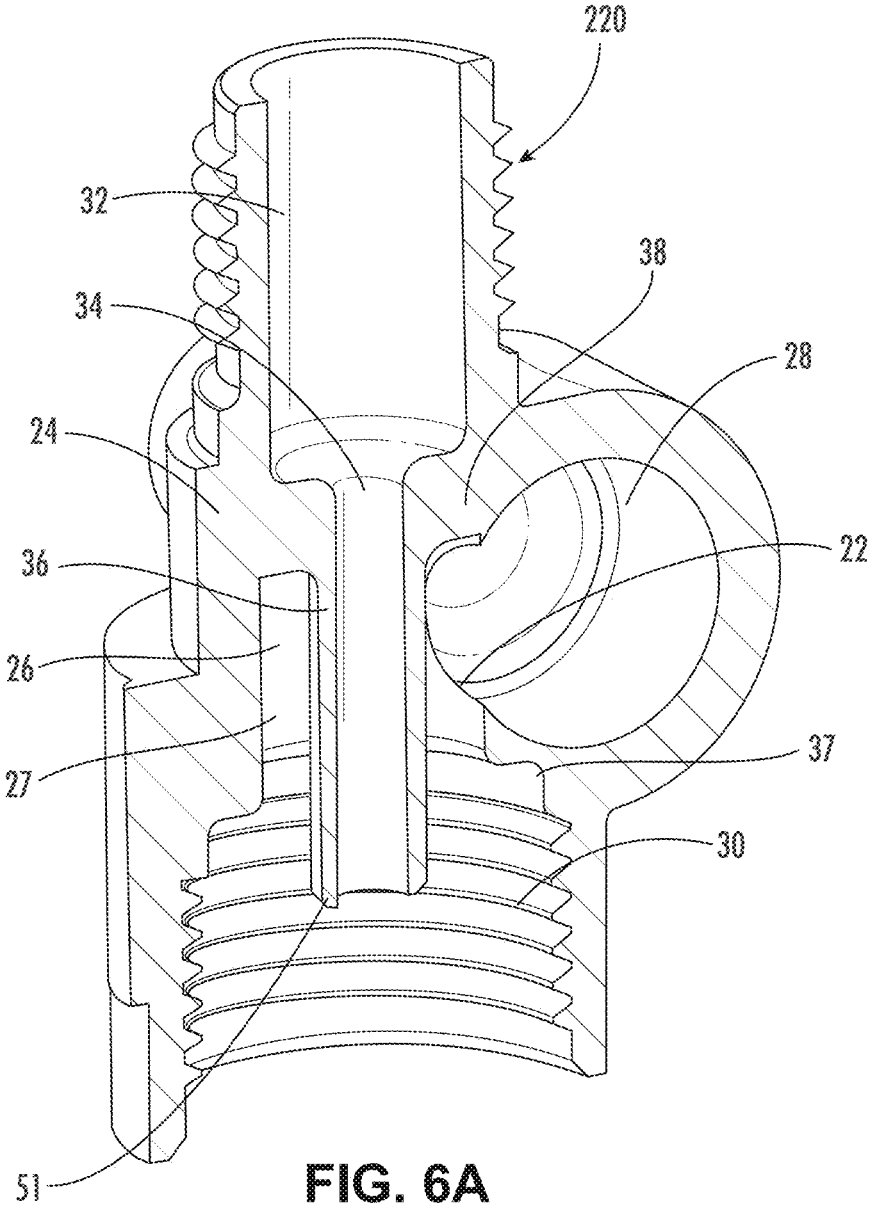
FIGS. 6A and 6B are cross-section views of another embodiment of an air inducer usable in connection with the system of FIG. 1, according to aspects of the disclosure.
Figure 6B:
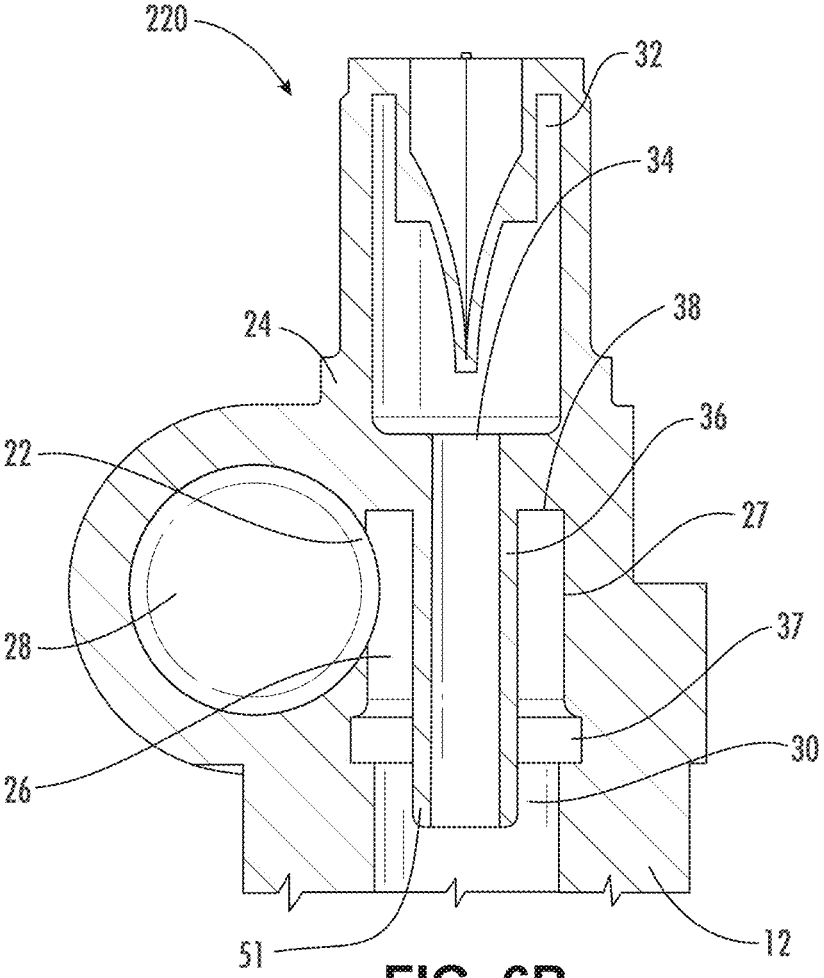
Figure 6C:
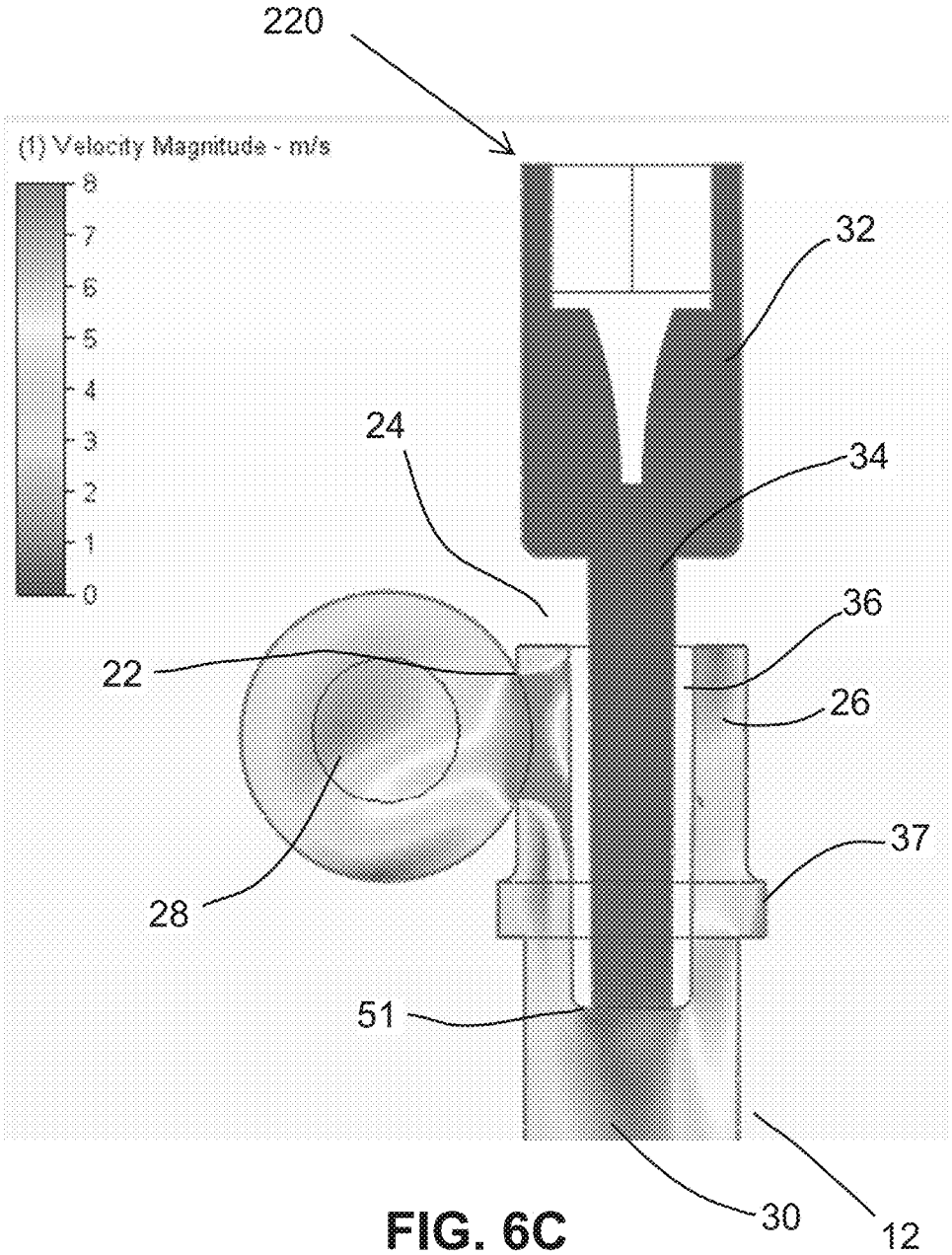
FIG. 6C is a cross-section view of the internal volume of an air inducer assembly including the air inducer of FIGS. 6A and 6B, with velocities at air inlet and liquid outlet illustrated quantitatively.

FIGS. 6A-6C illustrate an embodiment of an air inducer 220 configured similarly to the air inducer 20 of FIGS. 2-3A, in which the length L of the tube 36 is longer than in the air inducer of FIGS. 2-3A, and the diameter DC of the chamber 26 is smaller than in the air inducer of FIGS. 2-3A. In the embodiment of FIGS. 6A-6C, the length L of the tube 36 is 0.555 inch, the diameter DC of the chamber 26 is 0.365 inch, and the diameter DT of the tube 36 is 0.190 inch. The tube 36 in this embodiment terminates below the lower end of the chamber 26, e.g., a distance DE of approximately 0.113 inch below the bottom of the recess 37, and the distal end 51 of the tube 36 extends beyond the chamber 26 and terminates within the outlet 30. This embodiment exhibited superior mass flow balance performance relative to the air inducer 20 of FIGS. 2-3B.

Figure 7A:
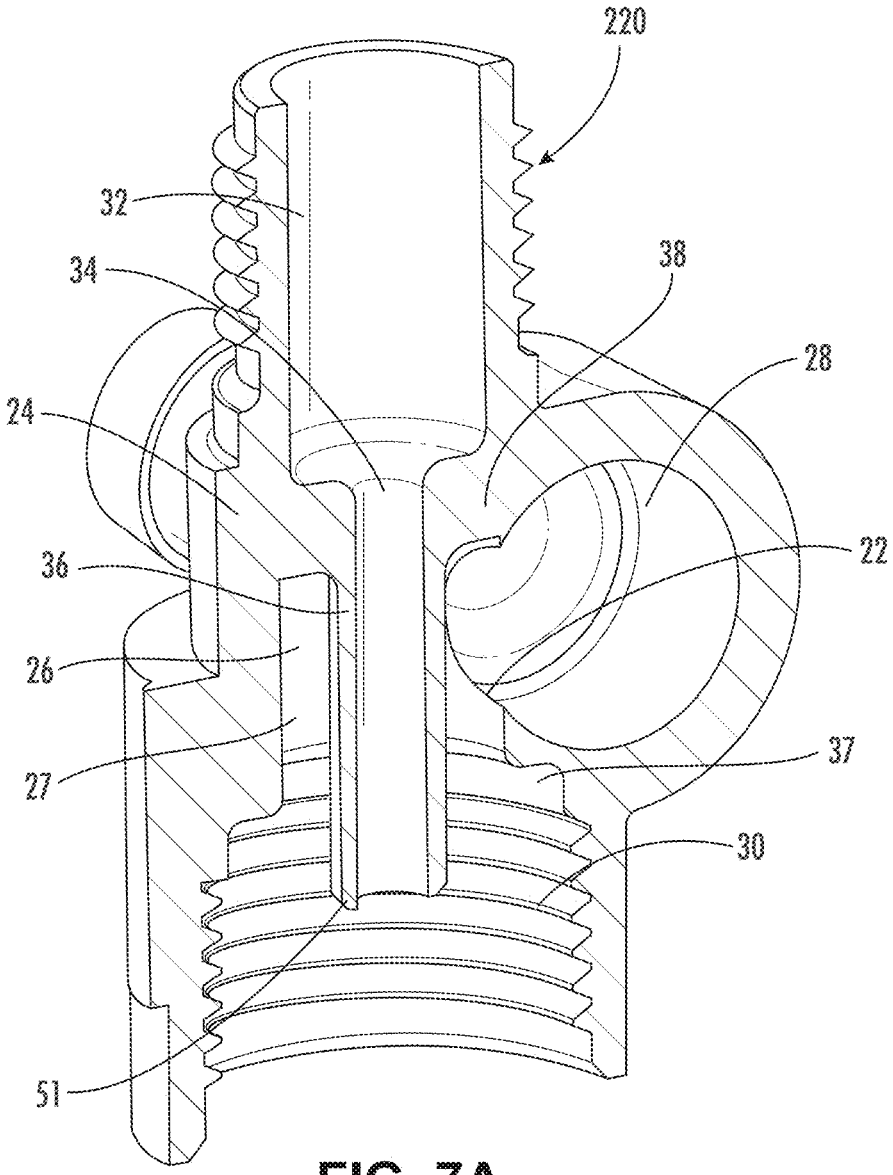
FIGS. 7A and 7B are cross-section views of another embodiment of an air inducer usable in connection with the system of FIG. 1, according to aspects of the disclosure.
Figure 7B:
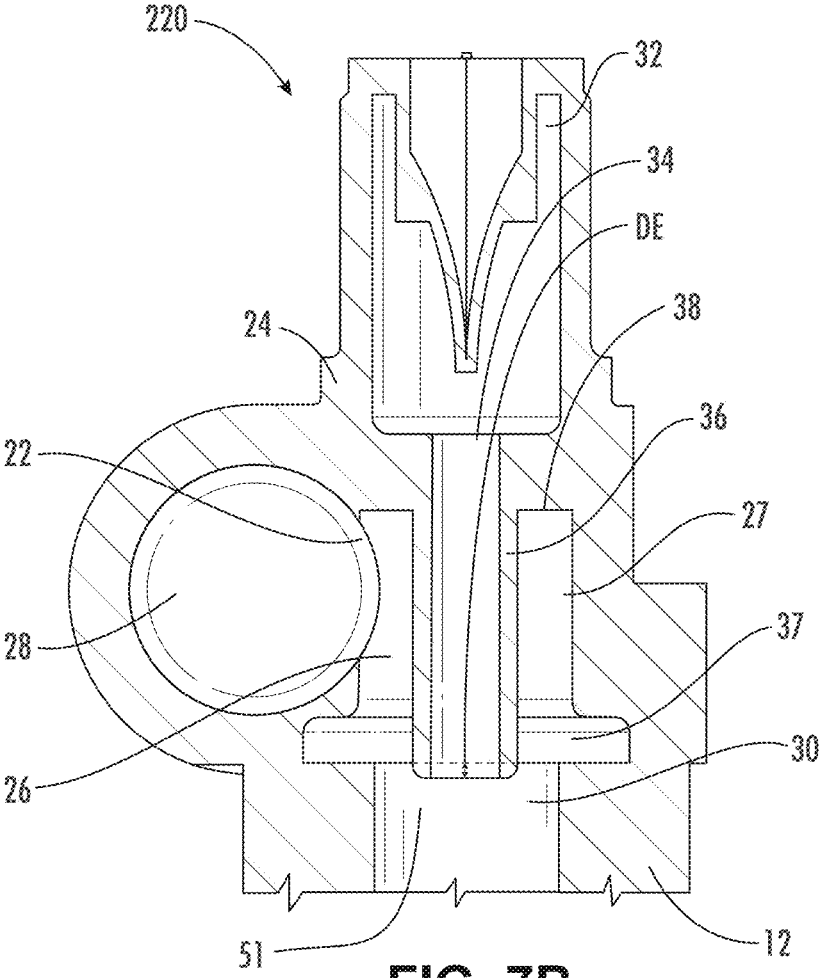
Figure 7C:
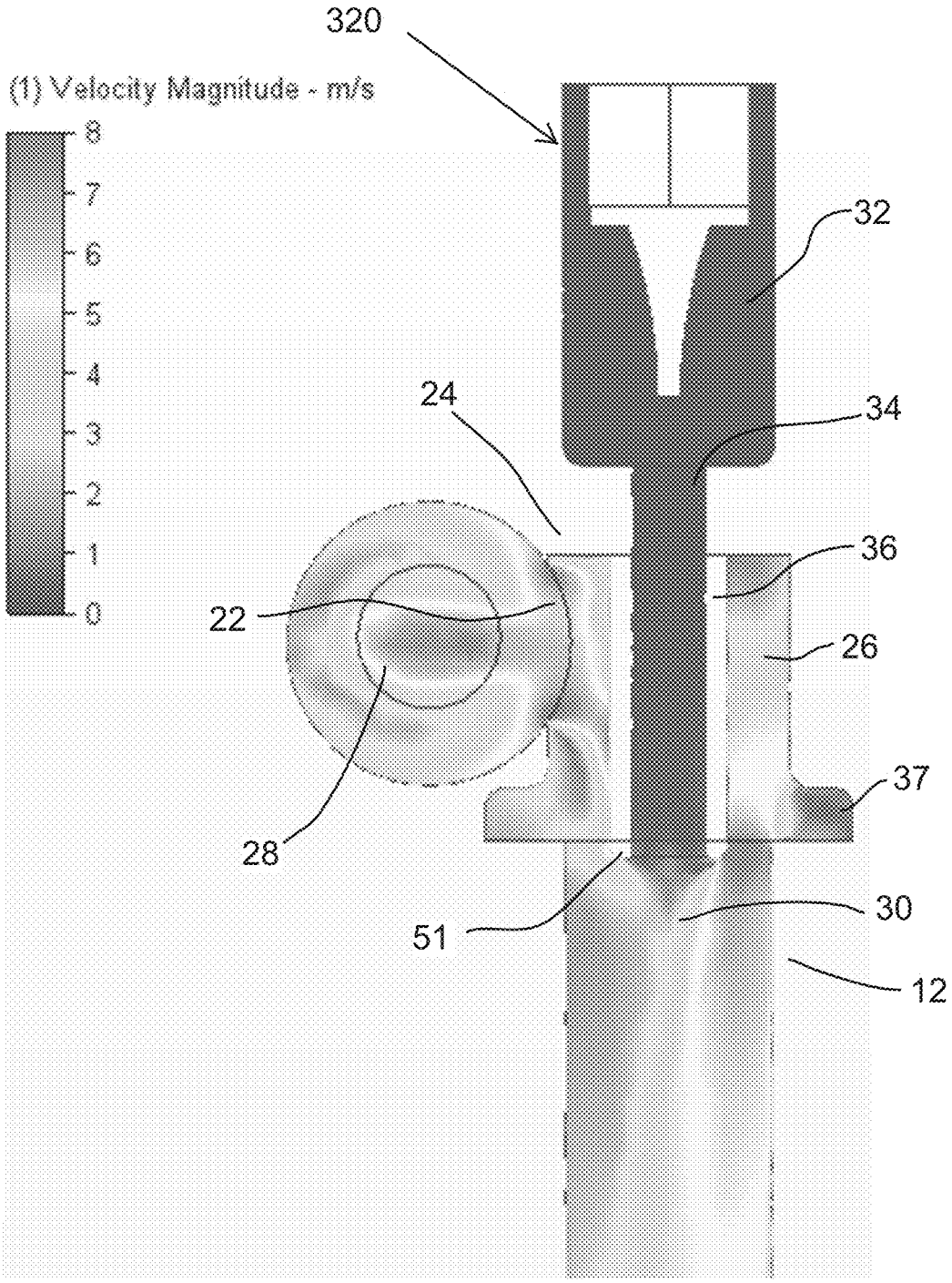
FIG. 7C is a cross-section view of the internal volume of an air inducer assembly including the air inducer of FIGS. 7A and 7B, with velocities at air inlet and liquid outlet illustrated quantitatively.

FIGS. 7A-7C illustrate an embodiment of an air inducer 320 configured similarly to the air inducer 20 of FIGS. 2-3A, in which the length L of the tube 36 is longer than in the air inducer of FIGS. 2-3A. In the embodiment of FIGS. 7A-7C, the length L of the tube 36 is 0.493 inch, the diameter DC of the chamber 26 is 0.395 inch, and the diameter DT of the tube 36 is 0.190 inch. The tube 36 in this embodiment terminates below the lower end of the chamber 26, e.g., a distance DE approximately 0.028 inch below the bottom of the recess 37, and the distal end 51 of the tube 36 extends beyond the chamber 26 and terminates within the outlet 30. This embodiment exhibited superior mass flow balance performance relative to the air inducer 20 of FIGS. 2-3B.

Figure 31:
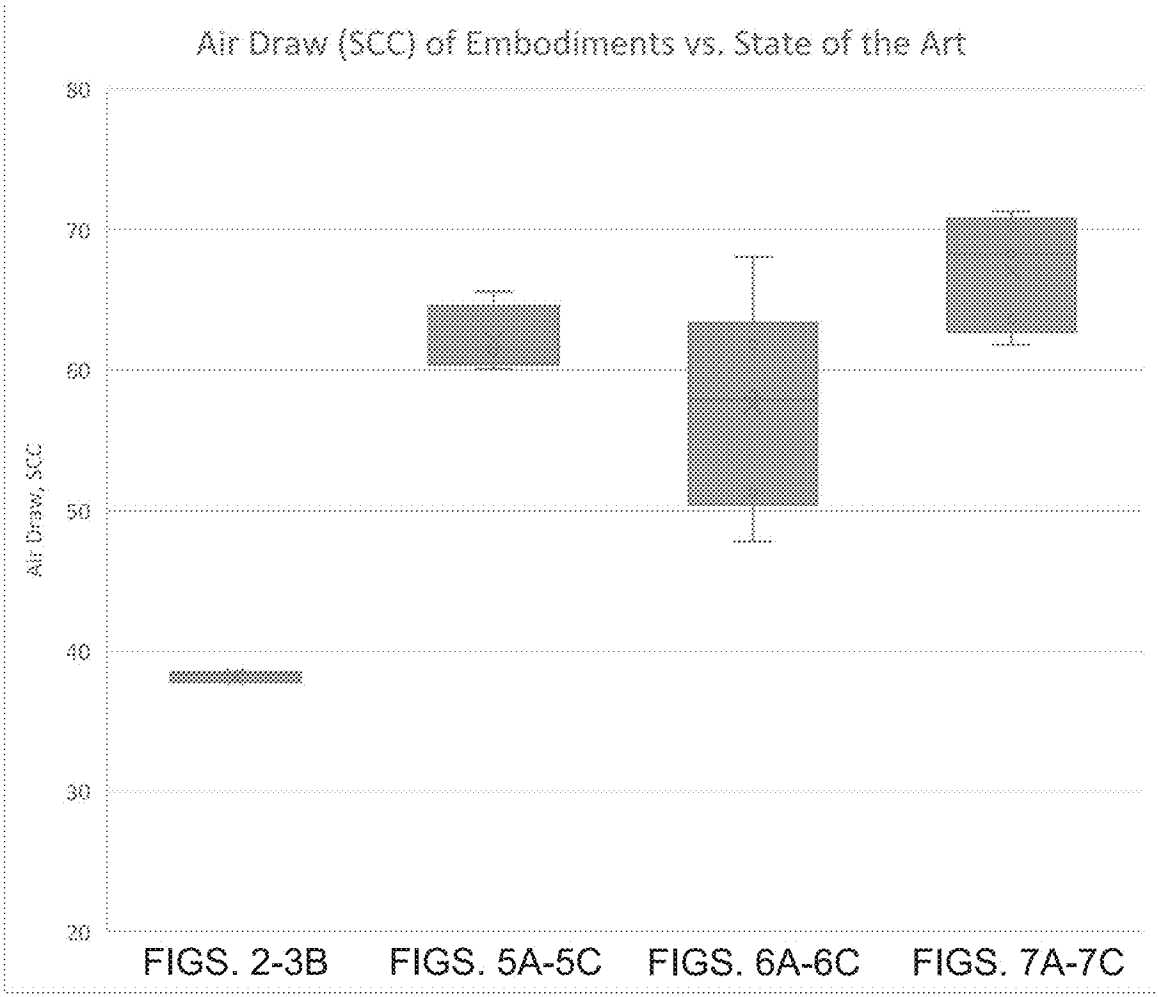
FIG. 31 is a graph illustrating air draw performance of an air inducer of the air inducer assembly of FIGS. 2-3B compared to the air inducers of FIGS. 5A-7C, according to aspects of the disclosure.

In one embodiment, the air inducers 120, 220, 320 according to the embodiments in FIGS. 5A-7C produce improved air draw relative to an air inducer in which the distal end 51 of the tube 36 terminates within the chamber 26 and/or above the top of the recess 37, such as the air inducer 20 in FIGS. 2-3B. This is true even in an air inducer that is otherwise identical other than the length of the tube 36, e.g., comparing the air inducer 320 in FIGS. 7A-7C to the air inducer 20 of FIGS. 2-3B. The air draw improvement is at least 50% in one embodiment, from 50-100% in another embodiment, or from 60-80% in a further embodiment, measured as an average, either in standard cubic centimeters (SCC) or standard cubic centimeters per minute (SCCM). FIG. 31 illustrates air draw performance of the air inducers 120, 220, 320 according to the embodiments of FIGS. 5A-7C compared to the air inducer 20 of FIGS. 2-3B, measured in SCC. The testing was performed with 3D printed prototypes of the embodiments in FIGS. 5A-7C. The air inlet 32 of the air inducer was attached to a flow meter such that any air that was drawn into the air inlet 32 would have to flow through the flow meter. The total amount of air drawn was calculated using the flow rate values generated. Values were collected at 20 psig and 50 psig inlet water pressures. The air inducer 120 in FIGS. 5A-5C produced, on average, an air draw of 61.3 SCC, which represents a 60.5% improvement over the average air draw of 38.2 SCC produced by the air inducer 20 of FIGS. 2-3B. The air inducer 220 in FIGS. 6A-6C produced, on average, an air draw of 57.5 SCC, which represents a 50.5% improvement over the average air draw of 38.2 SCC produced by the air inducer 20 of FIGS. 2-3B. The air inducer 320 in FIGS. 7A-7C produced, on average, an air draw of 67.1 SCC, which represents a 75.7% improvement over the average air draw of 38.2 SCC produced by the air inducer 20 of FIGS. 2-3B.

Figure 8A:
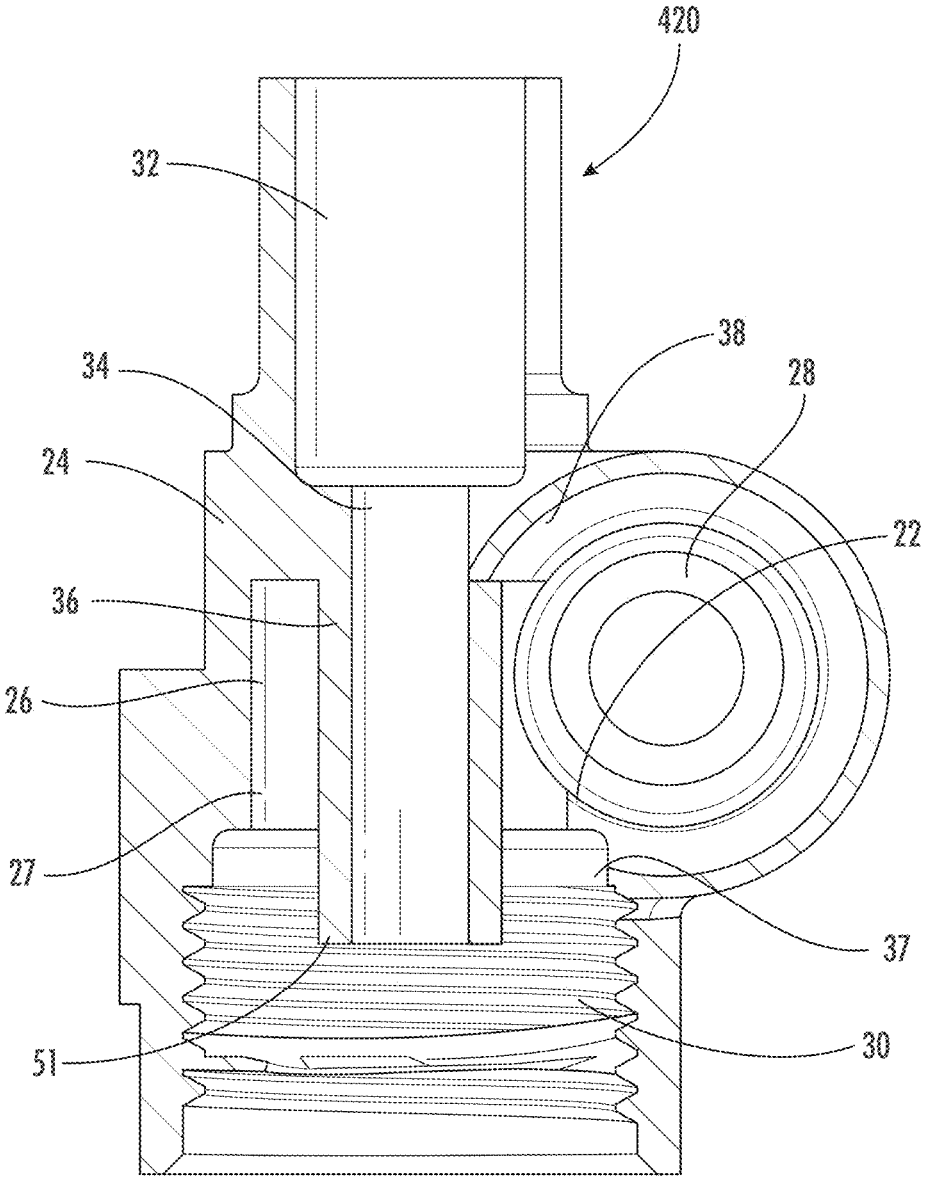
FIG. 8A is a cross-section view of another embodiment of an air inducer usable in connection with the system of FIG. 1, according to aspects of the disclosure.
Figure 8B:
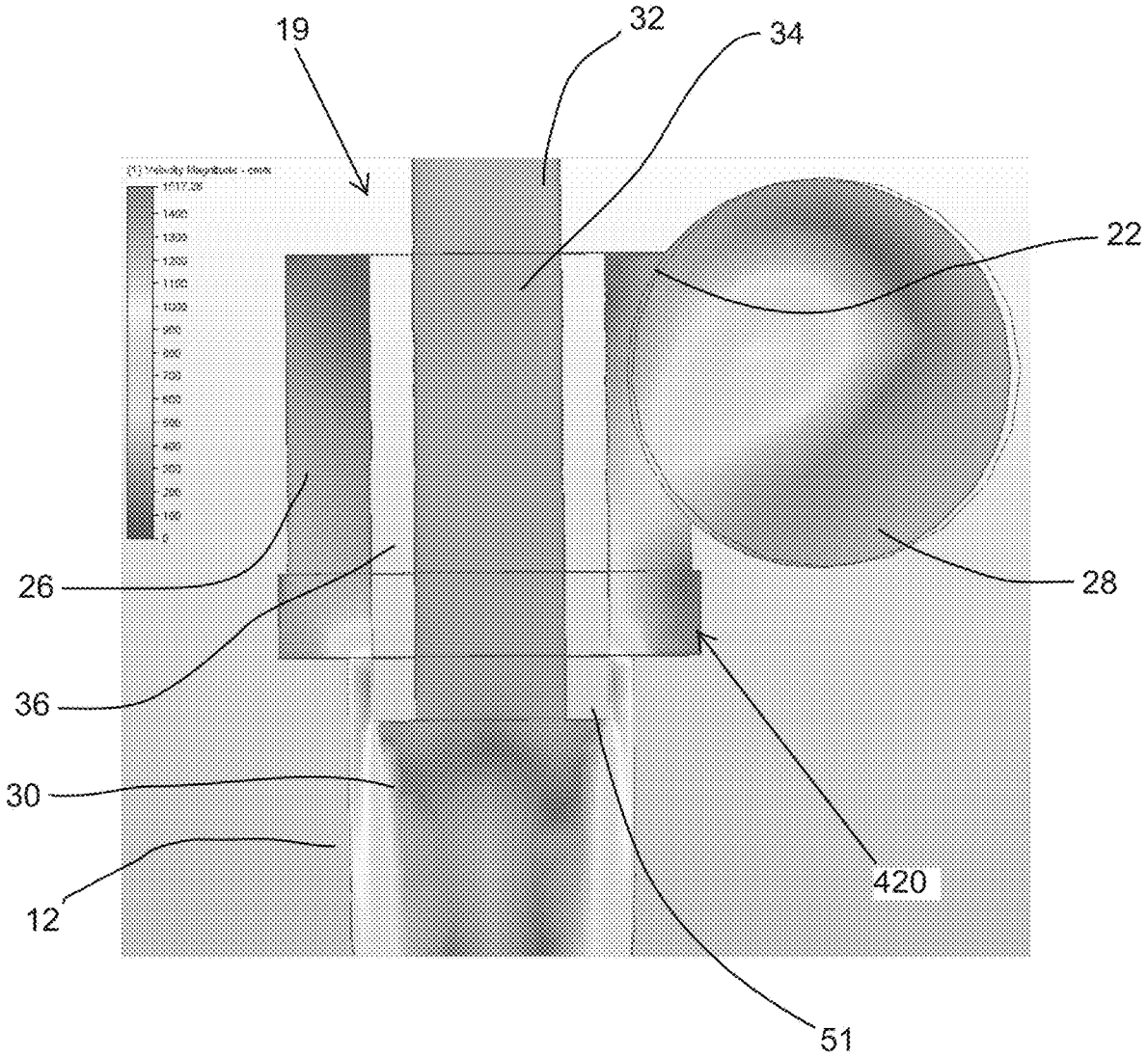
FIG. 8B is a cross-section view of the internal volume of an air inducer assembly including the air inducer of FIG. 8A, with velocities at air inlet and liquid outlet illustrated quantitatively.

FIGS. 8A-8B illustrate an embodiment of an air inducer 420 configured similarly to the air inducer 20 of FIGS. 2-3A, in which the length L of the tube 36 is longer, the diameter DC of the chamber 26 is larger, and the diameter DT of the tube 36 is greater than in the air inducer of FIGS. 2-3A. In the embodiment of FIGS. 8A-8B, the length L of the tube 36 is 0.553 inch, the diameter DT of the tube 36 is 0.280 inch, and the diameter DC of the chamber 26 is 0.480 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B.

Figure 9A:
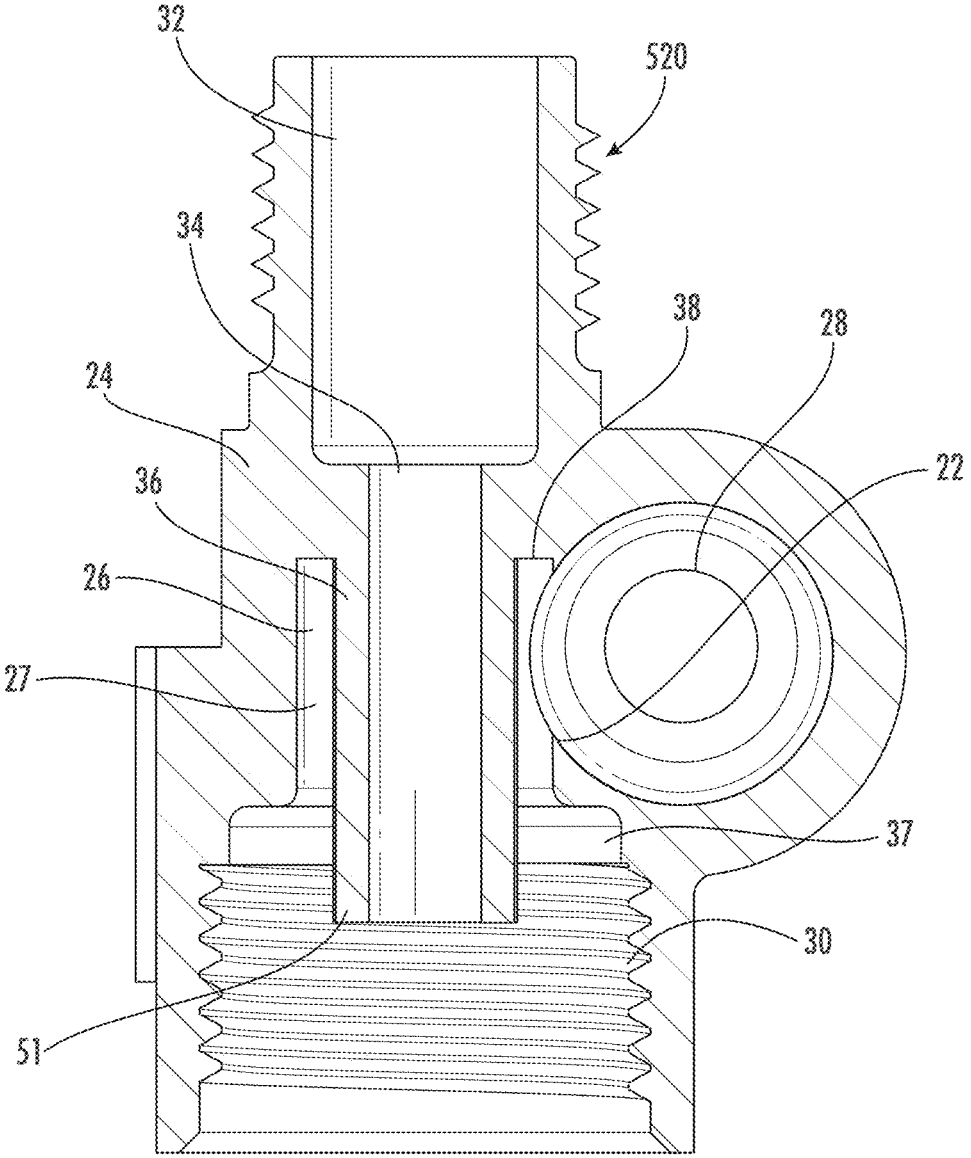
FIG. 9A is a cross-section view of another embodiment of an air inducer usable in connection with the system of FIG. 1, according to aspects of the disclosure.
Figure 9B:
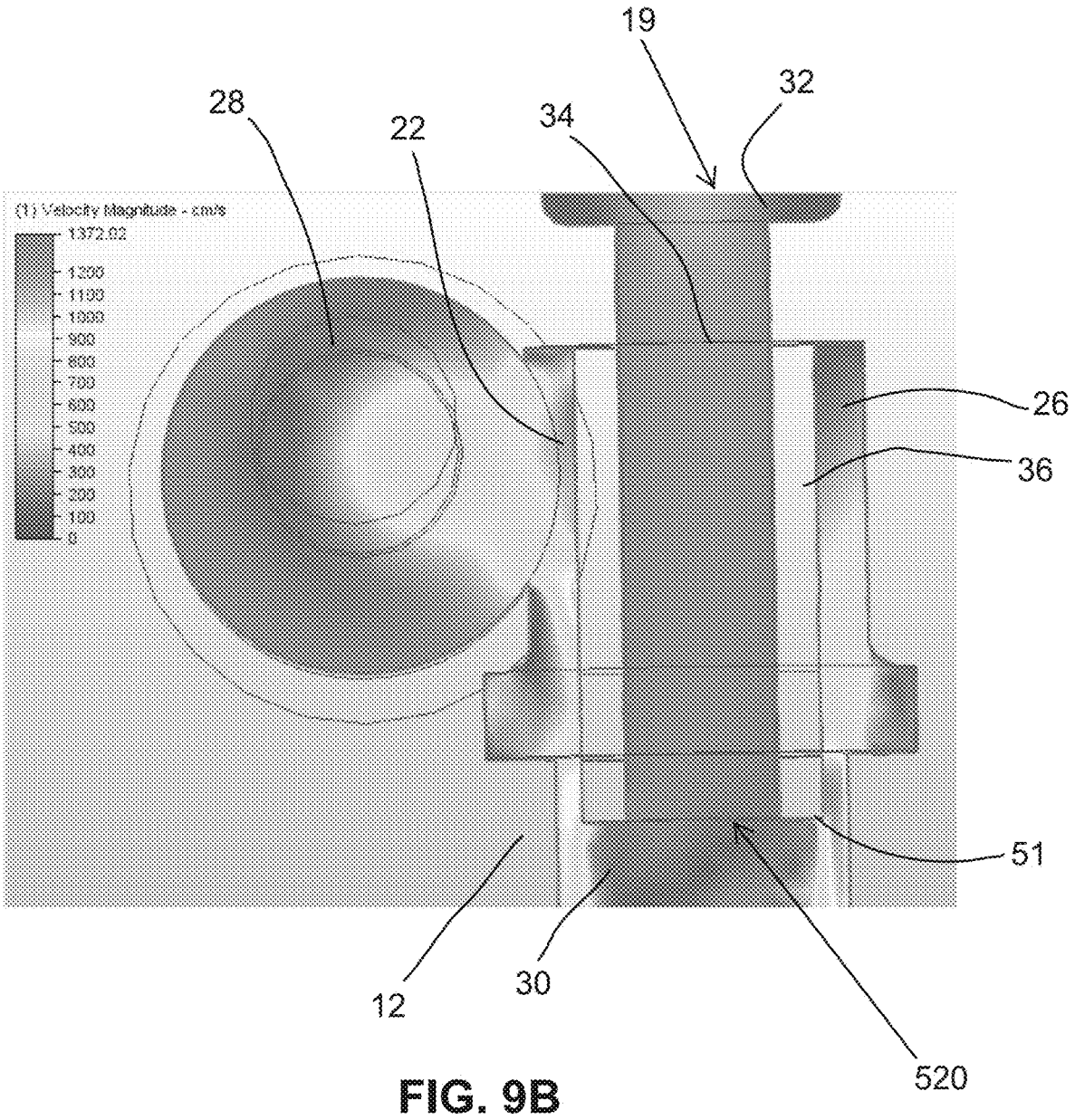
FIG. 9B is a cross-section view of the internal volume of an air inducer assembly including the air inducer of FIG. 9A, with velocities at air inlet and liquid outlet illustrated quantitatively.

FIGS. 9A-9B illustrate an embodiment of an air inducer 520 configured similarly to the air inducer 20 of FIGS. 2-3A, in which the length L of the tube 36 is longer and the diameter DT of the tube 36 is greater than in the air inducer of FIGS. 2-3A. In the embodiment of FIGS. 9A-9B, the length L of the tube 36 is 0.553 inch, and the diameter DT of the tube 36 is 0.280 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and similar performance to the air inducer 420 of FIGS. 8A-8B.

Figure 10A:
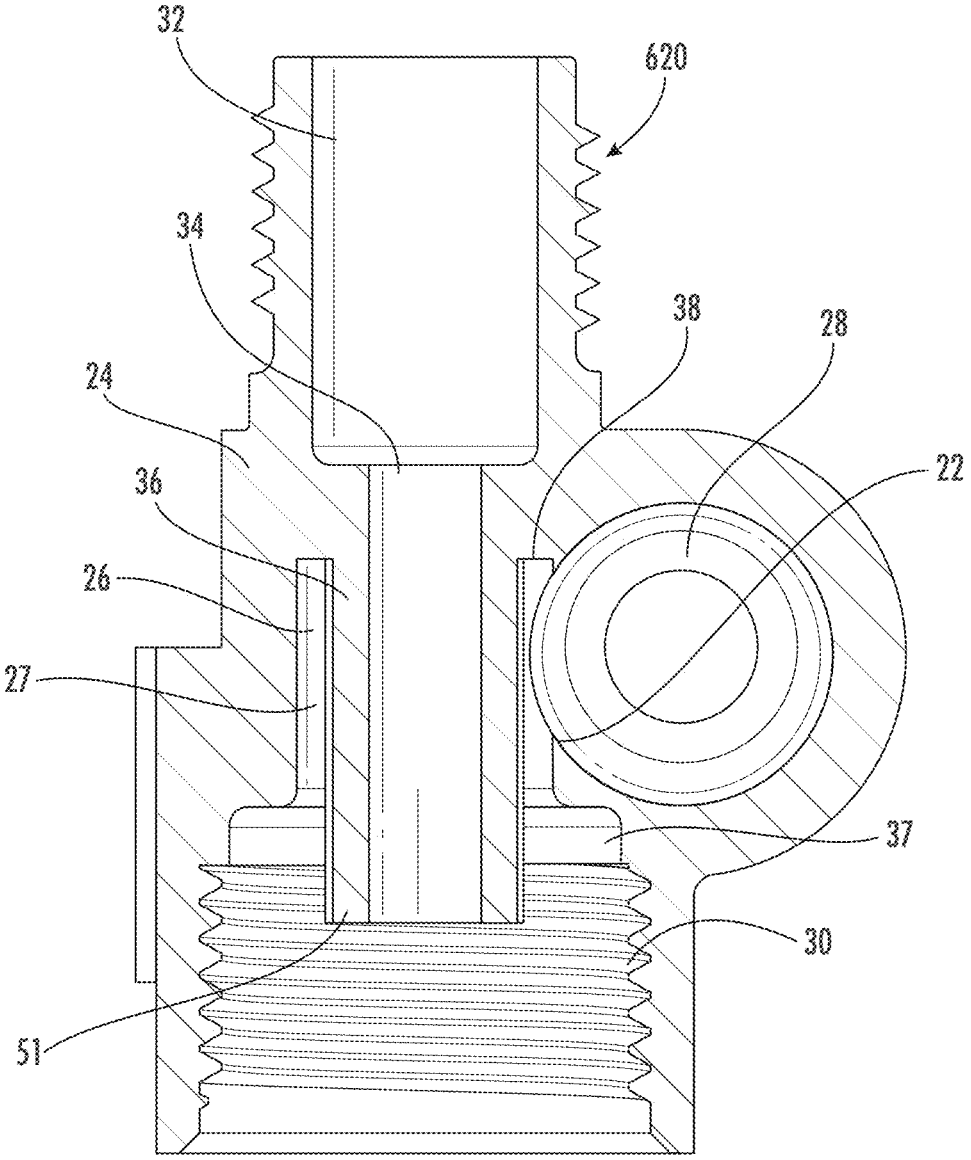
FIG. 10A is a cross-section view of another embodiment of an air inducer usable in connection with the system of FIG. 1, according to aspects of the disclosure.
Figure 10B:
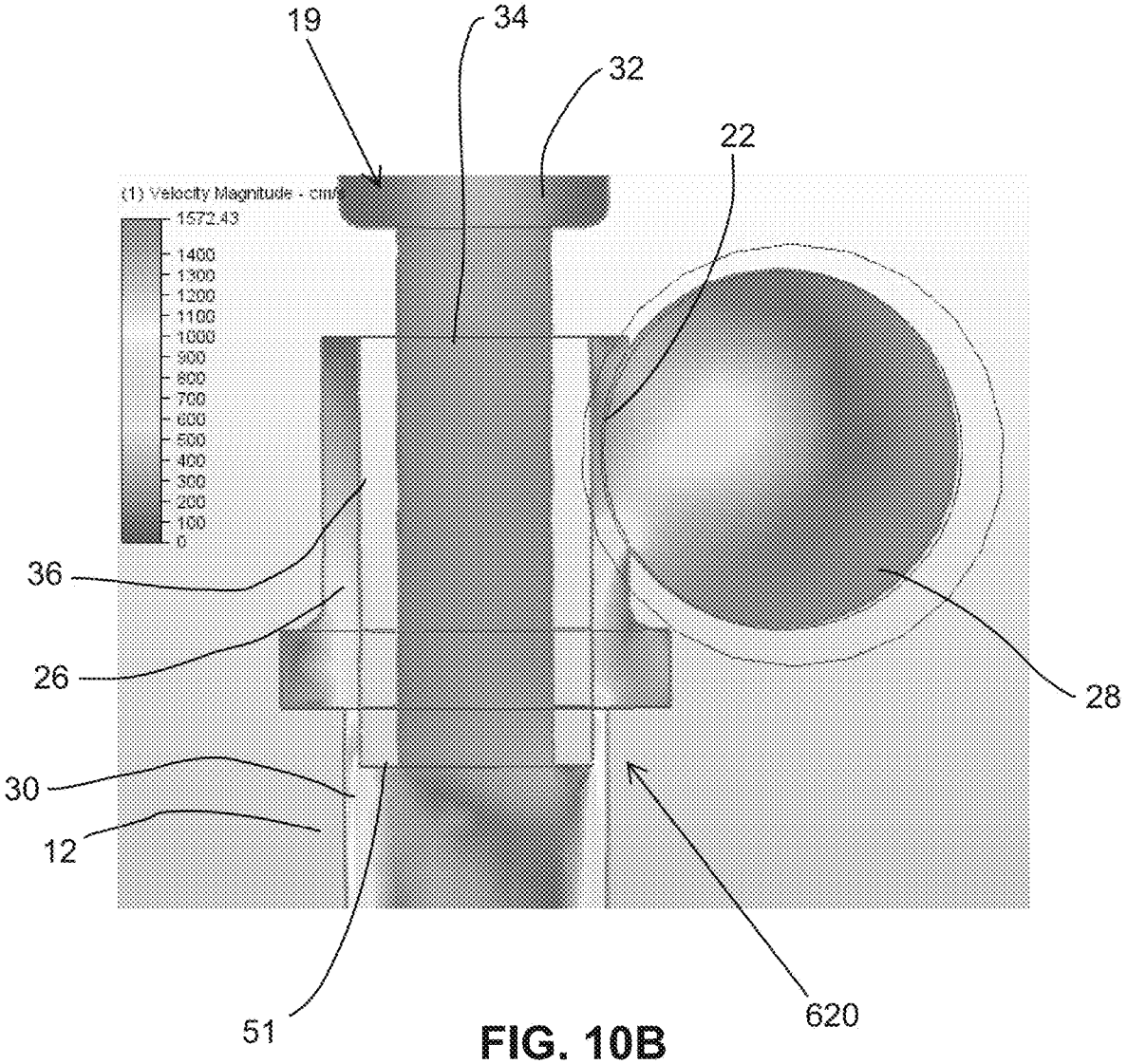
FIG. 10B is a cross-section view of the internal volume of an air inducer assembly including the air inducer of FIG. 10A, with velocities at air inlet and liquid outlet illustrated quantitatively.

FIGS. 10A-10B illustrate an embodiment of an air inducer 620 configured similarly to the air inducer 20 of FIGS. 2-3A, in which the length L of the tube 36 is longer and the diameter DT of the tube 36 is greater than in the air inducer of FIGS. 2-3A. In the embodiment of FIGS. 10A-10B, the length L of the tube 36 is 0.553 inch, the diameter DT of the tube 36 is 0.300 inch, and the diameter DC of the chamber 26 is 0.395 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and superior performance relative to the assemblies 420, 520 of FIGS. 8A-9B.

Figure 11A:
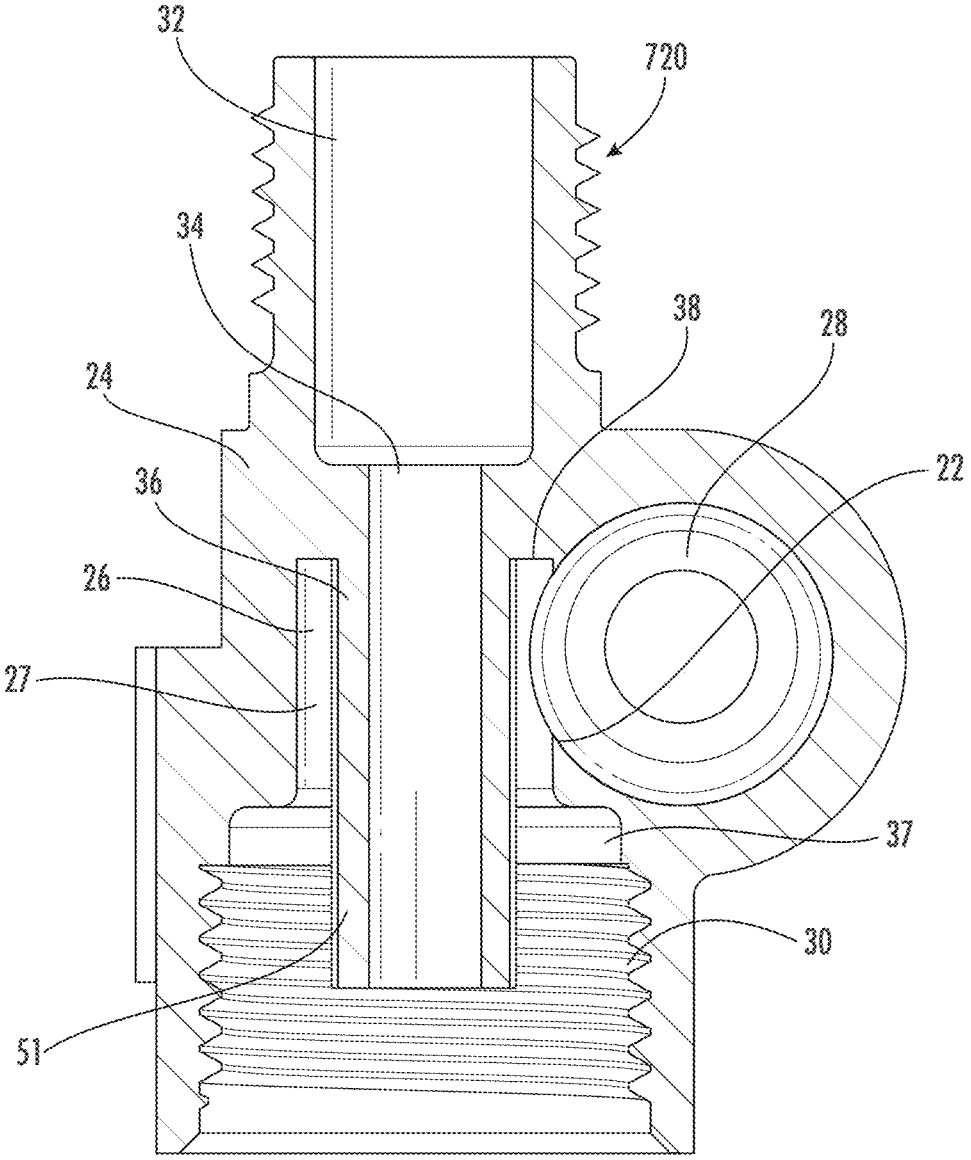
FIG. 11A is a cross-section view of another embodiment of an air inducer usable in connection with the system of FIG. 1, according to aspects of the disclosure.
Figure 11B:
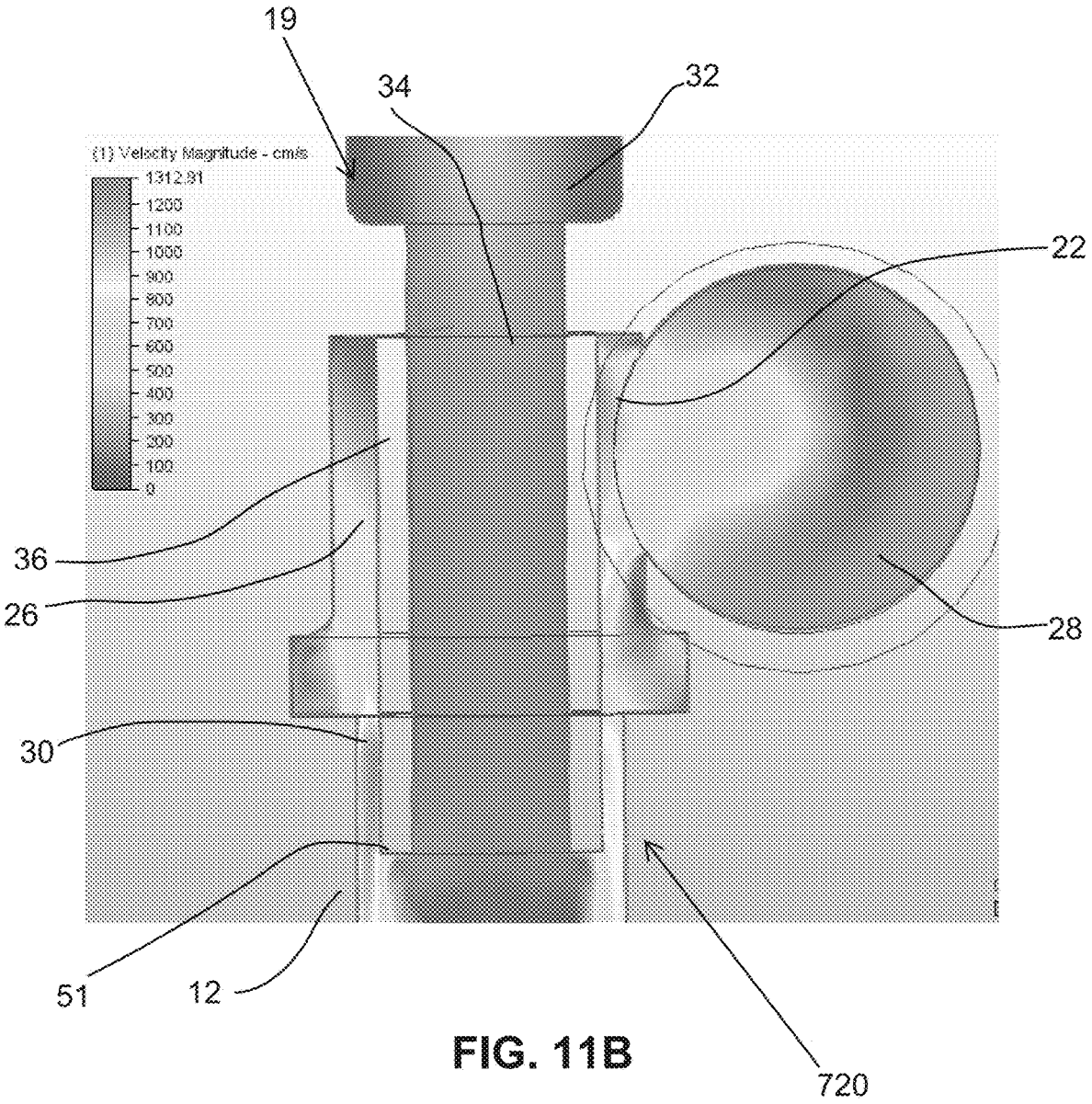
FIG. 11B is a cross-section view of the internal volume of an air inducer assembly including the air inducer of FIG. 11A, with velocities at air inlet and liquid outlet illustrated quantitatively.

FIGS. 11A-11B illustrate an embodiment of an air inducer 720 configured similarly to the air inducer 20 of FIGS. 2-3A, in which the length L of the tube 36 is longer and the diameter DT of the tube 36 is greater than in the air inducer of FIGS. 2-3A. In the embodiment of FIGS. 11A-11B, the length L of the tube 36 is 0.653 inch, the diameter DC of the chamber 26 is 0.395 inch, and the diameter DT of the tube 36 is 0.280 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and similar performance relative to the assemblies 420, 520 of FIGS. 8A-9B.

Figure 12A:
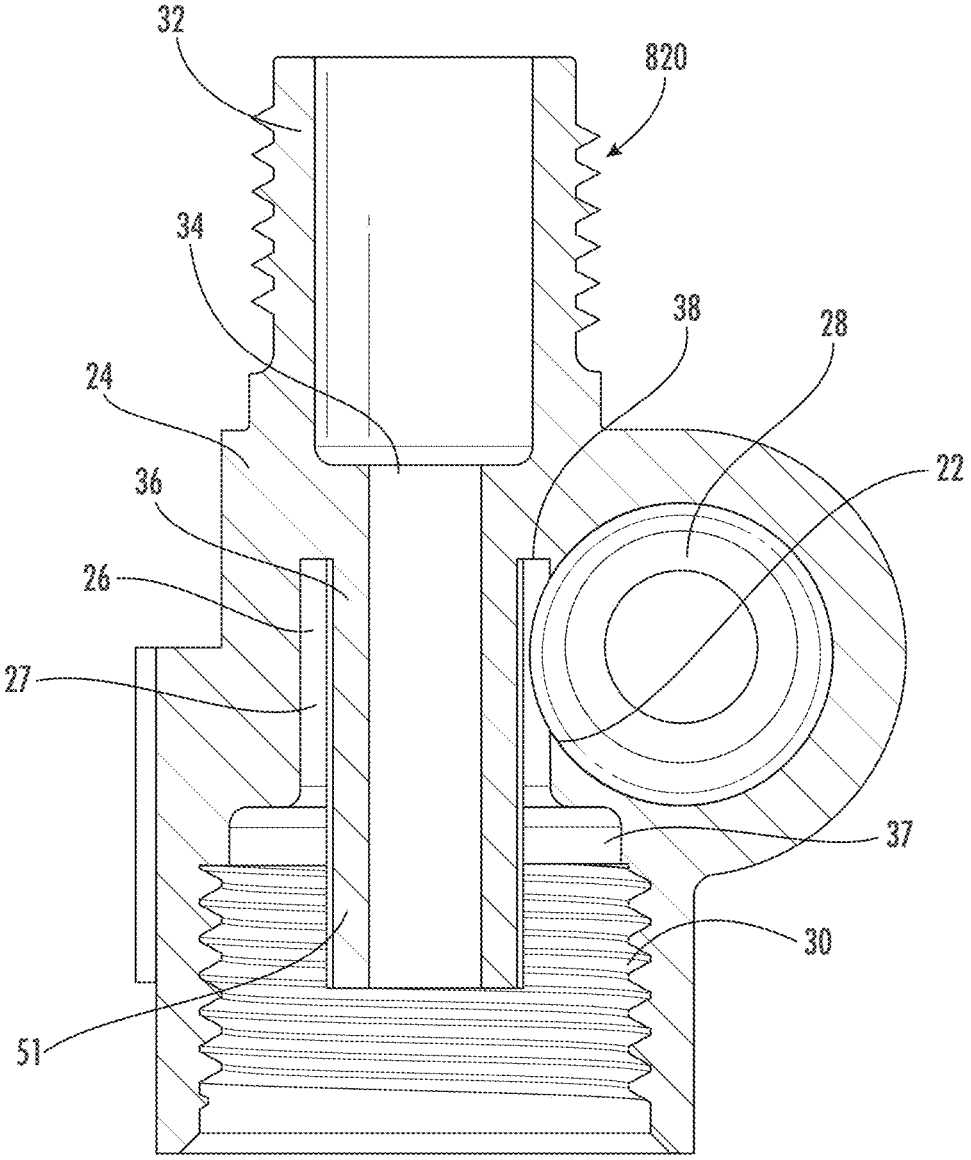
FIG. 12A is a cross-section view of another embodiment of an air inducer usable in connection with the system of FIG. 1, according to aspects of the disclosure.
Figure 12B:
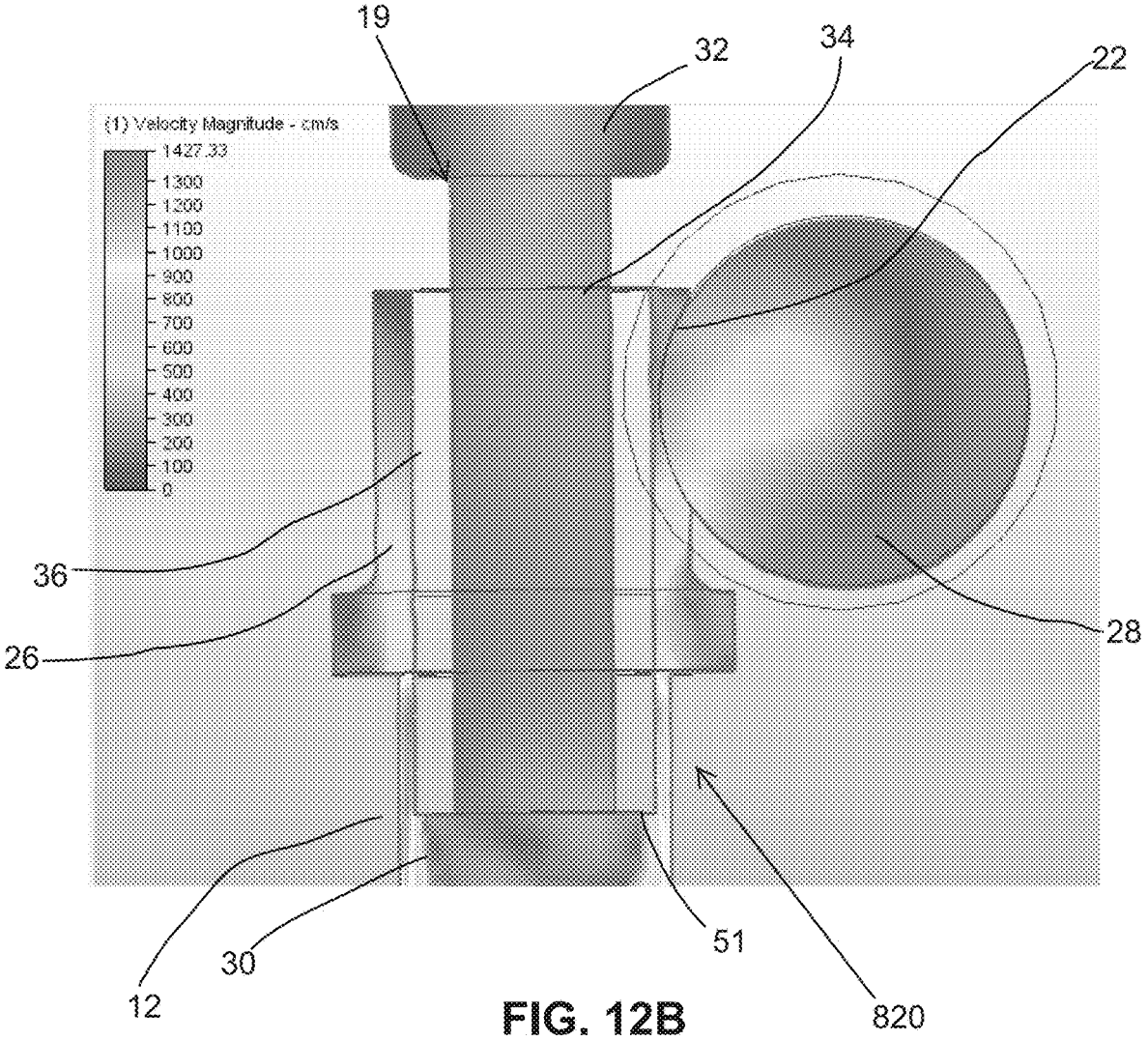
FIG. 12B is a cross-section view of the internal volume of an air inducer assembly including the air inducer of FIG. 12A, with velocities at air inlet and liquid outlet illustrated quantitatively.

FIGS. 12A-12B illustrate an embodiment of an air inducer 820 configured similarly to the air inducer 20 of FIGS. 2-3A, in which the length L of the tube 36 is longer and the diameter DT of the tube 36 is greater than in the air inducer of FIGS. 2-3A. In the embodiment of FIGS. 12A-12B, the length L of the tube 36 is 0.653 inch, the diameter DC of the chamber 26 is 0.395 inch, and the diameter DT of the tube 36 is 0.300 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and superior performance relative to the air inducer 620 of FIGS. 10A-10B.

Figure 13A:
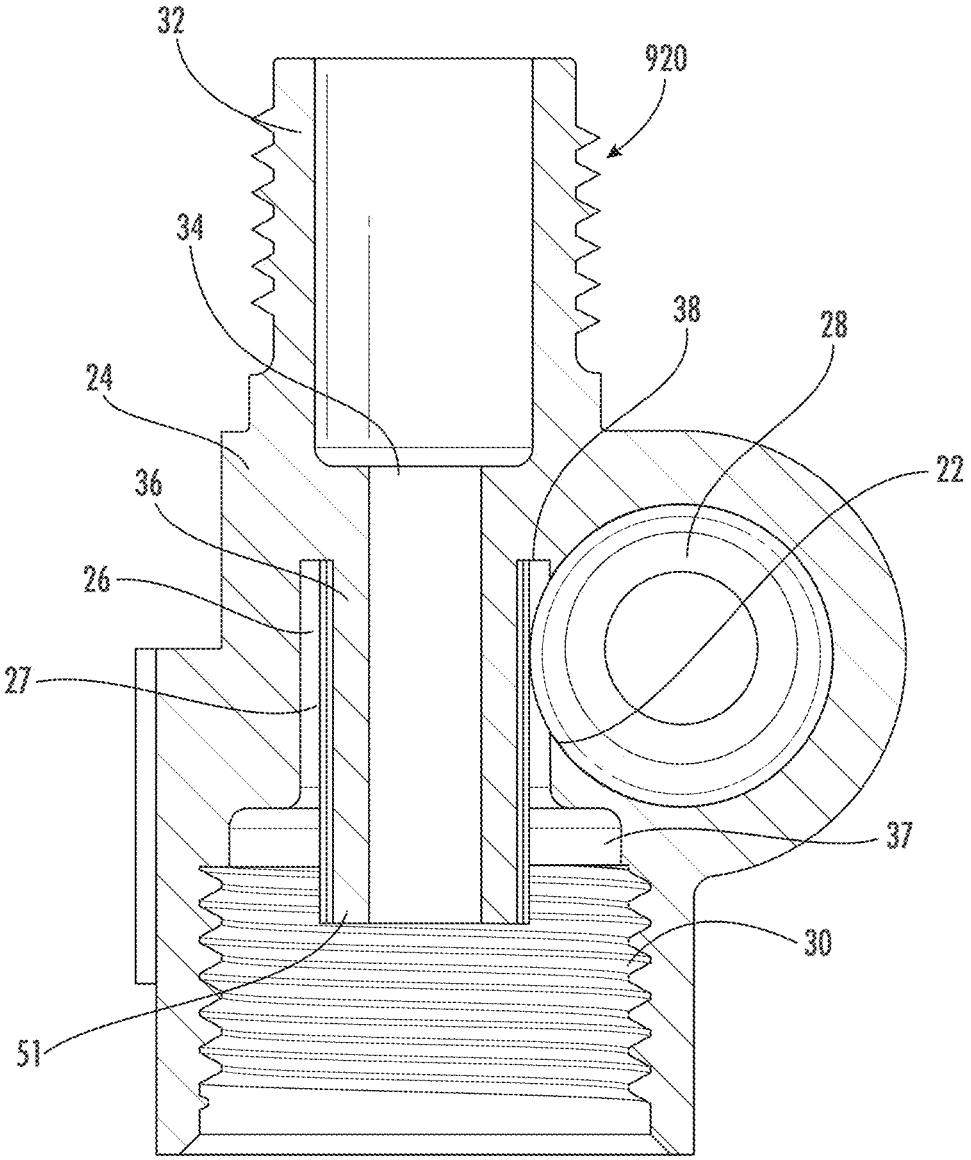
FIG. 13A is a cross-section view of another embodiment of an air inducer usable in connection with the system of FIG. 1, according to aspects of the disclosure.
Figure 13B:
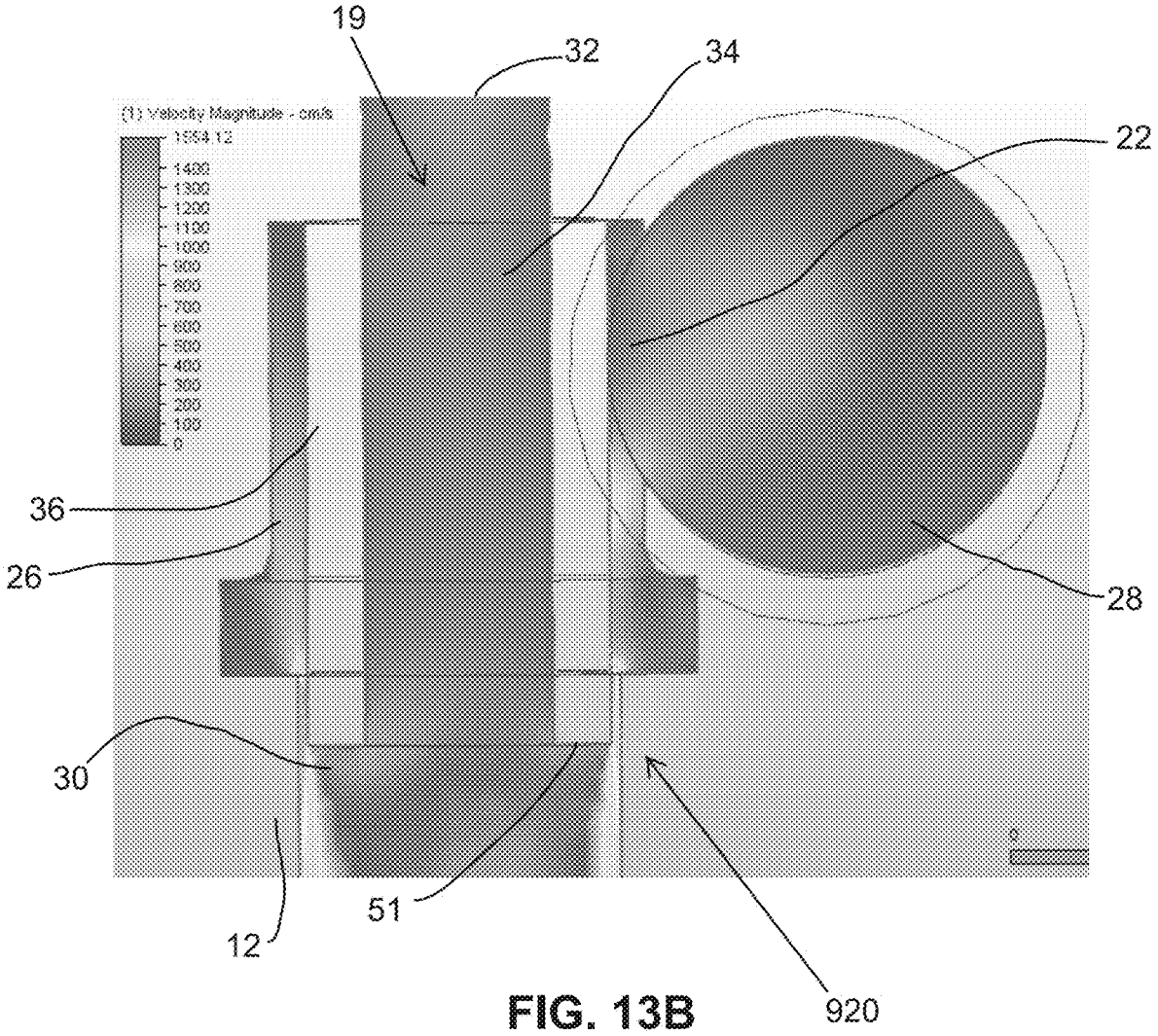
FIG. 13B is a cross-section view of the internal volume of an air inducer assembly including the air inducer of FIG. 13A, with velocities at air inlet and liquid outlet illustrated quantitatively.

FIGS. 13A-13B illustrate an embodiment of an air inducer 920 configured similarly to the air inducer 20 of FIGS. 2-3A, in which the length L of the tube 36 is longer and the diameter DT of the tube 36 is greater than in the air inducer of FIGS. 2-3A. In the embodiment of FIGS. 13A-13B, the length L of the tube 36 is 0.553 inch, the diameter DC of the chamber 26 is 0.395 inch, and the diameter DT of the tube 36 is 0.320 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and superior performance relative to the assemblies 420, 520, 620, 720, 820 of FIGS. 8A-12B.

Figure 14A:
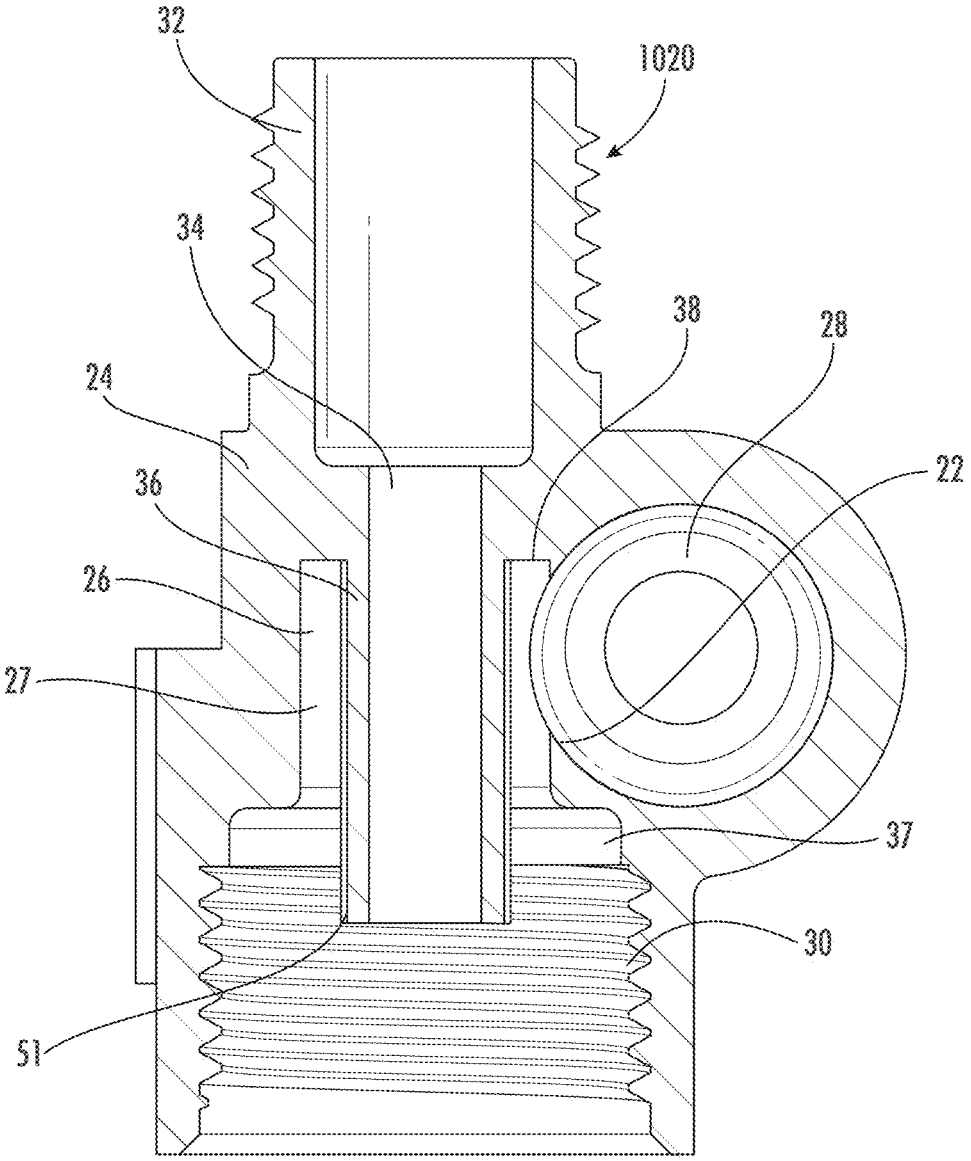
FIG. 14A is a cross-section view of another embodiment of an air inducer usable in connection with the system of FIG. 1, according to aspects of the disclosure.
Figure 14B:
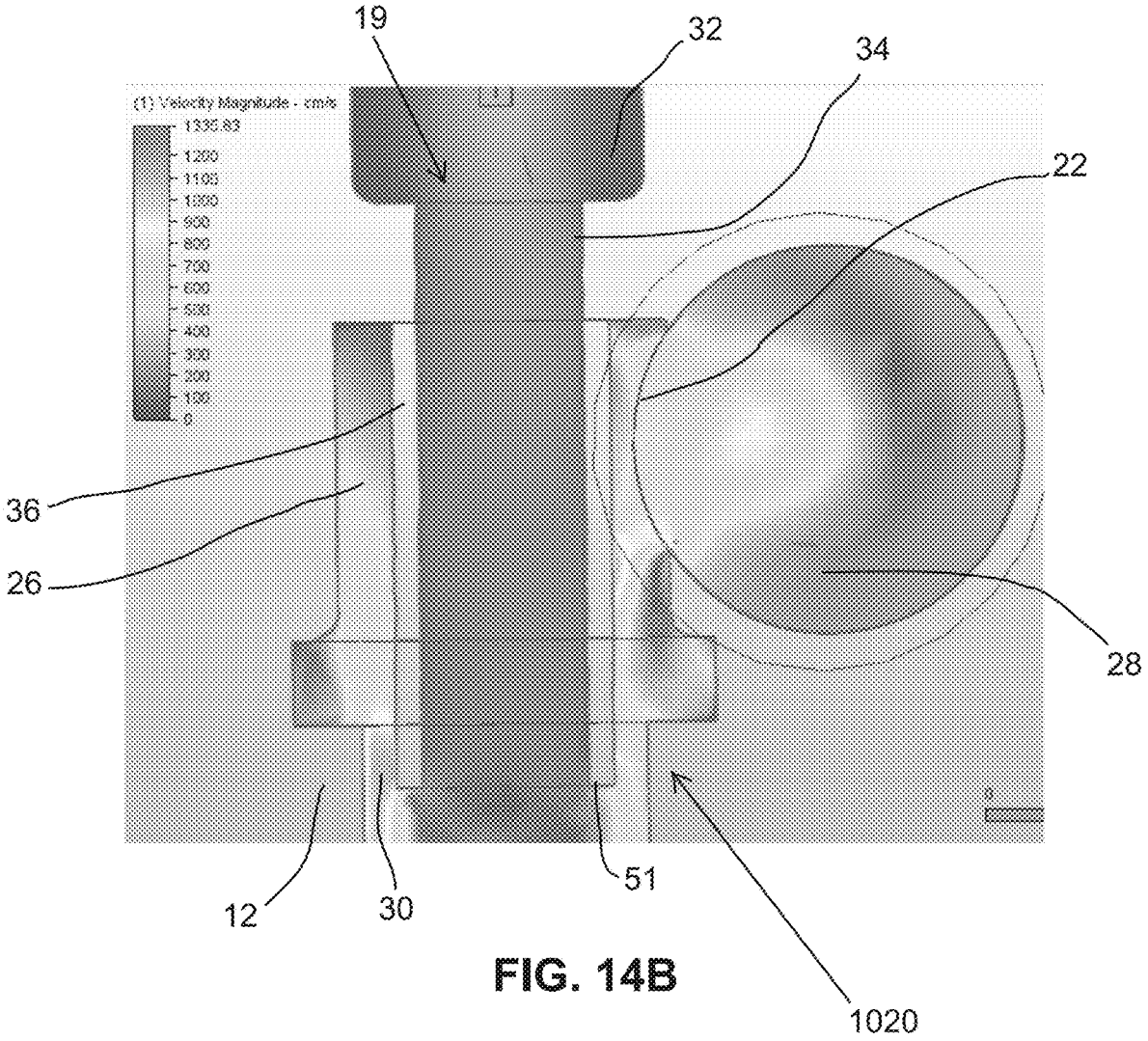
FIG. 14B is a cross-section view of the internal volume of an air inducer assembly including the air inducer of FIG. 14A, with velocities at air inlet and liquid outlet illustrated quantitatively.

FIGS. 14A-14B illustrate an embodiment of an air inducer 1020 configured similarly to the air inducer 20 of FIGS. 2-3A, in which the length L of the tube 36 is longer and the diameter DT of the tube 36 is larger than in the air inducer of FIGS. 2-3A. In the embodiment of FIGS. 14A-14B, the length L of the tube 36 is 0.553 inch, the diameter DC of the chamber 26 is 0.395 inch, and the diameter DT of the tube 36 is 0.260 inch. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and slightly inferior performance relative to the assemblies 420, 520 of FIGS. 8A-9B.

Figure 15A:
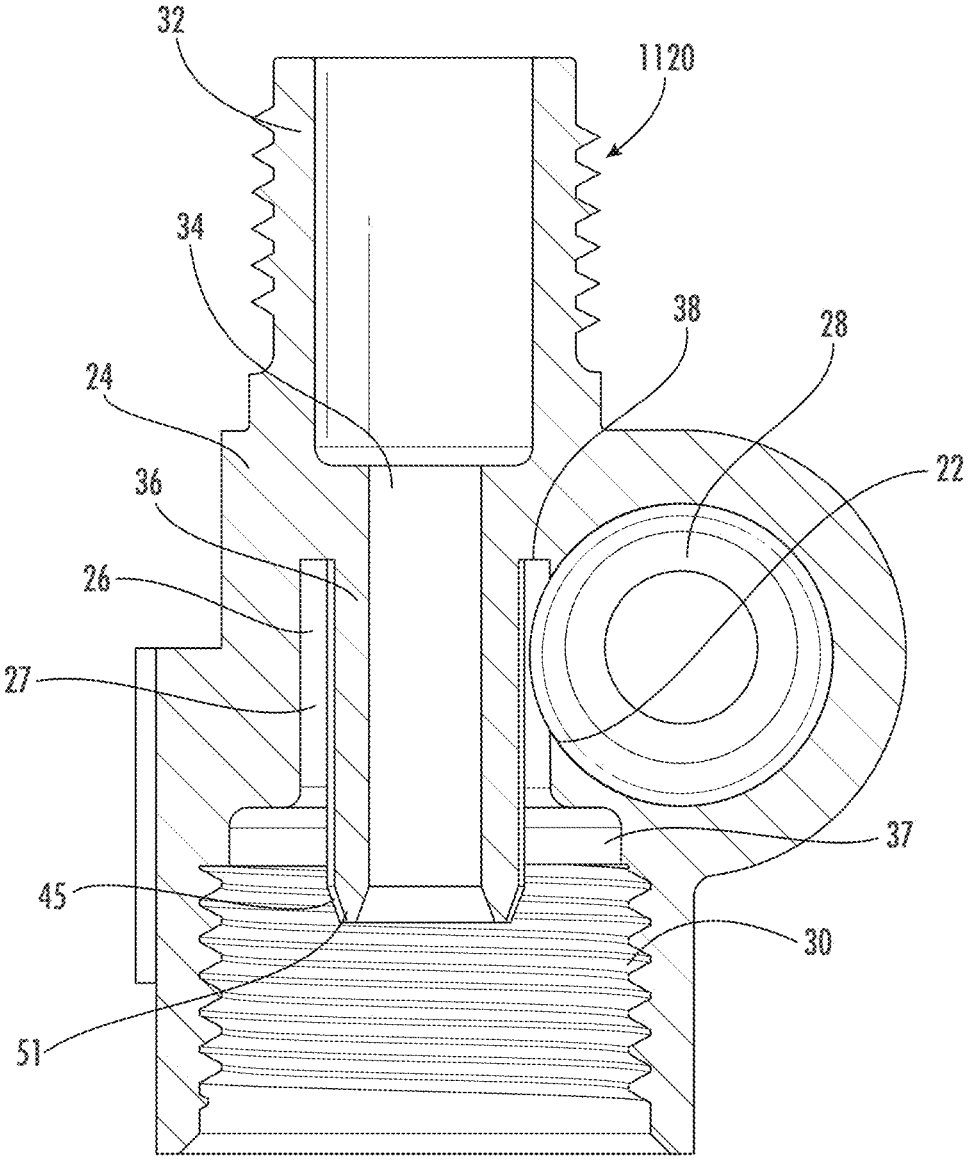
FIG. 15A is a cross-section view of another embodiment of an air inducer usable in connection with the system of FIG. 1, according to aspects of the disclosure.
Figure 15B:
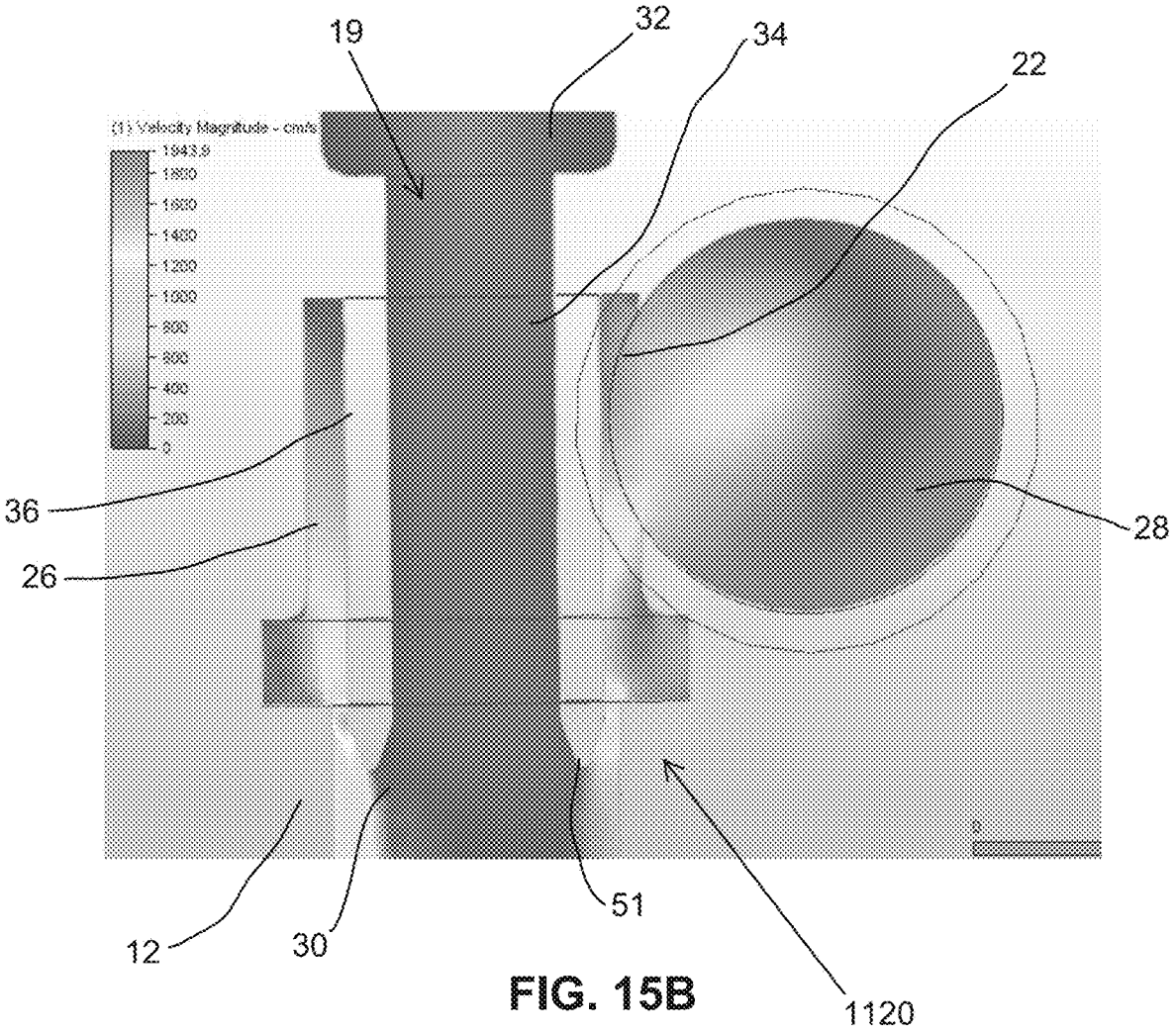
FIG. 15B is a cross-section view of the internal volume of an air inducer assembly including the air inducer of FIG. 15A, with velocities at air inlet and liquid outlet illustrated quantitatively.

FIGS. 15A-15B illustrate an embodiment of an air inducer 1120 configured similarly to the air inducer 20 of FIGS. 2-3A, in which the dimensions are the same as in the embodiment of FIGS. 10A-10B. In the air inducer 1120 of FIGS. 15A-15B, the distal end 51 of the tube 36 has chamfers 45 on the inner and outer surfaces. In this embodiment, the distal end 51 of the tube 36 extends beyond the chamber 26 and below the bottom of the recess 37 and terminates within the outlet 30. This embodiment exhibited superior mass flow balance performance relative to the air inducer 20 of FIGS. 2-3B, and slightly inferior performance relative to the assemblies 420, 520 of FIGS. 8A-9B.

Figure 16A:
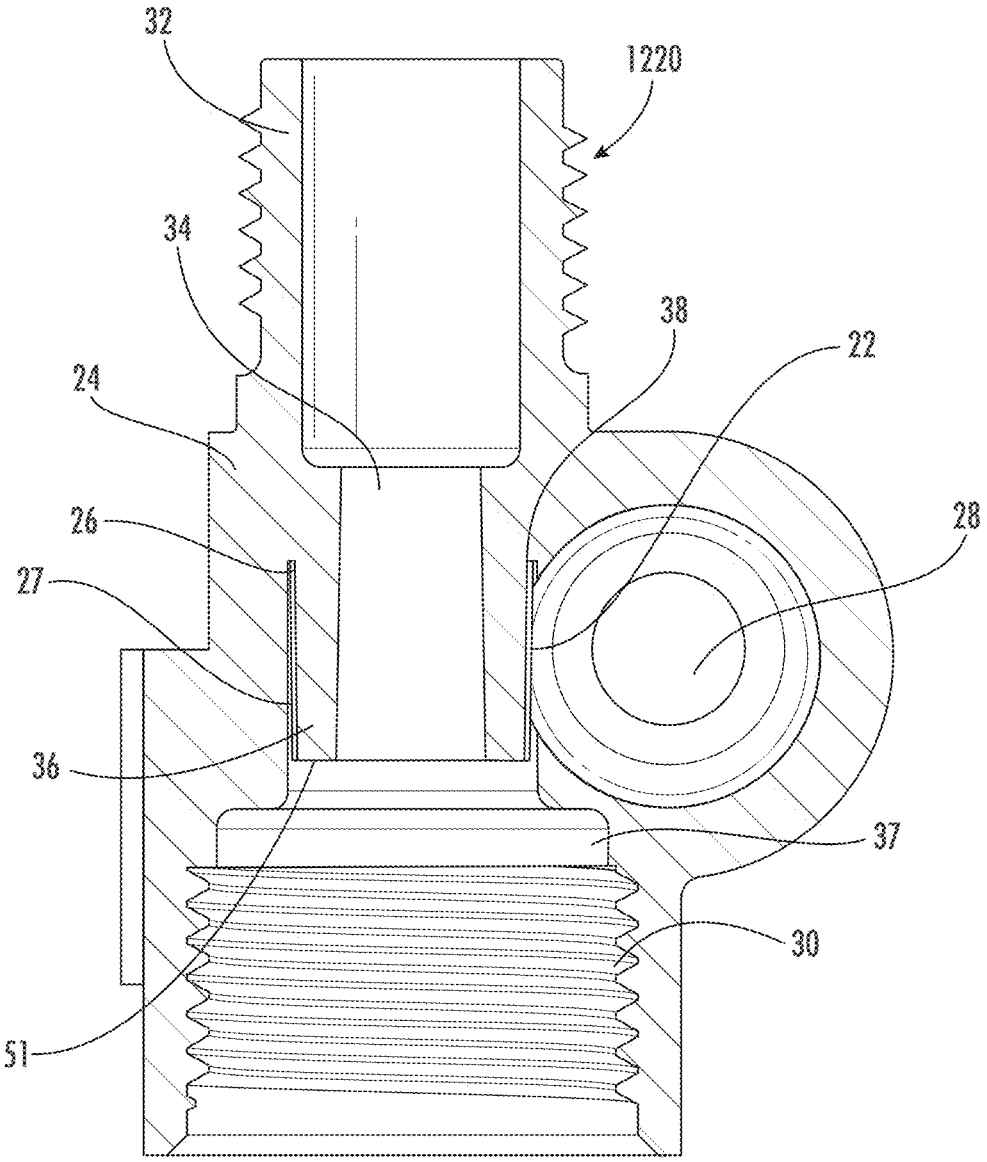
FIG. 16A is a cross-section view of another embodiment of an air inducer usable in connection with the system of FIG. 1, according to aspects of the disclosure.
Figure 16B:
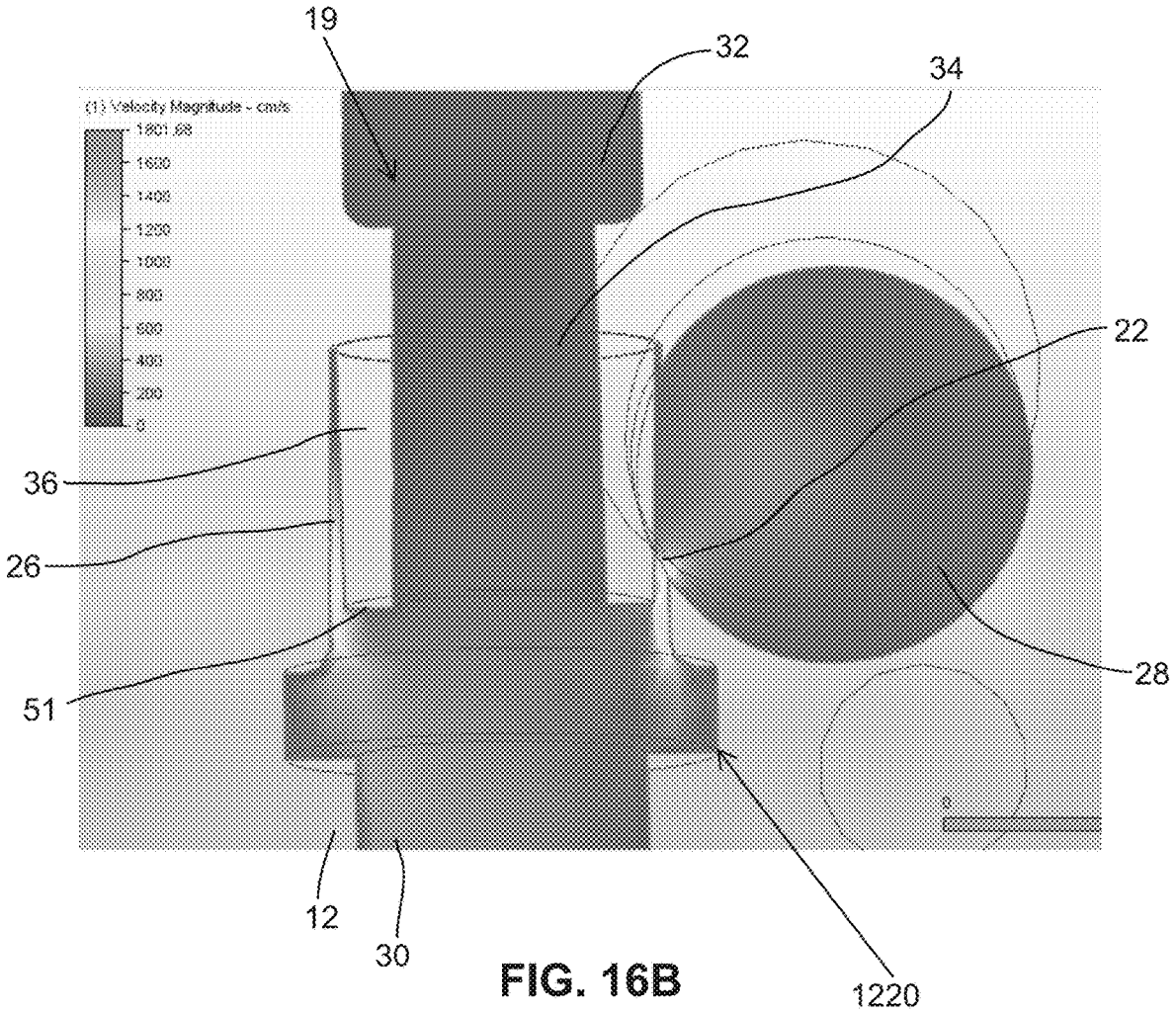
FIG. 16B is a cross-section view of the internal volume of an air inducer assembly including the air inducer of FIG. 16A, with velocities at air inlet and liquid outlet illustrated quantitatively.

FIGS. 16A-16B illustrate an embodiment of an air inducer 1220 configured similarly to the air inducer 20 of FIGS. 2-3A, in which the diameter DT of the tube 36 is larger than in the air inducer of FIGS. 2-3A. In the embodiment of FIGS. 14A-14B, the length L of the tube 36 is 0.303 inch, the diameter DC of the chamber 26 is 0.395 inch, the diameter DT of the tube 36 is 0.360 inch. The tube 36 in this embodiment terminates within the chamber 26 and above the top of the recess 37. This embodiment exhibited similar or inferior mass flow balance performance relative to the air inducer 20 of FIGS. 2-3B.

FIGS. 17A-28 illustrate embodiments of air inducers 1320, 1420, 1520, 1620, 1720, 1820 that include a plurality of ribs 50 extending radially with respect to the tube 36 between the wall(s) of the chamber 26 and the tube 36. The ribs 50 in these embodiments also extend to the top wall 38 of the chamber 26 and extend downward from the top wall 38 of the chamber 26, along the length of the tube 36 and parallel to the axis of elongation of the tube 36. The ribs 50 in the embodiments of FIGS. 17A-28 are spaced around the periphery of the tube 36 at equal intervals, such that spaces 52 are defined between the ribs 50. The embodiments in FIGS. 17A-28 have four ribs 50 oriented at 90° angles to each other, and the ribs 50 are arranged such that two of the ribs 50 are positioned on either side of the opening 22 and the other two ribs 50 are positioned on the opposite side of the tube 36 from the opening 22. The ribs 50 are configured such that water passing through the chamber 26 from the opening 22 to the outlet 30 must pass through at least one of the spaces 52. Accordingly, the ribs 50 decrease the area for passage of water through the chamber 26 and thereby constrict the flow rate of water through the chamber 26. This permits air to be drawn through the passage 34 and into the chamber 26 and/or the outlet 30 more efficiently. The widths of the ribs 50 (defined between the tube 36 and the wall(s) 27 of the chamber 26) depend on the inner diameter DC of the chamber 26 and the outer diameter DT of the tube 36, and the lengths of the ribs 50 vary among the embodiments. With the exception of the air inducer 1420 of FIGS. 18A-18C, which performed very poorly, all of the other embodiments of assemblies 1320, 1520, 1620, 1720, 1820 in FIGS. 17A-28 exhibited consistently good mass flow balance performance that was comparable or superior to other embodiments described herein.

Figure 17A:
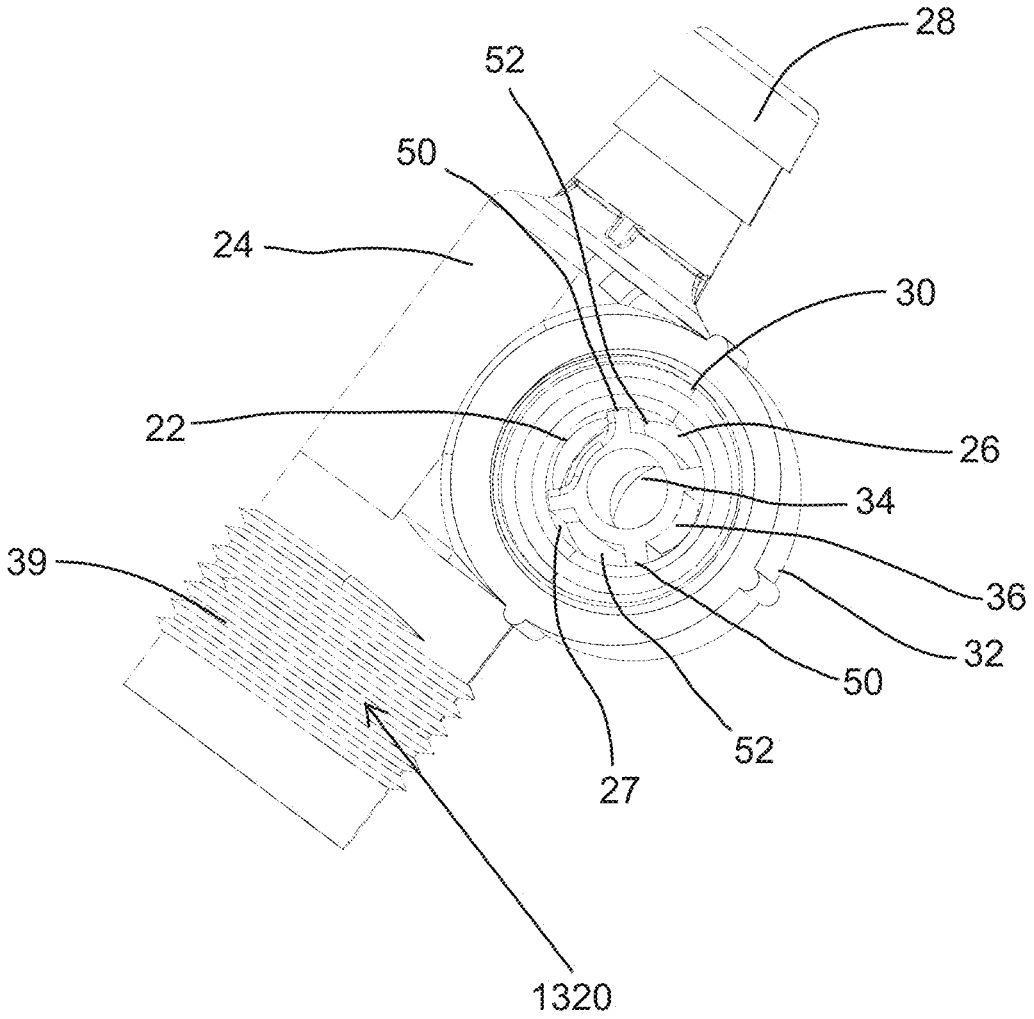
FIG. 17A is a perspective view of another embodiment of an air inducer usable in connection with the system of FIG. 1, according to aspects of the disclosure.
Figure 17B:
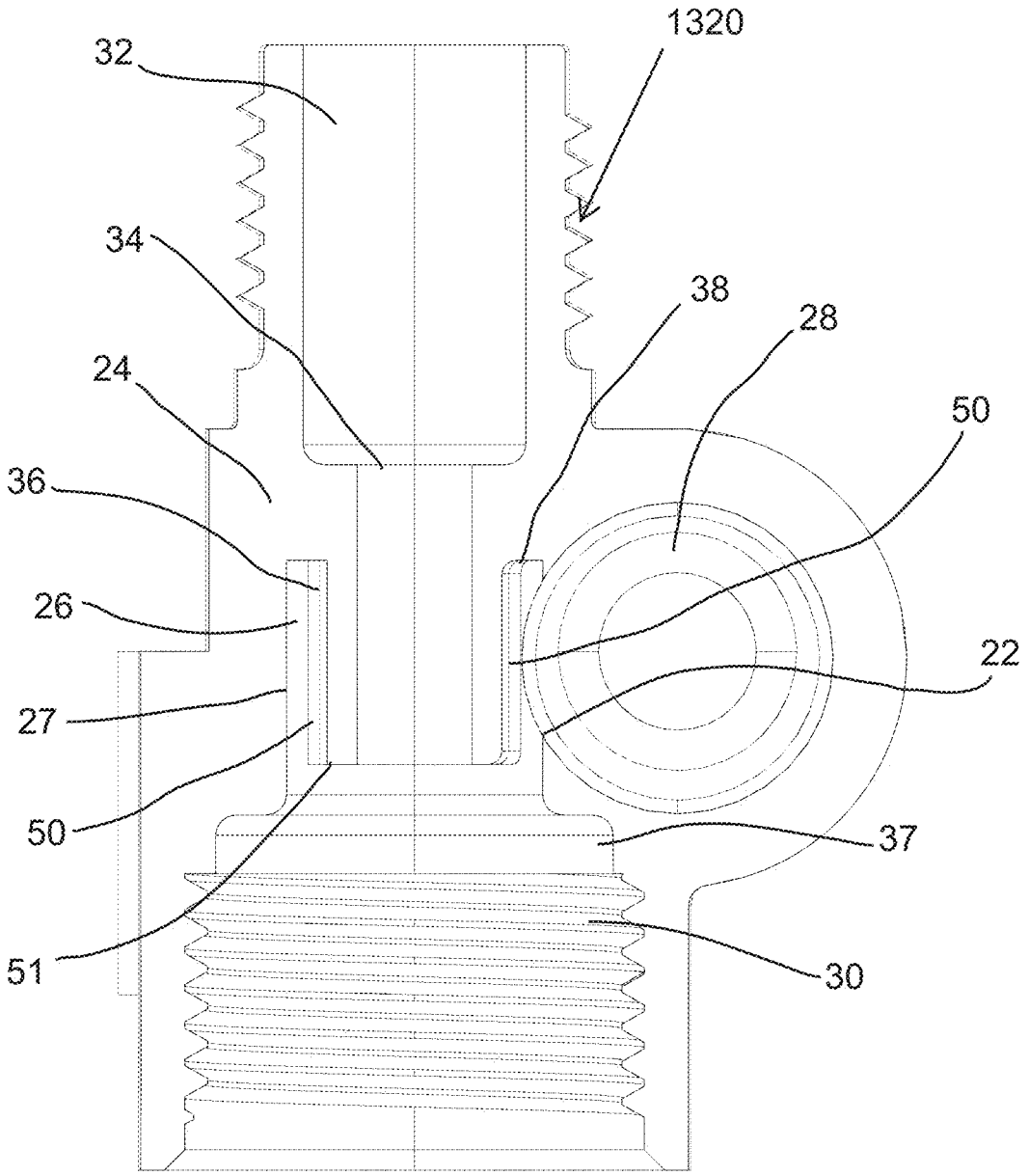
FIG. 17B is a cross-section view of the air inducer of FIG. 17A.
Figure 17C:
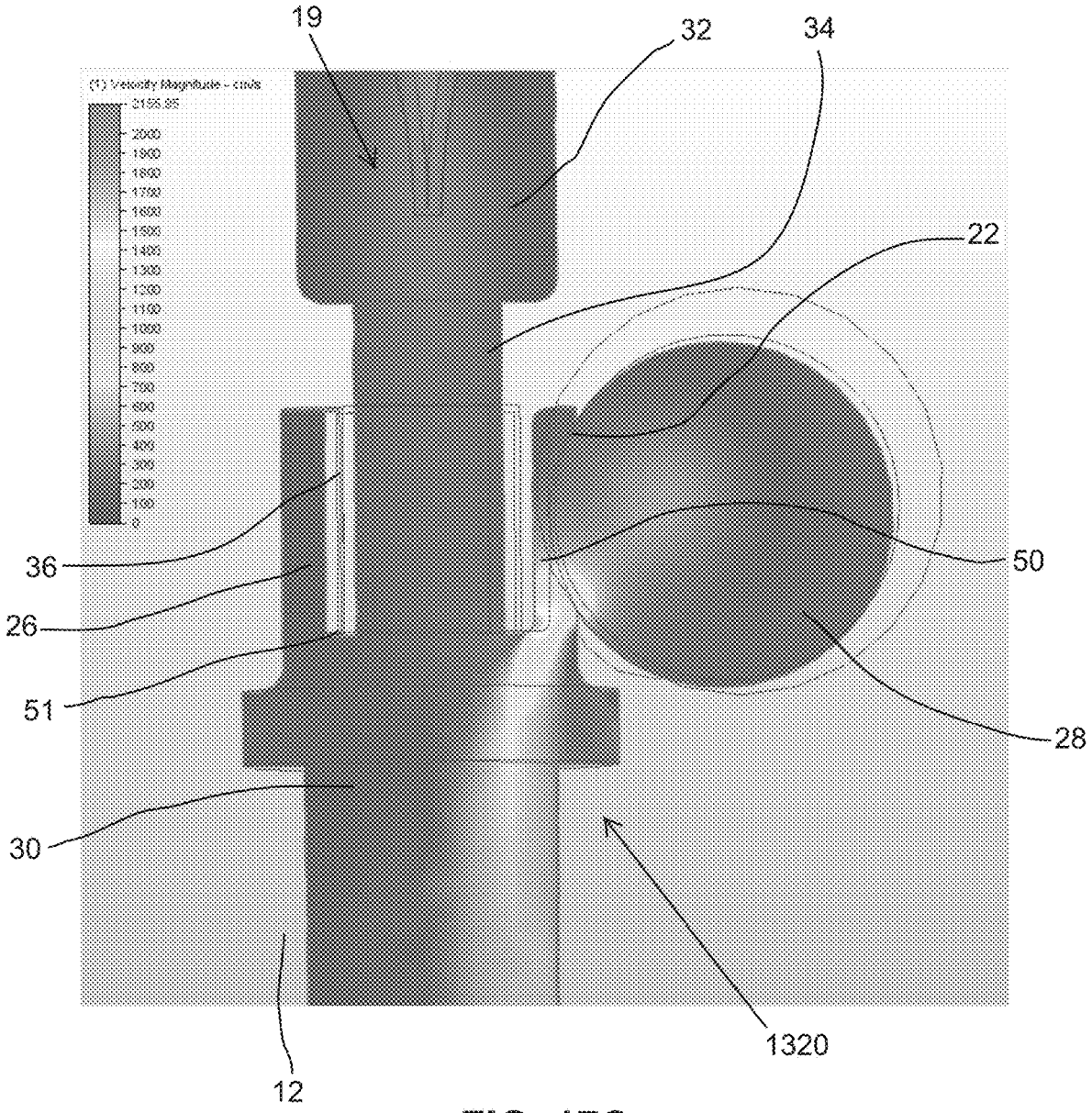
FIG. 17C is a cross-section view of the internal volume of an air inducer assembly including the air inducer of FIG. 17B, with velocities at air inlet and liquid outlet illustrated quantitatively.

FIGS. 17A-17C illustrate an embodiment of an air inducer 1320 configured similarly to the air inducer 20 of FIGS. 2-3A with the addition of ribs 50 as described herein, in which the diameter DT of the tube 36 is greater than in the air inducer of FIGS. 2-3A. In the embodiment of FIGS. 17A-17C, the length L of the tube 36 is 0.303 inch, the diameter DC of the chamber 26 is 0.395 inch, and the diameter DT of the tube 36 is 0.280 inch. The tube 36 in this embodiment terminates within the chamber 26 and above the top of the recess 37. The ribs 50 in this embodiment extend from the top wall 38 of the chamber 26 to the distal end 51 of the tube 36 and terminate at the distal end 51 of the tube 36, such that the lengths of the tube 36 and the ribs 50 are equal. This embodiment exhibited superior mass flow balance performance relative to the air inducer 20 of FIGS. 2-3B, and superior performance relative to the assemblies 420, 520 of FIGS. 8A-9B.

Figure 18A:
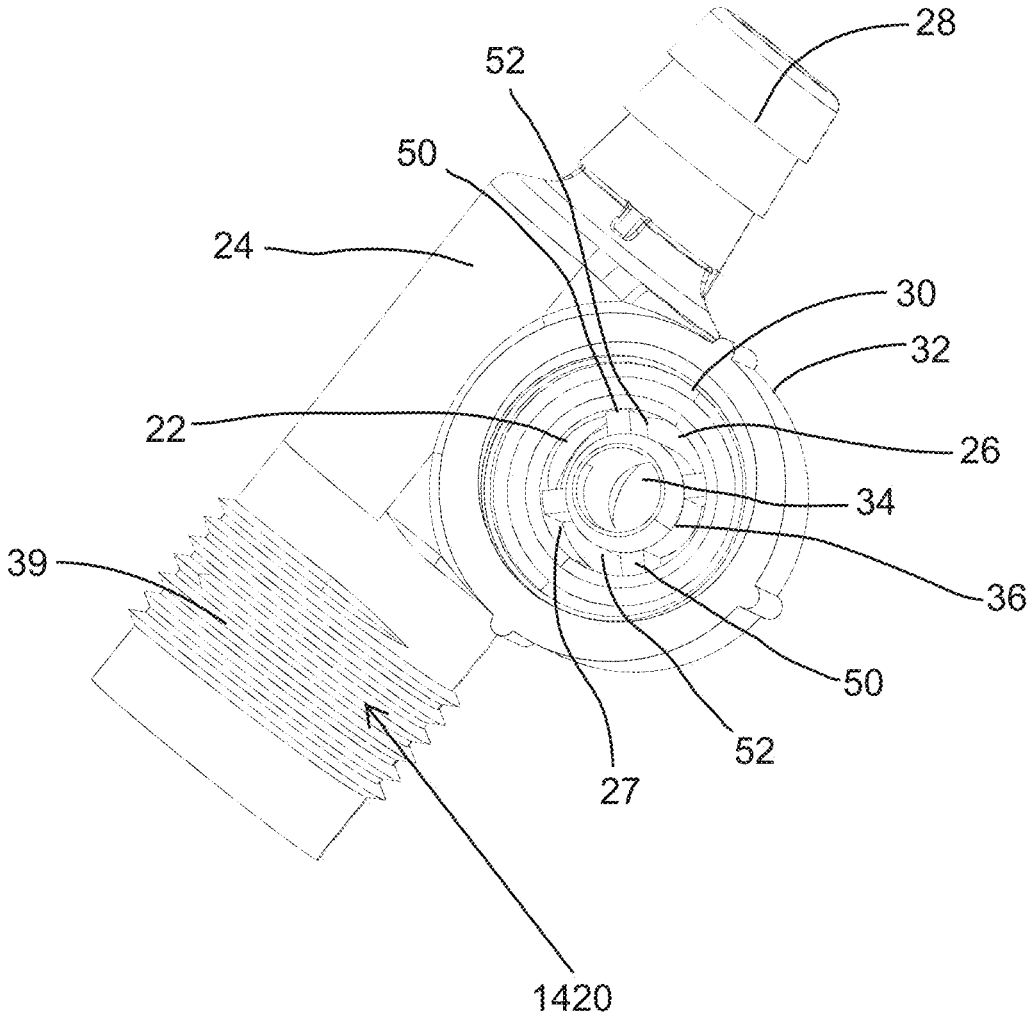
FIG. 18A is a perspective view of another embodiment of an air inducer usable in connection with the system of FIG. 1, according to aspects of the disclosure.
Figure 18B:
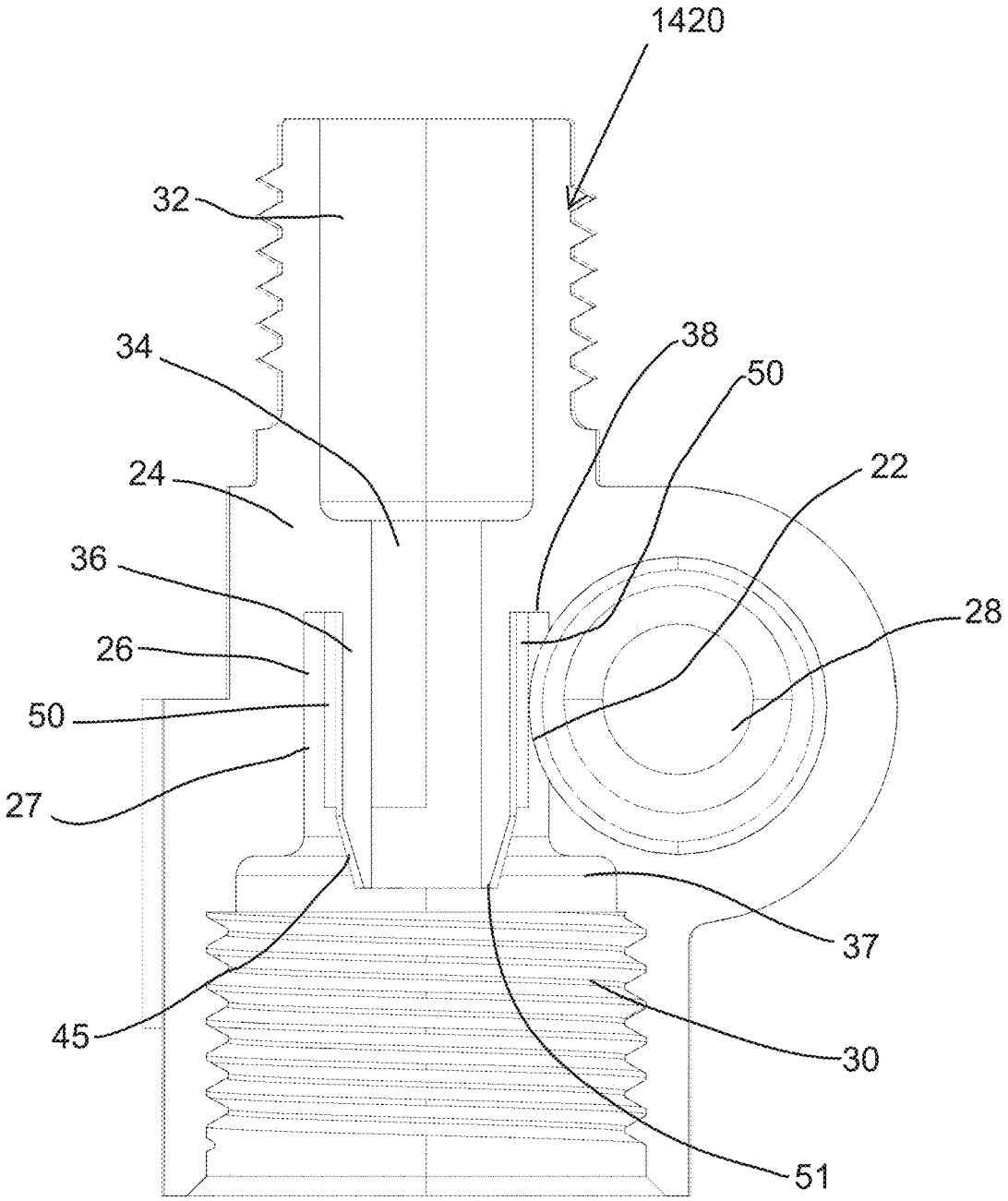
FIG. 18B is a cross-section view of the air inducer of FIG. 18A.
Figure 18C:
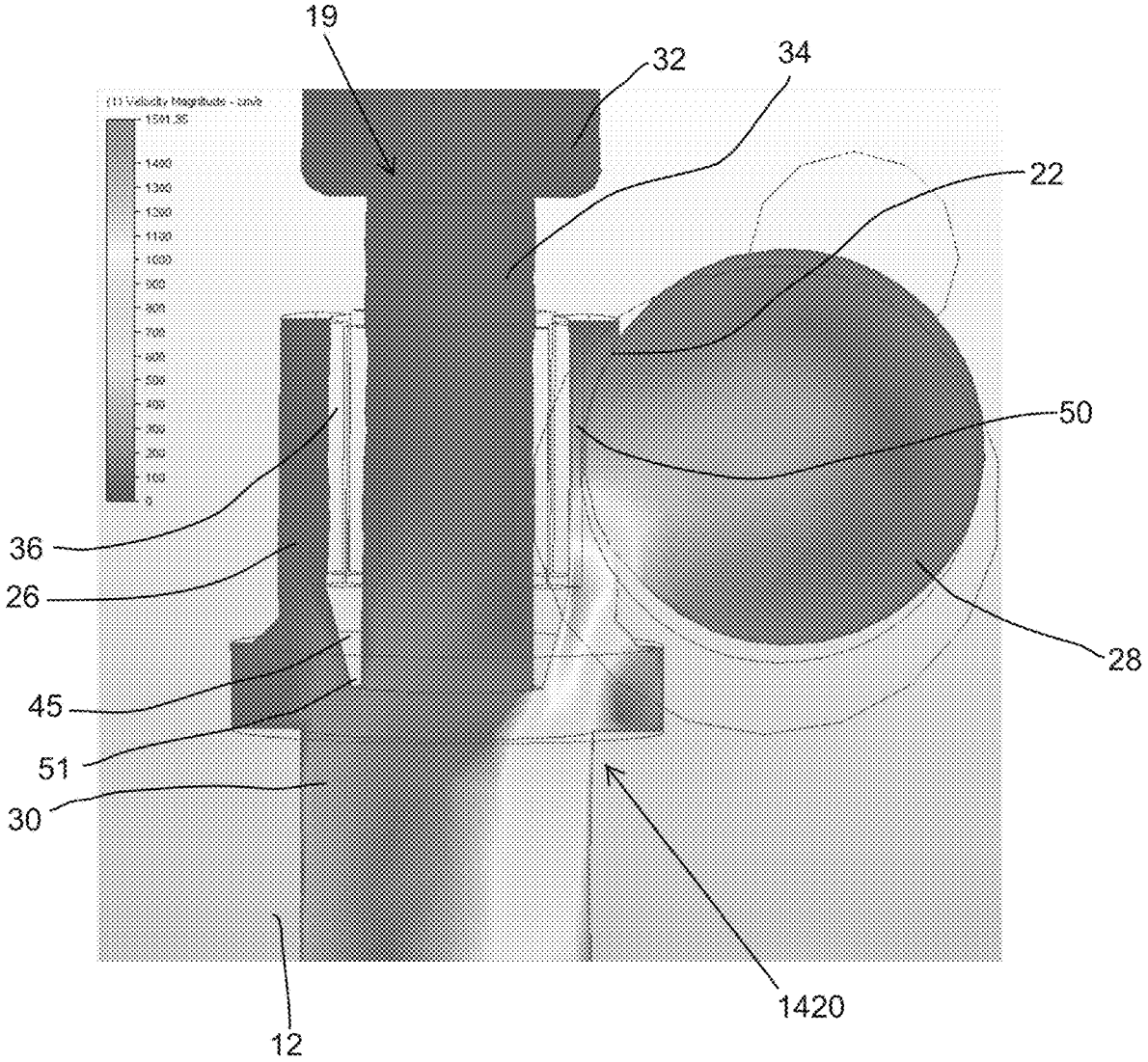
FIG. 18C is a cross-section view of the internal volume of an air inducer assembly including the air inducer of FIG. 18B, with velocities at air inlet and liquid outlet illustrated quantitatively.

FIGS. 18A-18C illustrate an embodiment of an air inducer 1420 configured similarly to the air inducer 20 of FIGS. 2-3A with the addition of ribs 50 as described herein, in which the length L of the tube 36 and the diameter DT of the tube 36 are greater than in the air inducer 20 of FIGS. 2-3A. In the embodiment of FIGS. 18A-18C, the length L of the tube 36 is 0.428 inch, the diameter DC of the chamber 26 is 0.395 inch, and the diameter DT of the tube 36 is 0.280 inch. The tube 36 in this embodiment terminates within the chamber 26 and above the top of the recess 37, and includes a chamfer 45 on the outer surface of the tube 36. The ribs 50 in this embodiment extend from the top wall 38 of the chamber 26 and terminate at the beginning of the chamfer 45, short of the distal end 51 of the tube 36, such that the length of the tube 36 is longer than the lengths of the ribs 50. This embodiment exhibited inferior mass flow balance performance relative to all other embodiments described herein.

Figure 19A:
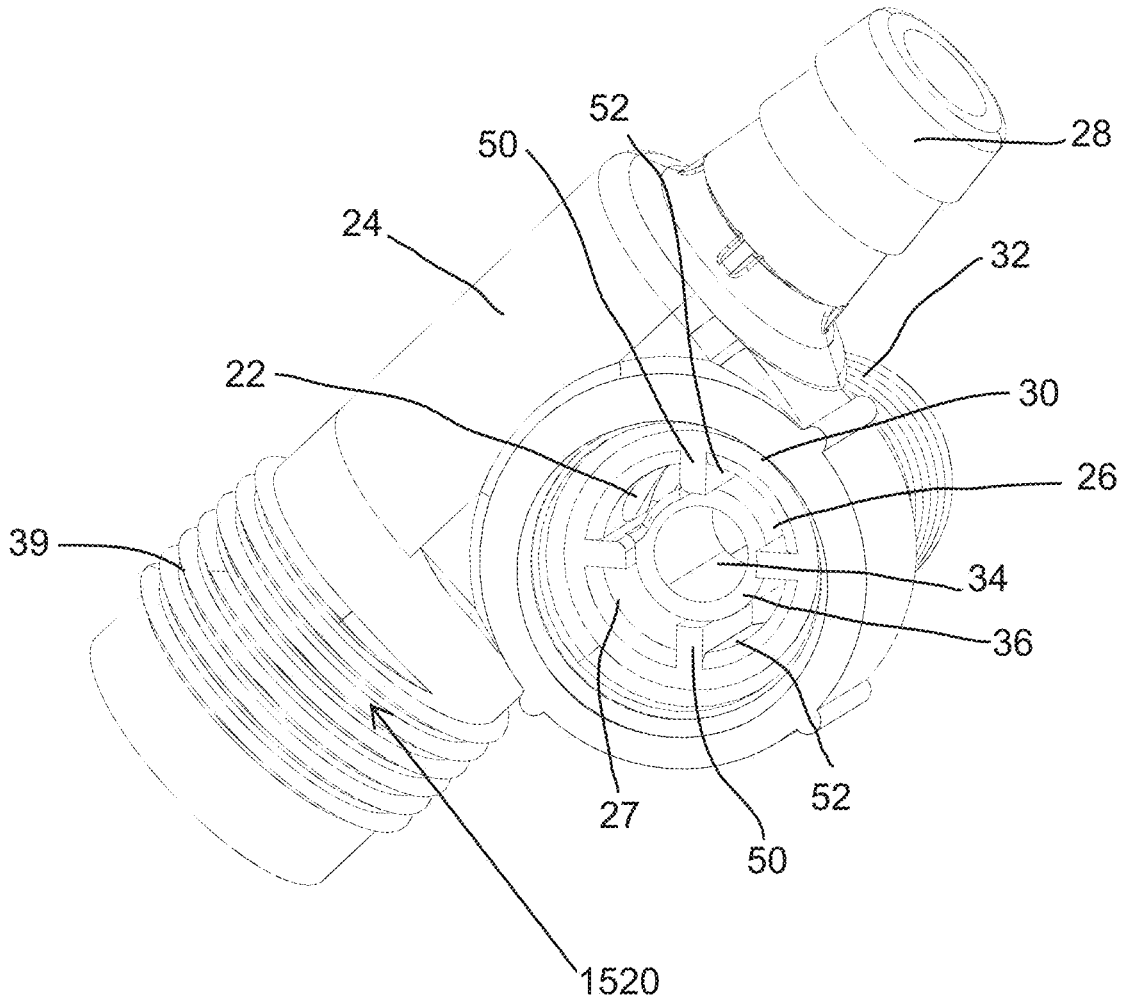
FIG. 19A is a perspective view of another embodiment of an air inducer usable in connection with the system of FIG. 1, according to aspects of the disclosure.
Figure 19B:
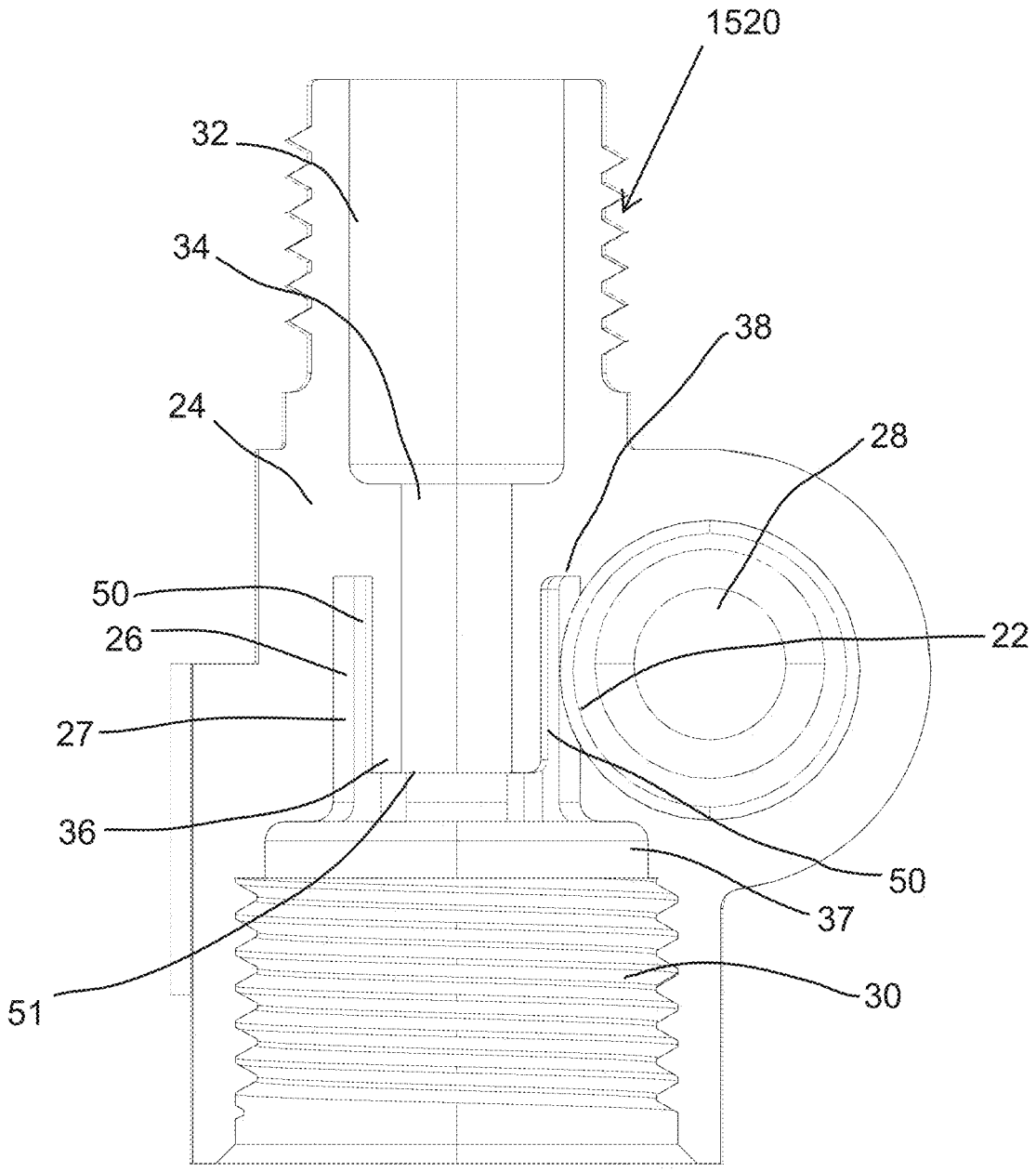
FIG. 19B is a cross-section view of the air inducer of FIG. 19A.
Figure 19C:
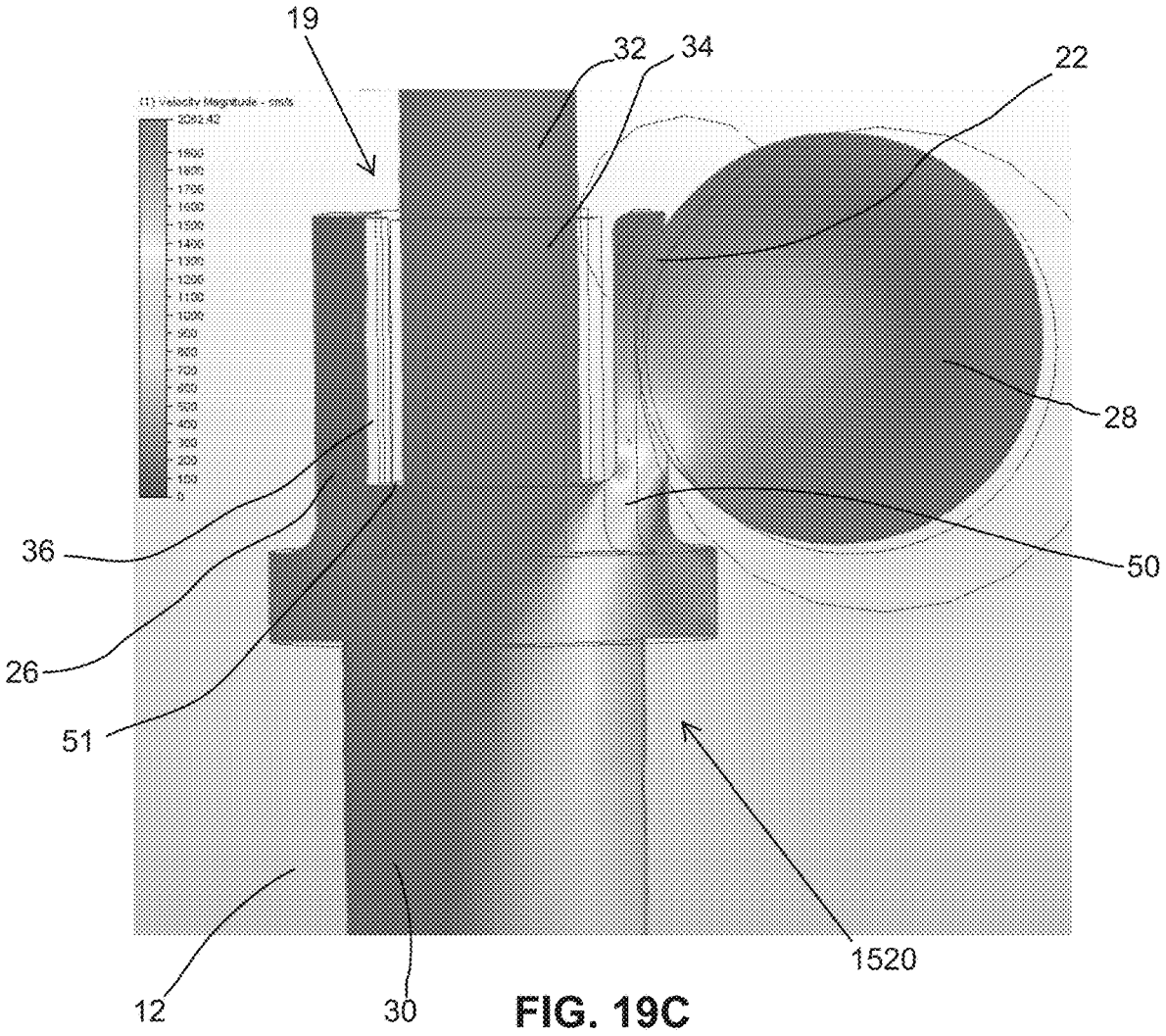
FIG. 19C is a cross-section view of the internal volume of an air inducer assembly including the air inducer of FIG. 19B, with velocities at air inlet and liquid outlet illustrated quantitatively.

FIGS. 19A-19C illustrate an embodiment of an air inducer 1520 configured similarly to the air inducer 20 of FIGS. 2-3A with the addition of ribs 50 as described herein, in which the diameter DT of the tube 36 is greater than in the air inducer 20 of FIGS. 2-3A. In the embodiment of FIGS. 19A-19C, the length L of the tube 36 is 0.303 inch, the diameter DC of the chamber 26 is 0.395 inch, and the diameter DT of the tube 36 is 0.280 inch. The tube 36 in this embodiment terminates within the chamber 26 and above the top of the recess 37. The ribs 50 in this embodiment extend from the top wall 38 of the chamber 26 beyond the distal end 51 of the tube 36 and terminate below the distal end 51 of the tube 36, such that the lengths of the tube 36 and the ribs 50 are equal. This embodiment exhibited superior mass flow balance performance relative to the air inducer 20 of FIGS. 2-3B, and superior performance relative to the assemblies 420, 520 of FIGS. 8A-9B.

Figure 20A:
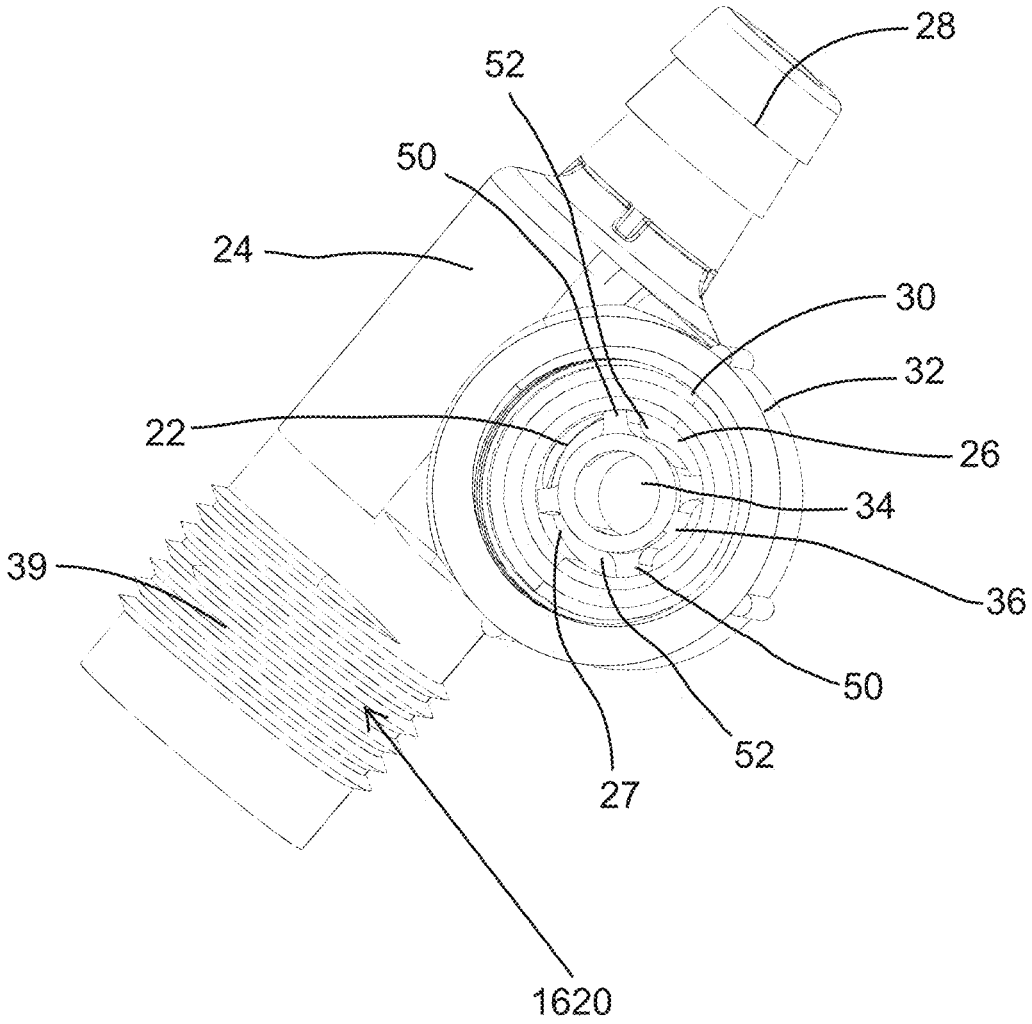
FIG. 20A is a perspective view of another embodiment of an air inducer usable in connection with the system of FIG. 1, according to aspects of the disclosure.
Figure 20B:
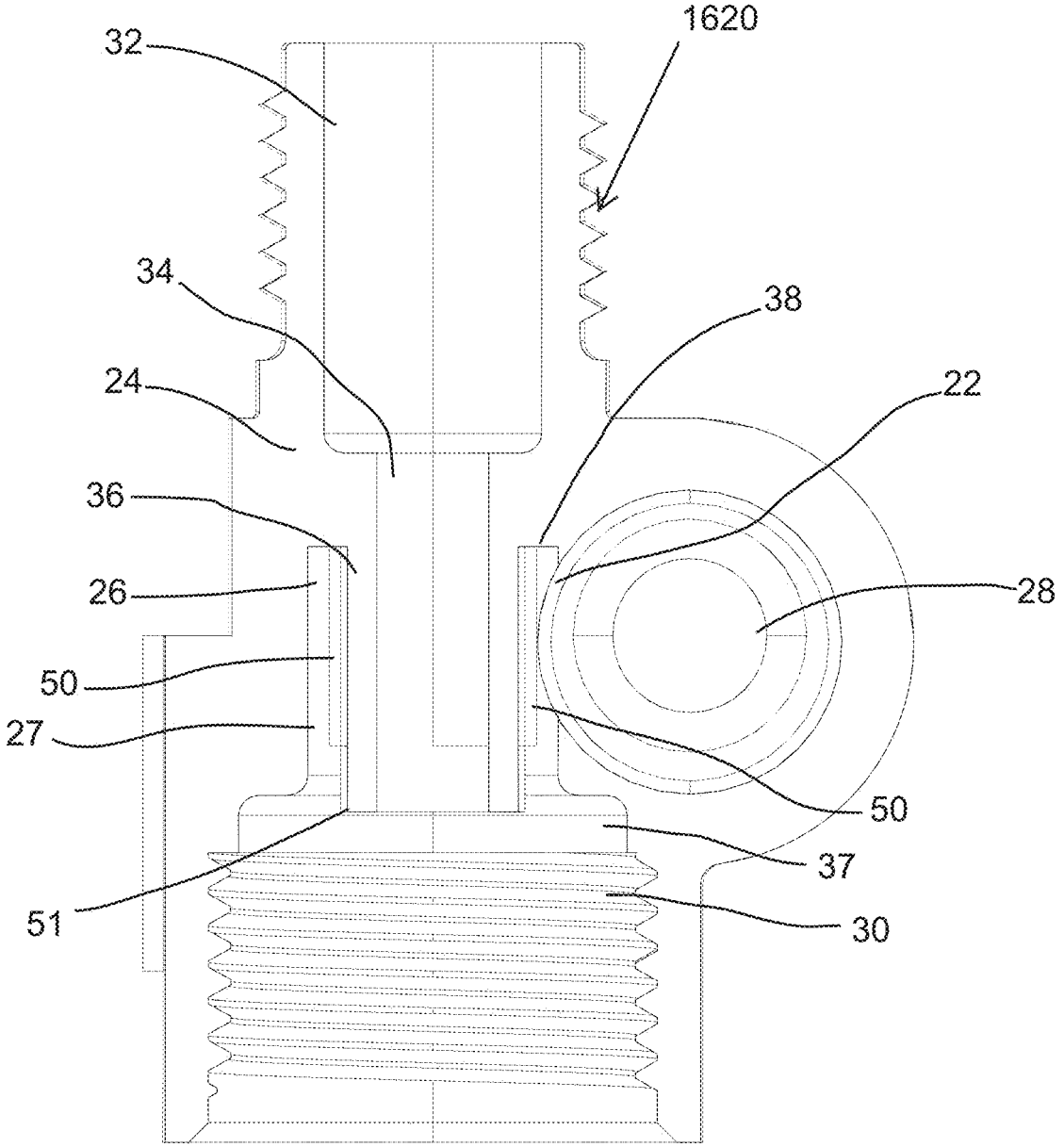
FIG. 20B is a cross-section view of the air inducer of FIG. 20A.
Figure 20C:
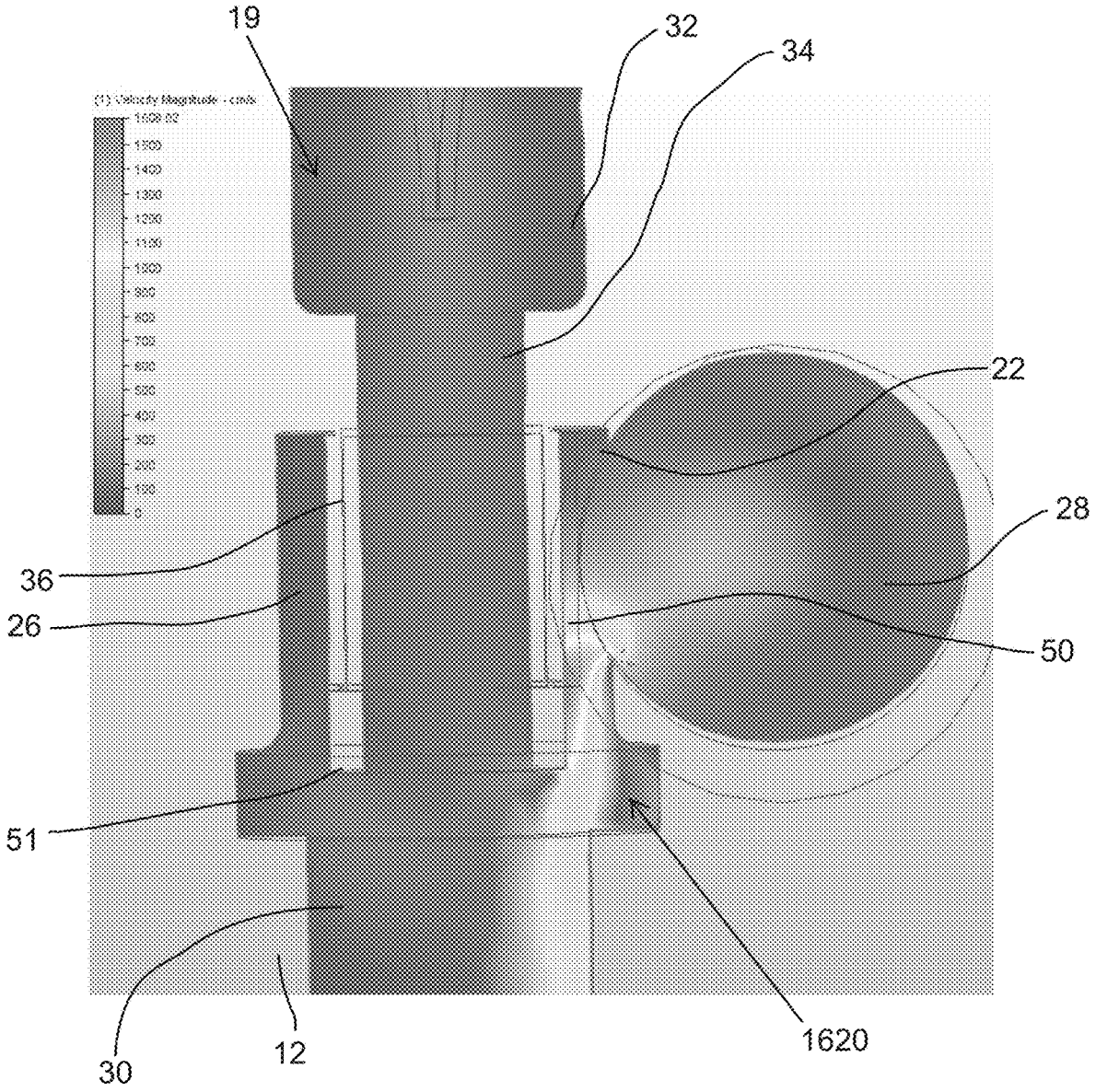
FIG. 20C is a cross-section view of the internal volume of an air inducer assembly including the air inducer of FIG. 20B, with velocities at air inlet and liquid outlet illustrated quantitatively.

FIGS. 20A-20C illustrate an embodiment of an air inducer 1620 configured similarly to the air inducer 20 of FIGS. 2-3A with the addition of ribs 50 as described herein, in which the diameter DT of the tube 36 is greater than in the air inducer of FIGS. 2-3A. In the embodiment of FIGS. 20A-20C, the length L of the tube 36 is 0.403 inch, the diameter DC of the chamber 26 is 0.395 inch, and the diameter DT of the tube 36 is 0.280 inch. The tube 36 in this embodiment terminates within the chamber 26 and above the top of the recess 37. The ribs 50 in this embodiment extend from the top wall 38 of the chamber 26 beyond the distal end 51 of the tube 36 and terminate below the distal end 51 of the tube 36, such that the lengths of the ribs 50 are greater than the length L of the tube 36. This embodiment exhibited superior mass flow balance performance relative to the air inducer 20 of FIGS. 2-3B, and superior performance relative to the assemblies 420, 520 of FIGS. 8A-9B.

Figure 21A:
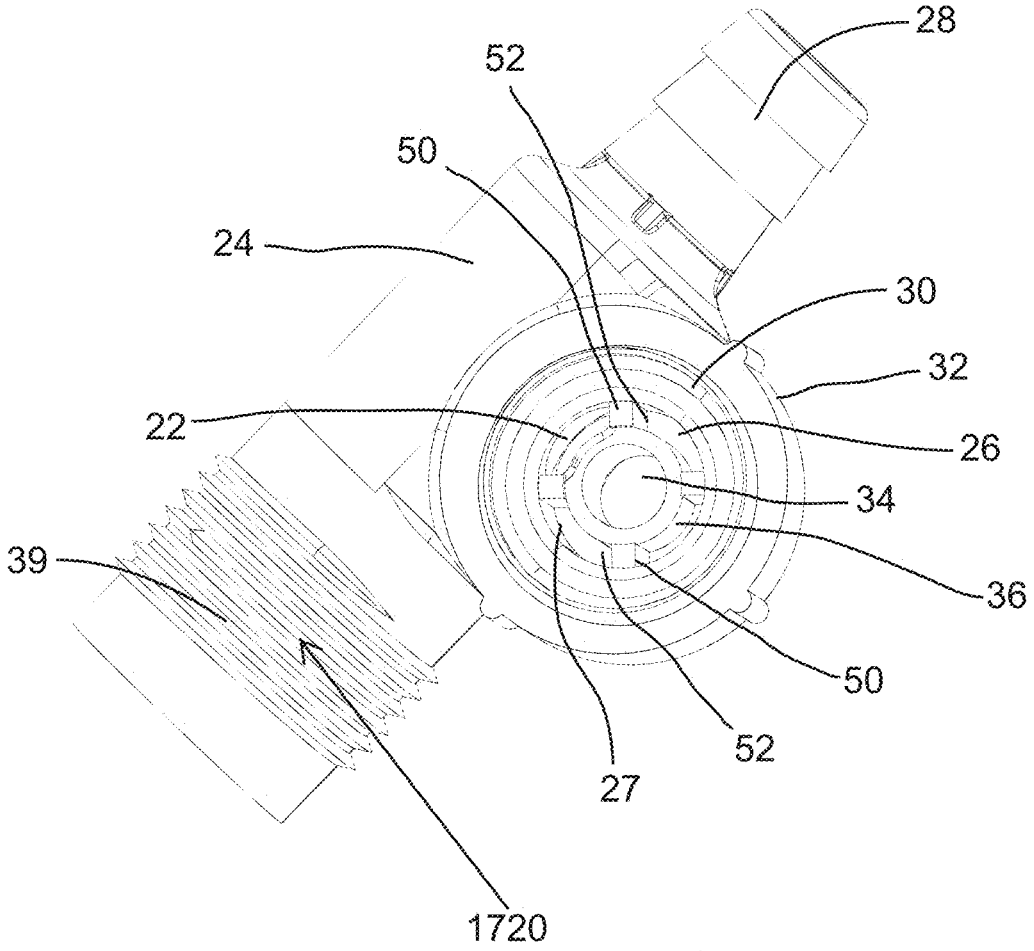
FIG. 21A is a perspective view of another embodiment of an air inducer usable in connection with the system of FIG. 1, according to aspects of the disclosure.
Figure 21B:
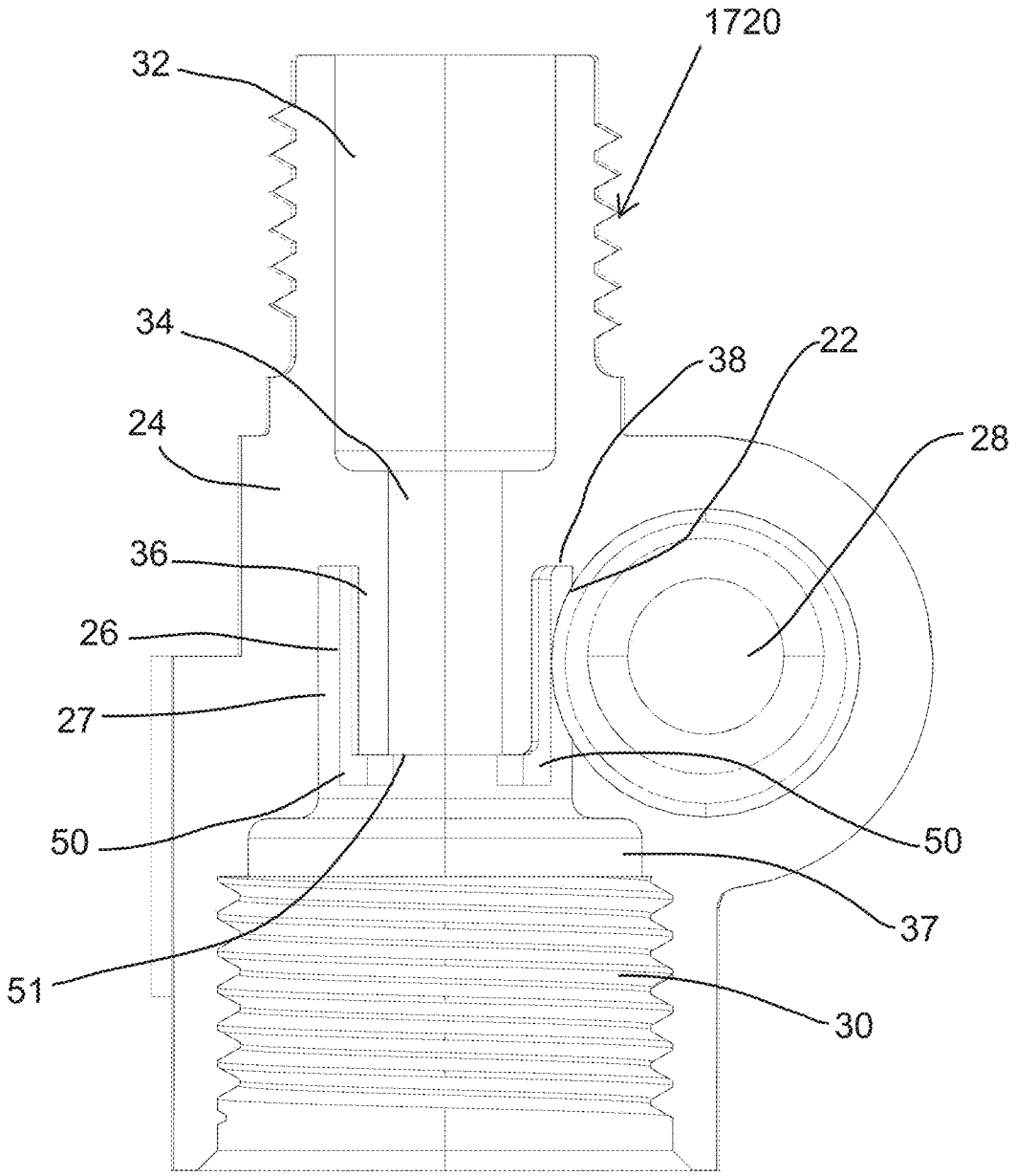
FIG. 21B is a cross-section view of the air inducer of FIG. 21A.
Figure 21C:
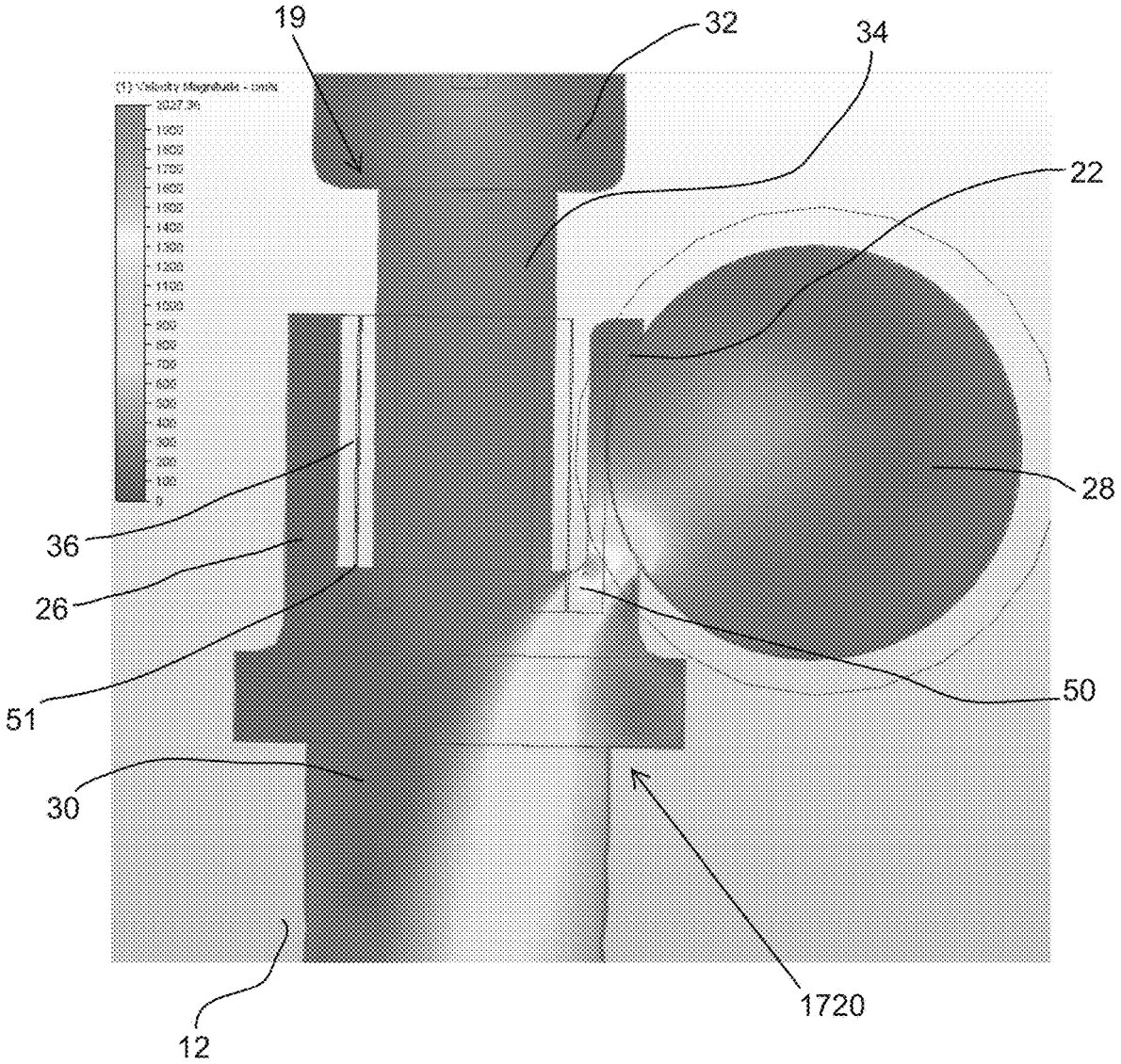
FIG. 21C is a cross-section view of the internal volume of an air inducer assembly including the air inducer of FIG. 21B, with velocities at air inlet and liquid outlet illustrated quantitatively.
Figure 22:
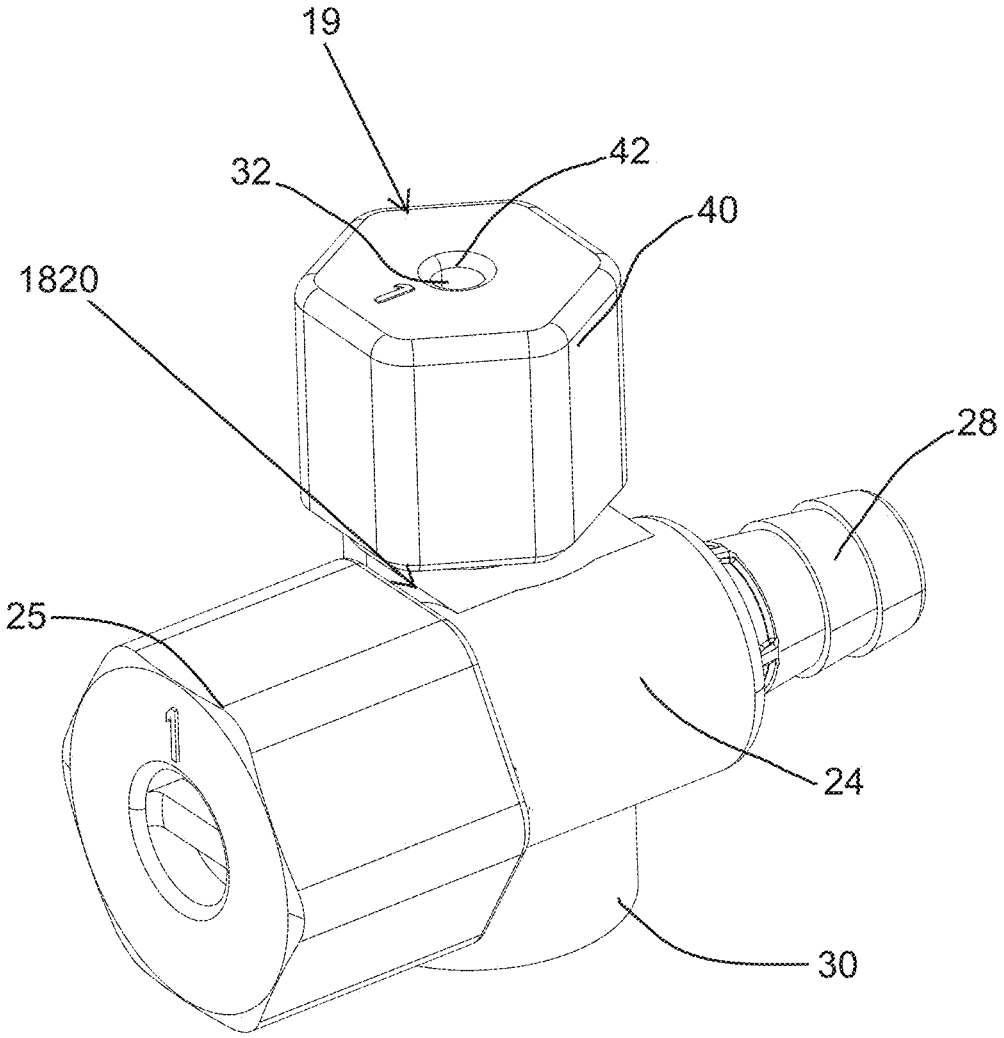
FIG. 22 is a perspective view of another embodiment of an air inducer assembly usable in connection with the system of FIG. 1, according to aspects of the disclosure.
Figure 23:
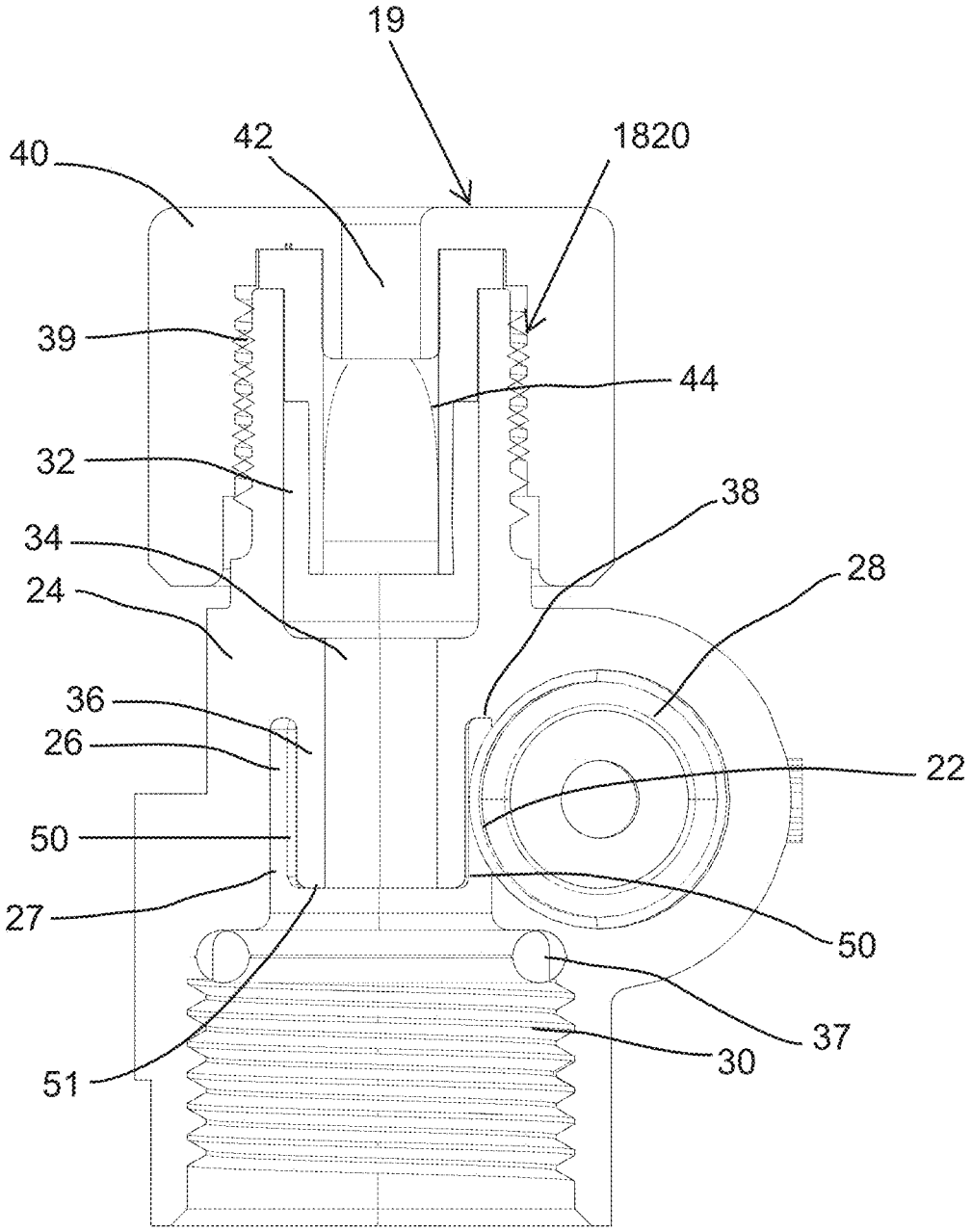
FIG. 23 is a cross-section view of the air inducer assembly of FIG. 22.
Figure 24:
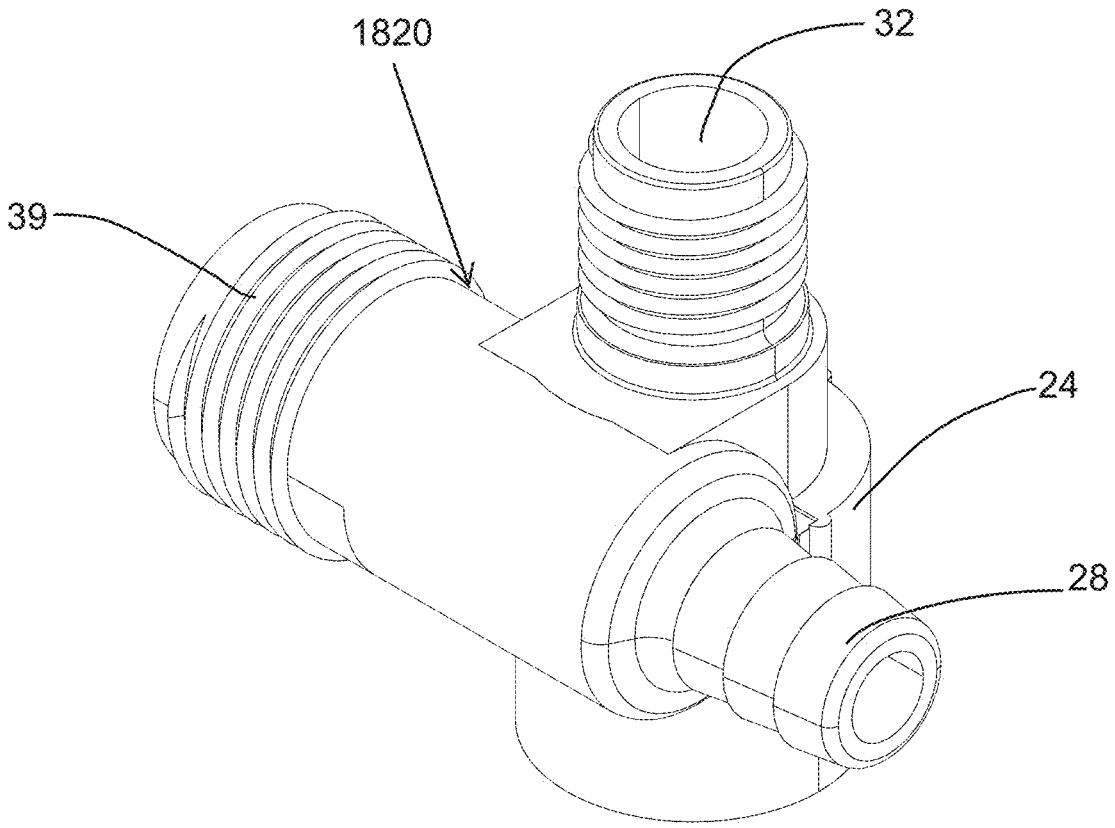
FIG. 24 is a perspective view of the air inducer of the air inducer assembly of FIG. 22.
Figure 25:
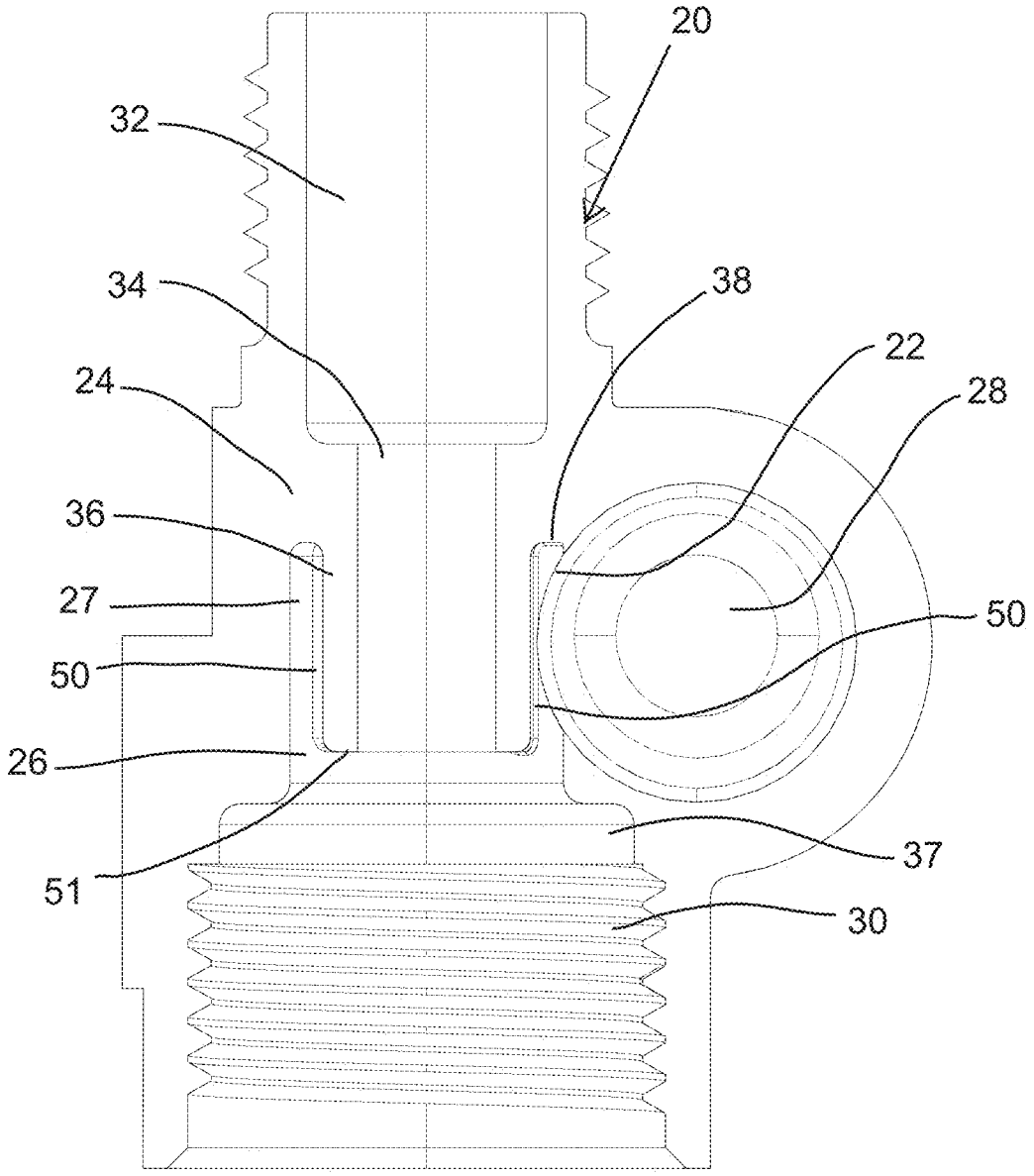
FIG. 25 is a cross-section view of the air inducer of FIG. 24.
Figure 26:
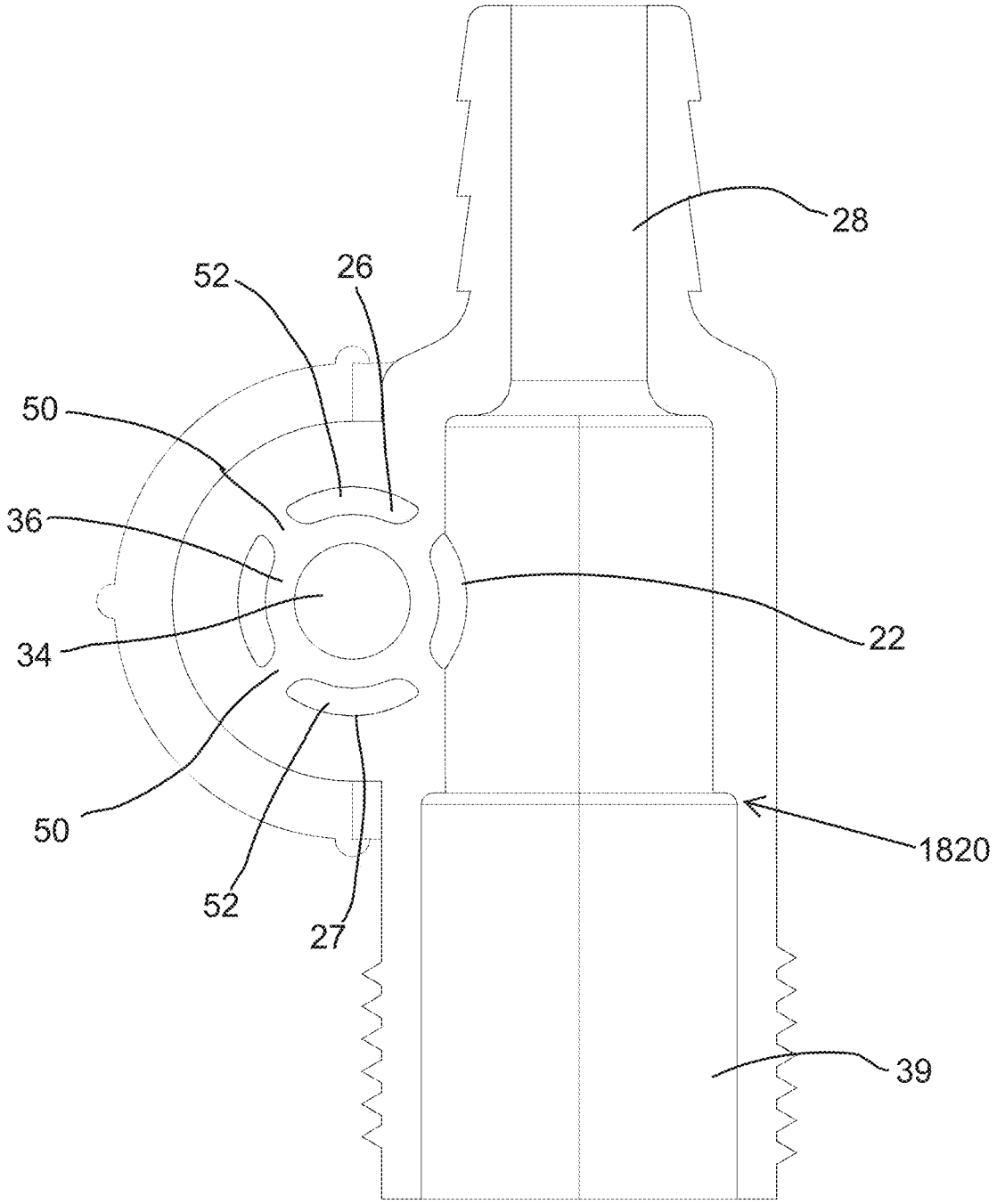
FIG. 26 is another cross-section view of the air inducer of FIG. 24.
Figure 27:
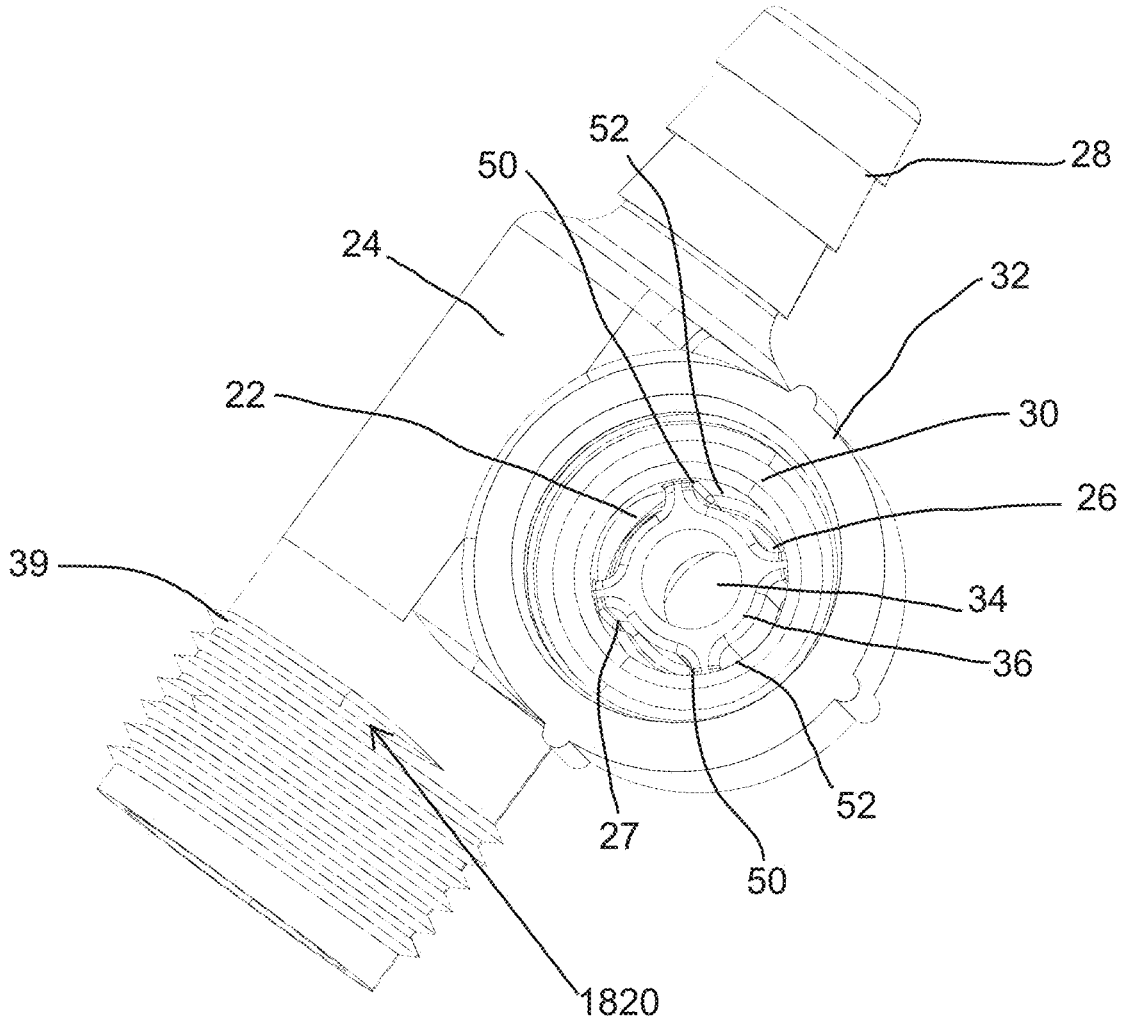
FIG. 27 is a partially broken-away bottom view of the air inducer of FIG. 24.
Figure 28:
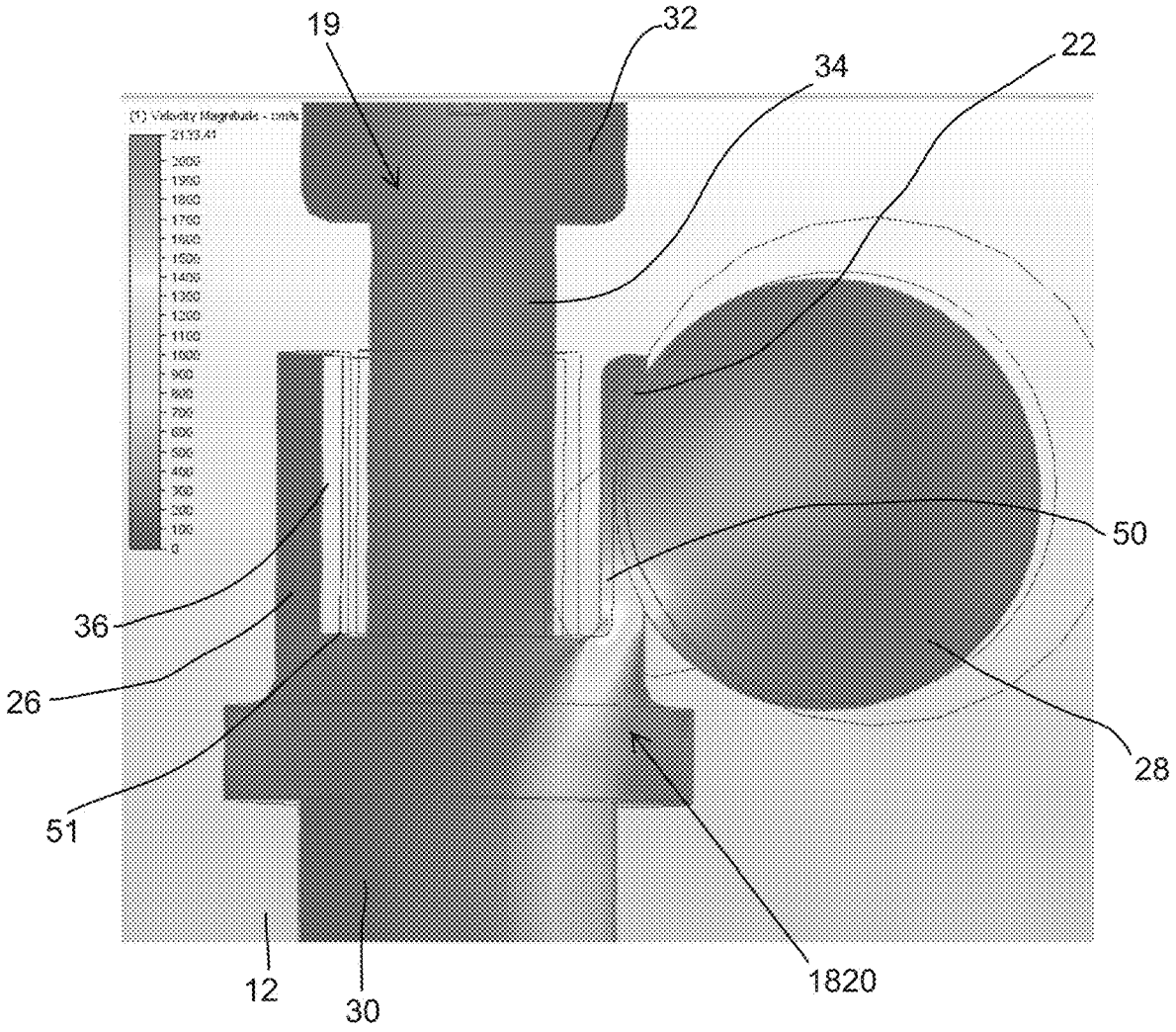
FIG. 28 is a cross-section of the internal volume of the air inducer assembly of FIG. 23, with velocities at air inlet and liquid outlet illustrated quantitatively.

FIGS. 21A-21C illustrate an embodiment of an air inducer 1720 configured similarly to the air inducer 20 of FIGS. 2-3A with the addition of ribs 50 as described herein, in which the diameter DT of the tube 36 is greater, and the length L of the tube 36 is shorter, than in the air inducer of FIGS. 2-3A. In the embodiment of FIGS. 21A-21C, the length L of the tube 36 is 0.283 inch, the diameter DC of the chamber 26 is 0.395 inch, and the diameter DT of the tube 36 is 0.280 inch. The tube 36 in this embodiment terminates within the chamber 26 and above the top of the recess 37. The ribs 50 in this embodiment extend from the top wall 38 of the chamber 26 beyond the distal end 51 of the tube 36 and terminate below the distal end 51 of the tube 36, such that the lengths of the ribs 50 are greater than the length L of the tube 36. The tube 36 in this embodiment has a smaller length L than the tube 36 in the air inducer 1320 of FIGS. 17A-17C, but the ribs 50 are the same length as in FIGS. 17A-17C, creating the different lengths of the ribs 50 and the tube 36. This embodiment exhibited superior mass flow balance performance relative to the air inducer 20 of FIGS. 2-3B, and superior performance relative to the assemblies 420, 520 of FIGS. 8A-9B.

Figure 30:
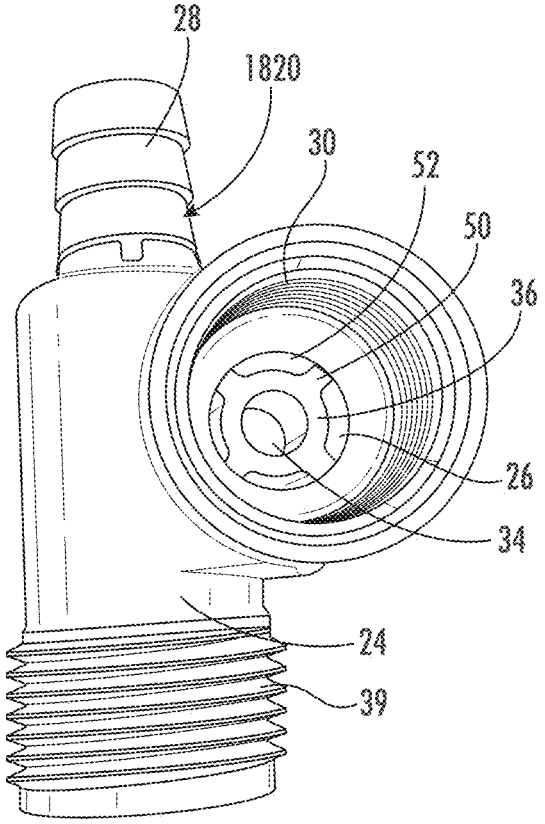
FIG. 30 is a photograph of an embodiment of an air inducer usable in connection with the system of FIG. 1, similar to the air inducer of FIG. 24, according to aspects of the disclosure.

FIGS. 22-28 illustrate an embodiment of an air inducer 1820 configured similarly to the air inducer 20 of FIGS. 2-3A with the addition of ribs 50 as described herein, in which the diameter DT of the tube 36 is greater than in the air inducer of FIGS. 2-3A. FIG. 30 is a photograph illustrating an air inducer 1820 as shown in FIGS. 22-28. In the embodiment of FIGS. 22-28, the length L of the tube 36 is 0.303 inch, the diameter DC of the chamber 26 is 0.395 inch, and the diameter DT of the tube 36 is 0.300 inch. The tube 36 in this embodiment terminates within the chamber 26 and above the top of the recess 37. The ribs 50 in this embodiment extend from the top wall 38 of the chamber 26 to the distal end 51 of the tube 36 and terminate at the distal end 51 of the tube 36, such that the lengths of the tube 36 and the ribs 50 are equal. This embodiment exhibited superior mass flow balance performance relative to the air inducer 20 of FIGS. 2-3B, and superior performance relative to the assemblies 420, 520 of FIGS. 8A-9B. This embodiment provides good air draw performance, while not overly constricting flow of water through the chamber 26. Constricting water flow through the chamber 26 can weaken the ability of the flush actuator 14 to seal and thereby lead to increased flush volume. The air inducer 1820 in FIGS. 22-28 provides sufficiently high air draw and sufficient mass balance performance to enable a flush volume of 1.1 gallons per flush (GPF), or potentially smaller (e.g., 1.0 GPF or less).

Figure 32:
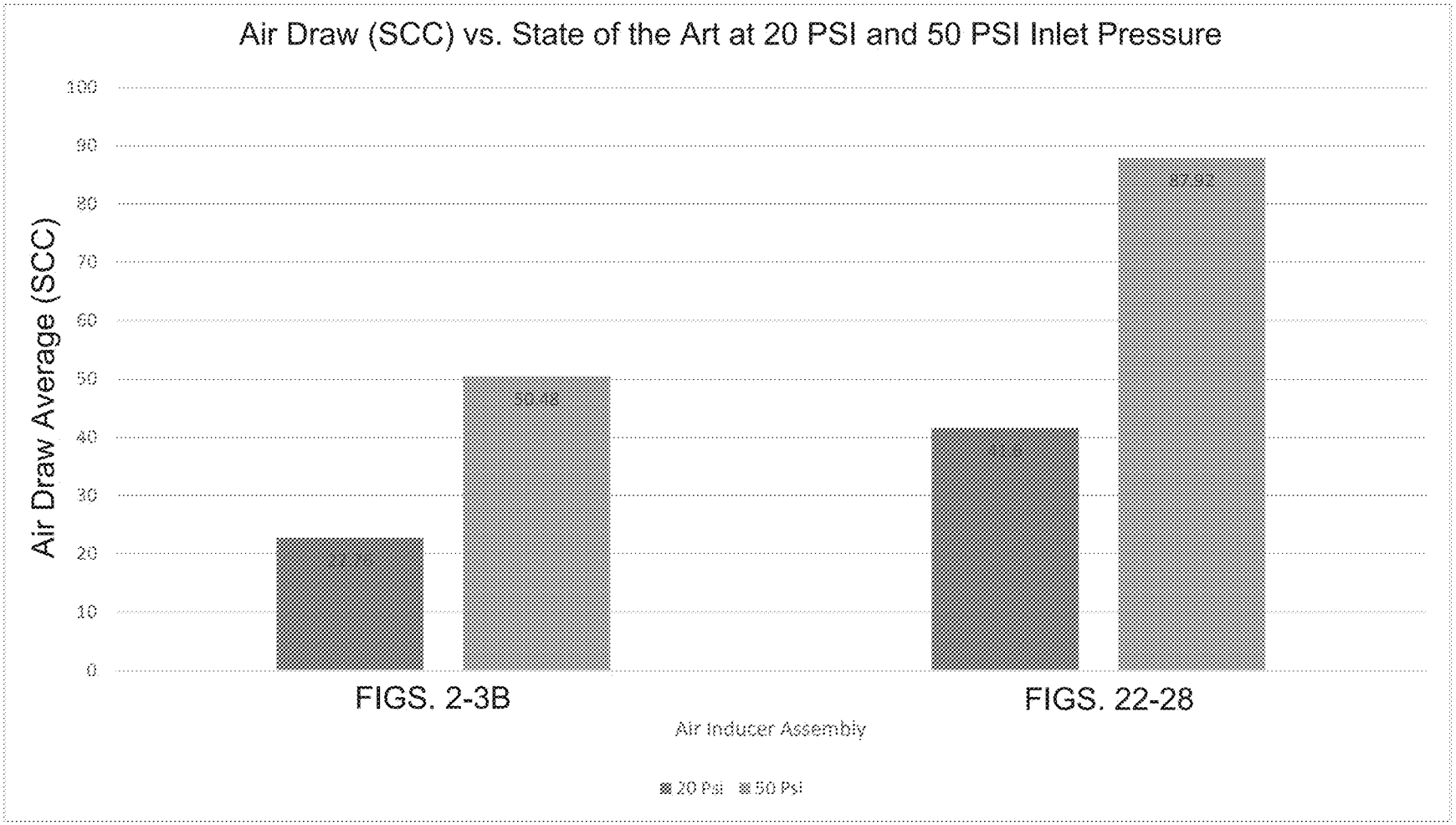
FIG. 32 is a graph illustrating air draw performance of the air inducer of FIGS. 2-3B compared to the air inducer of FIGS. 22-28, according to aspects of the disclosure.

In one embodiment, the air inducer 1820 according to the embodiment in FIGS. 22-28 produces improved air draw relative to an air inducer that does not include any ribs 50, such as the air inducer 20 in FIGS. 2-3B. This is true even in an air inducer that is otherwise identical other than the length of the tube 36, and at various different water pressures (e.g., 20 psi, 50 psi, etc.). The air draw improvement is at least 50% in one embodiment, from 50-100% in another embodiment, or from 70-90% in a further embodiment, measured as an average, either in standard cubic centimeters (SCC) or standard cubic centimeters per minute (SCCM). FIG. 32 illustrates air draw performance of the air inducer 1820 according to the embodiment of FIGS. 22-28 compared to the air inducer 20 of FIGS. 2-3B, measured in SCC, at water inlet pressures of both 20 psi and 50 psi. At an inlet pressure of 20 psi, the air inducer 1820 in FIGS. 22-28 produced, on average, an air draw of 41.6 SCC, which represents an 82.8% improvement over the average air draw of 22.76 SCC produced by the air inducer 20 of FIGS. 2-3B. At an inlet pressure of 50 psi, the air inducer 1820 in FIGS. 22-28 produced, on average, an air draw of 87.92 SCC, which represents a 74.2% improvement over the average air draw of 50.48 SCC produced by the air inducer 20 of FIGS. 2-3B.

Various embodiments of air inducers and air inducer assemblies have been described herein, which include various components and features. In other embodiments, the air inducer and/or the air inducer assembly may be provided with any combination of such components and features. It is also understood that in other embodiments, the various devices, components, and features of the air inducer and the air inducer assembly described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. An air inducer assembly comprising:
- a housing having one or more walls defining a chamber;
- an outlet located downstream from the chamber and configured for connection to an inlet of a flush tank;
- a water inlet in communication with the chamber and configured for connection to a water inlet conduit for introducing water into the chamber;
- an air inlet in communication with the chamber and configured to be in communication with a source of air;
- a tube extending into the chamber and toward the outlet, the tube having a passage therethrough extending from the air inlet through the tube to place the air inlet in communication with the outlet, wherein the tube is configured to permit air to be drawn from the air inlet through the tube and into the outlet by a flow of the water past a distal end of the tube; and
- a plurality of ribs extending from the tube to the one or more walls defining the chamber, wherein the ribs are spaced around a periphery of the tube to define spaces between the ribs.

2. The air inducer assembly of claim 1, wherein the ribs extend along a length of the tube and terminate at the distal end of the tube.

3. The air inducer assembly of claim 1, wherein the ribs extend along a length of the tube and terminate short of the distal end of the tube.

4. The air inducer assembly of claim 1, wherein the ribs extend along a length of the tube and extend beyond the distal end of the tube.

5. The air inducer assembly of claim 1, wherein the ribs and the water inlet are configured such that the water entering the chamber must pass through at least one of the spaces between the water inlet and the outlet.

6. The air inducer assembly of claim 1, wherein the ribs are spaced around the periphery of the tube at equal intervals.

7. The air inducer assembly of claim 1, wherein the housing has a recess in the one or more walls defining the chamber configured to receive a sealing member, wherein the recess is located at a bottom end of the chamber such that the outlet is located below a top of the recess, and wherein the distal end of the tube is located within the chamber.

8. The air inducer assembly of claim 1, further comprising a check valve connected to the housing at the air inlet and configured to permit the air to flow through the air inlet and into the passage and to resist air flow out of the air inducer assembly through the air inlet.

9. The air inducer assembly of claim 1, wherein the distal end of the tube is chamfered on at least one of an inner surface and an outer surface of the tube.

10. The air inducer assembly of claim 1, wherein the plurality of ribs extend radially with respect to the tube between the tube and the one or more walls defining the chamber, and the plurality of ribs further extend lengthwise along the tube.

11. The air inducer assembly of claim 1, wherein the air inducer assembly, in use, is configured to produce at least 50% increased air draw relative to an identical air inducer assembly that does not include the plurality of ribs.

12. The air inducer assembly of claim 1, wherein the air inducer assembly, in use, is configured to produce 50% to 100% increased air draw relative to an identical air inducer assembly that does not include the plurality of ribs.

13. The air inducer assembly of claim 1, wherein the air inducer assembly, in use, is configured to produce 70% to 90% increased air draw relative to an identical air inducer assembly that does not include the plurality of ribs.

14. An air inducer assembly comprising:

a housing having one or more walls defining a chamber, the housing having a recess in the one or more walls located at a bottom end of the chamber;

a sealing member received in the recess;

an outlet located downstream from the chamber and below the recess and the sealing member, wherein the outlet is configured for connection to an inlet of a flush tank;

a water inlet in communication with the chamber and configured for connection to a water inlet conduit for introducing water into the chamber;

an air inlet in communication with the chamber and configured to be in communication with a source of air; and a tube extending into the chamber and toward the outlet, the tube having a distal end located below a top of the recess in the housing, wherein a passage extends from the air inlet through the tube to place the air inlet in communication with the outlet, and wherein the tube is configured to permit air to be drawn from the air inlet through the tube and into the outlet by a flow of the water past the distal end of the tube.

15. The air inducer assembly of claim 14, wherein the distal end of the tube is located at or below a bottom of the recess.

16. The air inducer assembly of claim 15, wherein the air inducer assembly, in use, is configured to produce at least 50% increased air draw relative to an air inducer assembly in which the distal end of the tube is located above the top of the recess.

17. The air inducer assembly of claim 15, wherein the air inducer assembly, in use, is configured to produce 50% to 100% increased air draw relative to an air inducer assembly in which the distal end of the tube is located above the top of the recess.

18. The air inducer assembly of claim 15, wherein the air inducer assembly, in use, is configured to produce 60% to 80% increased air draw relative to an air inducer assembly in which the distal end of the tube is located above the top of the recess.

19. The air inducer assembly of claim 14, wherein the distal end of the tube is located below the recess and within the outlet.

20. The air inducer assembly of claim 14, further comprising a rib extending from the tube to the one or more walls defining the chamber.

21. The air inducer assembly of claim 14, further comprising a plurality of ribs extending from the tube to the one or more walls defining the chamber, wherein the ribs are spaced around a periphery of the tube to define spaces between the ribs.

22. The air inducer assembly of claim 21, wherein the plurality of ribs extend radially with respect to the tube between the tube and the one or more walls defining the chamber, and the plurality of ribs further extend lengthwise along the tube.

23. The air inducer assembly of claim 14, further comprising a check valve connected to the housing at the air inlet and configured to permit the air to flow through the air inlet and into the passage and to resist air flow out of the air inducer assembly through the air inlet.

24. The air inducer assembly of claim 14, wherein the distal end of the tube is chamfered on at least one of an inner surface and an outer surface of the tube.

25. The air inducer assembly of claim 14, wherein the outlet is configured to receive a threaded portion of the inlet of the flush tank and has internal threading configured for threading engagement with the threaded portion of the inlet, and wherein the distal end of the tube is located below an upper end of the threading.

26. A pressure-assist toilet flush system comprising:

a tank having an outlet configured for discharging water from the tank and an inlet having a threaded portion;

a flush cartridge configured for controlling discharge of the water from the outlet of the tank; and an air inducer assembly connected to the inlet and configured for introducing a mixture of air and the water into the tank, the air inducer assembly comprising:

a housing having one or more walls defining a chamber;

an outlet located downstream from the chamber and below a recess and a sealing member, wherein the outlet receives the threaded portion of the inlet of the tank and is connected to the inlet by complementary threading;

a water inlet in communication with the chamber and configured for connection to a water inlet conduit for introducing water into the chamber;

an air inlet in communication with the chamber and configured to be in communication with a source of air; and a tube extending into the chamber and toward the outlet, the tube having a distal end located within the outlet and within the inlet of the tank, wherein a passage extends from the air inlet through the tube to place the air inlet in communication with the outlet, and wherein the tube is configured to permit air to be drawn from the air inlet through the tube and into the inlet of the tank by a flow of the water past the distal end of the tube.

27. The pressure-assist toilet flush system of claim 26, further comprising a plurality of ribs extending from the tube to the one or more walls defining the chamber, wherein the ribs are spaced around a periphery of the tube to define spaces between the ribs.

28. The pressure-assist toilet flush system of claim 27, wherein the plurality of ribs extend radially with respect to the tube between the tube and the one or more walls defining the chamber, and the plurality of ribs further extend lengthwise along the tube.

29. The pressure-assist toilet flush system of claim 26, further comprising a check valve connected to the housing at the air inlet and configured to permit the air to flow through the air inlet and into the passage and to resist air flow out of the air inducer assembly through the air inlet.

30. The pressure-assist toilet flush system of claim 26, wherein the distal end of the tube is chamfered on at least one of an inner surface and an outer surface of the tube.

* * * * *